US005541052A

United States Patent [19]

Okusa et al.

[11] Patent Number: 5,541,052

[45] Date of Patent: Jul. 30, 1996

[54] SILVER HALIDE PHOTOGRAPHIC MATERIAL HAVING IMPROVED KEEPING QUALITY

[75] Inventors: Hiroshi Okusa; Syoji Matsuzaka; Hirofumi Ohtani, all of Hino, Japan

[73] Assignee: Konica Corporation, Tokyo, Japan

[21] Appl. No.: 341,896

[22] Filed: Nov. 15, 1994

Related U.S. Application Data

[63] Continuation of Ser. No. 5,867, Jan. 15, 1993, abandoned, which is a continuation of Ser. No. 758,723, Sep. 9, 1991, abandoned, which is a continuation of Ser. No. 556,445, Jul. 24, 1990, abandoned.

[30] Foreign Application Priority Data

Jul. 24, 1989 [JP] Japan ..... 190854

[51] Int. Cl.[6] ..... G03G 1/005

[52] U.S. Cl. ..... 430/567; 430/578; 430/584; 430/585; 430/576; 430/569; 430/744; 430/955

[58] Field of Search ..... 430/567, 569, 430/955, 578, 595, 584, 576, 744

[56] References Cited

U.S. PATENT DOCUMENTS

| | | | |
|---|---|---|---|
| 4,477,564 | 10/1984 | Cellone et al. | 430/567 |
| 4,710,455 | 12/1987 | Iguchi et al. | 430/567 |
| 4,769,315 | 9/1988 | Suda et al. | 430/567 |
| 4,865,959 | 9/1989 | Sakanolle et al. | 430/548 |
| 4,879,208 | 11/1989 | Wabe | 430/569 |
| 4,912,029 | 3/1990 | Asami | 430/567 |
| 4,952,489 | 8/1990 | Amicucci | 430/567 |
| 4,959,299 | 9/1990 | Sakanolle et al. | 430/544 |
| 5,004,679 | 4/1991 | Mifumi et al. | 430/567 |

FOREIGN PATENT DOCUMENTS

| | | | |
|---|---|---|---|
| 0193389 | 9/1986 | European Pat. Off. . | |
| 0232160 | 8/1987 | European Pat. Off. . | |
| 42737 | 11/1980 | Japan . | |
| 222842 | 11/1985 | Japan . | |
| 35440 | 2/1986 | Japan . | |
| 62-275236 | 11/1987 | Japan | 430/567 |
| 2222694 | 3/1990 | United Kingdom | 430/567 |

*Primary Examiner*—Thorl Chea

*Attorney, Agent, or Firm*—Finnegan, Henderson, Farabow, Garrett & Dunner, L.L.P.

[57] ABSTRACT

The improved silver halide photographic material has one or more silver halide emulsion layers on a support and at least one of said emulsion layers contains silver halide grains which are of normal crystal form having at least one concave crystal face. This photographic material has not only high sensitivity but also good keeping quality.

15 Claims, 1 Drawing Sheet

SILVER HALIDE PHOTOGRAPHIC MATERIAL HAVING IMPROVED KEEPING QUALITY

This application is a continuation of application Ser. No. 08/005,876, filed Jan. 15, 1993, now abandoned, which is a continuation of Ser. No. 07/758,723, filed Sep. 9, 1991, abandoned which is a continuation of Ser. No. 07/556,445, filed Jul. 24, 1990, abandoned.

BACKGROUND OF THE INVENTION

This invention relates to a silver halide photographic material, more particularly to a silver halide photographic material having not only improved keeping quality but also high sensitivity.

Silver halide crystals incorporated in silver halide emulsion layers for use in silver halide photographic materials are predominantly of normal (regular) shape.

Normal silver halide crystals have the advantage that they can be produced consistently and that desired shapes can be obtained. They also have high pressure resistance. Further, they permit the grain size to be controlled easily, thus contributing to ease in designing suitable photographic materials. Another advantage of normal silver halide crystals Is that the grain structures can be controlled easily. If, for example, a core/shell structure is to be formed, its composition can be easily controlled to provide a core of high iodine content and, at the same time, the thickness of the shell can also be controlled easily. Thus, normal silver halide crystals offer great benefits with respect to sensitivity and granularity.

In spite of these many advantages, normal crystals have a serious disadvantage in that their sensitivity has rather low aging stability. This problem is particularly great in normal crystals having (III) faces.

A method commonly employed to improve the aging stability of normal crystals is to increase the iodine content of their surface. This technique is effective in preventing the decrease in sensitivity with time but, on the other hand, the sensitivity of fresh samples (before aging) decreases and in addition, the improvement in keeping quality is unsatisfactory.

Normal crystal grains has the additional problem that their ability to adsorb dyes is generally weak and thus fail to provide a desired increase in sensitivity by treatment with spectral sensitizing dyes.

SUMMARY OF THE INVENTION

An object, therefore, of the present invention is to solve the aforementioned problems of the prior art by providing a silver halide photographic material that contains silver halide grains of normal crystal type and which yet has improved keeping quality and high sensitivity, particularly upon spectral sensitization.

This object of the present invention can be attained by a silver halide photographic material having one or more silver halide emulsion layers on a support, at least one of which emulsion layers contains silver halide grains which are of normal crystal form having at least one concave crystal face.

As a result of the intensive studies conducted on the production and properties of various silver halide crystals, the present inventors found that silver halide grains of normal crystal form having at least one concave face as described above (such grains are hereinafter sometimes referred to as the "silver halide grains of the present invention") were effective for attaining the purposes of the present invention. The present invention has been accomplished on the basis of this finding. The above-described ability of the silver halide grains of the present invention was quite surprising to the present inventors.

The photographic material of the present invention is useful not only in black-and-white silver halide photography (e.g. X-ray films, lithographic light-sensitive materials and black-and-white negative films for use with cameras) but also so in color photography (e.g. color negative films, color reversal films and color papers). The photographic material of the present invention is also useful as diffusion transfer light-sensitive materials (e.g. color diffusion transfer elements and silver halide diffusion transfer elements) and heat-processable light-sensitive materials (for both black-and-white and color photography).

In multi-color photographic materials which are usually adapted to reproduce colors by a subtractive process, blue-sensitive, green-sensitive and red-sensitive emulsion layers containing yellow, magenta and cyan couplers, respectively, and any necessary non-light-sensitive layers are superposed in suitable numbers and orders on a support. The numbers of these layers and the order of their arrangement can be changed as appropriate in accordance with the performance that must be attained and with the specific object of use.

Sensitizing dyes sometimes cause restrainment of development but in accordance with the present invention, this problem could be successfully solved by using a BAR compound (to be described hereinafter) in combination with the structure described above. This effect was also a surprising discovery in that it could only be attained by adopting the unique constitution of the present invention.

DETAILED DESCRIPTION OF THE INVENTION

Figure 1:
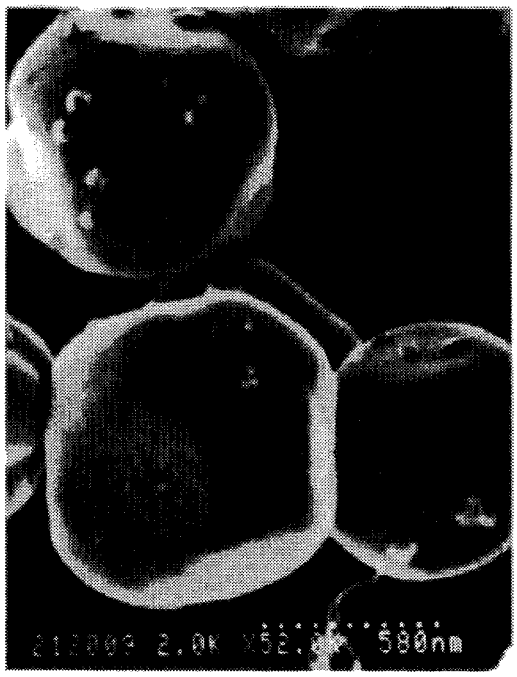
FIG. 1 is a scanning electron micrograph (SEM) showing the structure of grains in the emulsion EM-1 prepared in Example 1.

The term "a concave crystal face" as used herein means a crystal face that is concave with respect to the center of said face. See, for example, FIG. 1 which is a scanning electron micrograph (SEM) showing the structure of silver halide grains in the emulsion EM-1 prepared in Example 1 in accordance with the present invention. Obviously, at least one face of those grains is concave with respect to its center.

Silver halide grains of normal crystal form that have at least one concave crystal face can be prepared by the following procedure. In order to form a concave crystal surface, the crystal growth rate must differ greatly between the center of a certain face and its peripheral area. To this end, the crystal growth is preferably controlled in a subtle way either by using a crystal habit control agent which is adsorbed on a crystal surface to retard or accelerate the crystal growth or by performing control on such factors as pAg, pH and temperature.

Theoretically, such control may not be necessary to form a concave crystal face but in practice, this control seems to be necessary to prepare crystals having a concave face.

The exact reason why concave crystal faces are formed is yet to be clarified, but the following explanation may be put forward. In the case of "diffusion-controlled growth" of silver halide grains, where the liquid phase and the crystal phase are always in thermodynamic equilibrium in the vicinity of the crystal surface, the above-described control allows the crystal surface area in the neighborhood or edges and apexes to grow faster than the center of the face which has fewer lattice defects, whereby a concave face would be formed. The present inventors confirmed that the chance of the formation of such concave crystal surfaces increased when the above-described control was effected in the crystal growth from the interface where an abrupt change in halide composition occurred.

The silver halide grains used in the present invention may be of any composition such as silver chloride, silver bromide, silver chlorobromide, silver iodobromide or silver chloroiodobromide. Preferred compositions are silver iodobromide and silver chloroiodobromide, with silver iodobromide being particularly preferred.

The silver halide composition of crystal grains may be uniform but those having a "core/shell structure" in which the core is surrounded by a shell having a different composition from the core are preferred. In the grains of a core/shell structure, the shell may be uniform in composition but more preferably, it may be coated with another shell having a different composition to form a multi-layered structure.

In the case of using core/shell silver halide grains composed of silver iodobromide (or silver chloroiodobromide) in the present invention, the shell preferably has a silver iodide content of 2–40 mol %, more preferably 10–40 mol %, with the range of 15–40 mol %, being most preferred. preferably, the core has a higher silver iodide content on average than the shell.

The silver halide crystal grains to be used in the present invention, preferably have (III) faces as in the case of octahedral or tetradecahedral crystals.

In preparing silver halide grains composed of silver iodobromide (or silver chloroiodobromide) that are to be used in the present invention, iodine ions may be added either as an ionic solution exemplified by a solution of potassium iodide or as silver halide grains having a smaller solubility product than the growing silver halide grains. More preferably, iodine ions are added as silver halide grains having a smaller solubility product (to be described below in detail) than the growing grains.

In a preferred embodiment of the present invention, an emulsion containing silver halide grains is prepared in such a way that the silver halide grains are grown in at least part of the their growth stage in the presence of fine silver halide grains having a solubility product equal to or smaller than that of the growing silver halide grains. For the purpose of the following description of grain growth, the silver halide grains to be grown are referred to as "AgX grains (1)" whereas the fine grains having a solubility product not greater than that of AgX grains (1) are referred to as "AgX grains (2)".

The term "solubility product" as used herein has the meaning established in chemistry.

In the embodiment described above, AgX grains (2) are present in at least part of the growth stage of AgX grains (1) so that they are allowed to grow in the presence of said AgX grains (2) which have a solubility product equal to or smaller than that off the AgX grains (1). If desired, AgX grains (1) can be grown with AgX grains (2) being allowed to exist before the end of supply of grain growing elements (e.g. solution of halide ions and a solution of silver ions).

The AgX grains (2) generally have a smaller average size than AgX grains (1) but they may sometimes have a greater average size than the latter. In addition, AgX grains (2) are usually such that they substantially lack light sensitivity. The average size of AgX grains (2) is preferably in the range of 0.001–0.7 μm, more preferably 0.01–0.3 μm, with the range of 0.1–0.01 μm being most preferred.

AgX grains (2) are preferably allowed to exist in the mother liquor (i.e., the suspension system where AgX grains (1) are to be prepared) for a certain period of time that starts not later than the end of the growth or AgX grains (1).

When silver halide seed grains are used, AgX grains (2) may be incorporated into the mother liquor before said seed grains. Alternatively, they may be added to the mother liquor containing seed grains prior to the grain growing composition. If desired, they may be added as grain growing elements are added, or they may be added in two or more stages of the periods of addition described above.

If silver halide grains are to be grown after they are formed in the absence of seed crystals. AgX grains (2) are preferably added after the formation of said silver halide grains, and they may be added prior to or during the addition of grain growing elements or they may be added in two or more stages.

AgX grains (2) and grain growing elements may be added in one step; alternatively, they may be added continaously or intermittently in divided portions.

AgX grains (2) and grain growing elements are preferably added to the mother liquor by a multi-jet method such as a double-jet method at a rate commensurate to the growth of grains, with pH, pAg, temperature and other parameters being controlled.

AgX grains (2) and seed silver halide grains may be prepared within the mother liquor or they may be added to the mother liquor after they are prepared on a separate site.

An ammoniacal silver salt solution is preferably used as a water-soluble silver salt solution to prepare AgX grains (2).

If AgX grains (1) are composed of silver iodobromide, AgX grains (2) are preferably composed of silver iodide or silver iodobromide having a higher iodine content than the growing silver iodobromide grains. If AgX grains (1) are composed of silver chlorobromide, AgX grains (2) are preforably composed of silver bromide or silver chlorobromide having a higher bromine content than the growing silver chlorobromide grains. If AgX grains (1) are composed of silver iodobromide, it is particularly preferred that AgX grains (2) are composed of silver iodide.

If AgX grains (1) are composed of silver iodobromide or silver chloroiodobromide, all or the iodine content to be used for grain growth is preferably supplied as AgX grains (2) but, if desired, part or such iodine content may be supplied as an aqueous halide solution to an extent that is not deleterious to the objects of the present invention.

The silver halide grains to be used in the present invention retain the inherent advantages of normal crystal grains and yet they have the additional advantage of increased sensitivity, particularly upon spectral sensitization. Thus, the major problem associated with conventional normal crystal grains is successfully solved by the silver halide grains of the present invention.

An emulsion for providing a silver halide emulsion layer that contains the silver halide grains of the present invention is preferably subjected to spectral sensitization in the manner described below. To state more specifically, a silver halide emulsion to be used in the photographic material of the present invention, in particular, an emulsion containing the silver halide grains of the present invention, preferably contains a spectral sensitizing dye incorporated therein for the purpose of imparting spectral sensitivity in a desired wavelength range of light.

Various dyes can be used as spectral sensitizing dyes and they include polymethine dyes such as cyanine, merocyanine, holopolar cyanine, complex cyanine, complex merocyanine, oxonol, hemioxonol, styryl, merostyryl, streptocyanlne and pyrylium dyes. These dyes may be represented by the following general formulas:

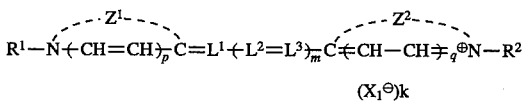

(S-1)

where $Z^1$ and $Z^2$ which may be the same or different each denotes the group of non-metallic atoms necessary to form a 5- or 6-membered hetero ring; $R_1$ and $R_2$ which may be the same or different each denotes an alkyl group or a substituted alkyl group; $L^1$, $L^2$ and $L^3$ are each a methine group or a substituted methine group; p and q are each 0 or 1; m is 0, 1, 2 or 3, provided that when m is 2 or more,—$L^2$=$L^3$—may be the same or different; $X_1^-$ is an anion; and k is 0 or 1;

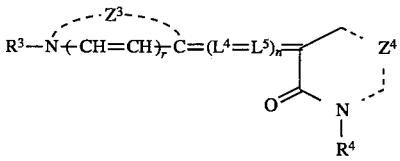

(S-II)

where $Z^3$ has the same meaning as $Z^1$ or $Z^2$; $R^3$ has the same meaning as $R^1$ or $R^2$; $L^4$ and $L^5$ have the same meaning as $L^1$, $L^2$ and $L^3$; $Z^4$ denotes the group of non-metallic atoms necessary to form a 5- or 6-membered hetero ring; $R^4$ is a hydrogen atom, an alkyl group, a substituted alkyl group, an aryl group, a substituted aryl group or a heterocyclic group; r has the same meaning as p and q; and n has the same meaning as m;

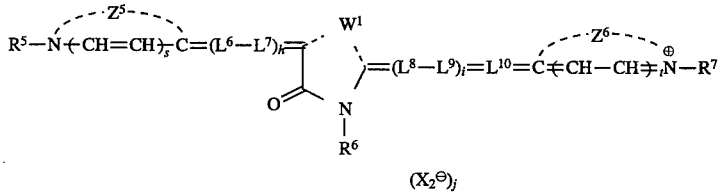

(S-III)

where $Z^5$ and $Z^6$ have the same meaning as $Z^1$ and $Z^2$; $R^5$ and $R^7$ have the same meaning as $R^1$ and $R^2$; $R^6$ has the same meaning as $R^4$; $L^6$, $L^7$, $L^8$, $L^9$ and $L^{10}$ have the same meaning as $L^1$, $L^2$ and $L^3$; $W^1$ denotes the group of non-metallic atoms necessary to form a 5- or 6-membered hereto ring: h and i each has the same meaning as m; s and t have the same meaning as p and q; $X_2^-$ has the same meaning as $X_1^-$; and j has the same meaning as k;

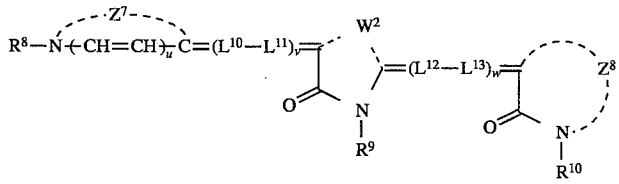

(S-IV)

where $Z^7$ has the same meaning as $Z^1$ and $Z^2$; $Z^8$ has the same meaning as $Z^4$; $W^2$ has the same meaning as $W^1$ ; $R^8$ has the same meaning as $R^1$ and $R^2$; and $R^9$ and $R^{10}$ each has the same meaning as $R^4$: $L^{10}$, $L^{11}$, $L^{12}$ and $L^{13}$ have the same meaning as $L^1$, $L^2$ and $L^3$; v and w each has the same meaning as m; and u has the same meaning as p and q.

The 5- or 6-membered hetero ring formed by $Z^1$, $Z^2$, $Z^3$, $Z^5$, $Z^6$ and $Z^7$ may be fused to other rings and examples of such hereto rings are listed below:

thiazole nuclei (e.g. thiazole, 4-methylthiazole, 4phenylthiazole, 4,5-dimethylthiazole and 4,5-diphenylthiazole); benzothiazole nuclei (e.g. benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5-hydroxy-6-methylbenzothiazole, tetrahydrobenzothiazole, and 4-phenylbenzothiazole); naphthothiazole nuclei (e.g. naphtho[2,1-d]thiazole, naphtho[1,2-d]thiazole, naphtho[2,3-d]thiazole, 5-methoxynaphtho[1,2-d]thiazole, 7-ethoxynaphtho [2,1-d]thiazole, 8-methoxynaphtho[2,1-d]thiazole, and 5-methoxynaphtho [2,3-d]thiazole); thiazoline nuclei (e.g thiazoline, 4-methylthiazoline and 4-nitrothiazoline); oxazole nuclei (e.g. oxazole, 4-methyloxazole, 4-nitroxazole, 5-methyloxazole, 4-phenyloxazole, 4,5-diphenyloxazole, and 4-ethyloxazole); benzoxazole nuclei (e.g. benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-ethoxybenzoxazole, 4,6-dimethylbenzoxazole, and 5-ethoxybenzoxazole;); naphthoxazole nuclei (e.g. naphtho[2,1-d]oxazole, naphtho[1,2-d]oxazole, naphtho[2,3-d]oxazole, and 5-nitronaphthoo[2,1-d]oxazole); oxazoline nuclei (e.g. 4,4-dimethyloxazoline); selenazole nuclei (e.g. 4-methylselenazole, 4-nitroselenazole and 4-phenylselenazole); benzoselenazole nuclei (e.g. benzoselenazole, 5-chlorobenzoselenazole, 5-nitrobenzoselenazole, 5-methoxybenzoselenazole, 5-hydroxybenzoselenazole, 6-nitrobenzoselenazole and 5-chloro-6-nitrobenzoselenazole); naphthoselenazole nuclei (e.g. naphtho[2,1-d]selenazole and naphtho[1,2-d]selenazole); 3,3-dialkylindolenine nuclei (e.g. 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine and 3,3-dimethyl-5-chloroindolenine); imidazole nuclei (e.g. 1-alkylimidazole, 1-alkyl-4-phenylimidazole, 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-alkylnaphtho[1,2-d]imidazole, 1-aryl-5,6-dichlorobenzimidazole, 1-aryl-5-chlorobenzimidazole, 1-arylimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole, 1-arylnaphtho[1,2-d]imidazole; preferred alkyl groups are those having 1–8 carbon atoms such as unsubstituted alkyl groups exemplified by methyl, ethyl, propyl, isopropyl and butyl, and hydroxyalkyl groups exemplified by 2-hydroxyethyl and 3-hydroxypropyl, with methyl and ethyl being particularly preferred; preferred aryl groups include phenyl, halogen (e.g. chloro) substituted phenyl, alkyl (e.g. methyl) substituted phenyl and alkoxy (e.g. methoxy) substituted phenyl}; 1-pyridine nuclei (e.g. 2-pyridine, 4-pyridine, 5-methyl-2-pyridine, and 3-methyl-4-pyridine); quinoline nuclei (e.g. 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, isoquinoline, 6-nitro-1-isoquinoline, 3,4-dihydro-1-isoquinoline, and 6-nitro-3-isoquinoline); imidazo[4,5-b]quinoxaline nuclei (e.g. 1,3-diethylimidazo[4,5-b]quinoxaline and 6-chloro-1,3-diallylimidazo[4,5-b]quinoxaline); oxadiazole nuclei; thiadiazole nuclei; tetrazole nuclei; and pyrimidine nuclei.

Examples of the 5- or 6-membered hetero ring formed by $Z^4$ and $Z^8$ include: rhodanine nucleus, 2-thiohydantoin nucleus, 2-thioxazolidin-4-one nucleus, 2-pyrazolin-5-one nucleus, barbituric acid nucleus, 2-thiobarbituric acid nucleus, thiazolidine-2,4-dione nucleus, thiazolidin-4-one nucleus, isoxazolone nucleus, hydantoin nucleus, and indandione nucleus.

The 5- or 6-membered hetero ring formed by $W^1$ and $W^2$ is the same as the 5- or 6-membered hereto ring formed by $Z^4$ and $Z^8$ except that the former has no oxo or thioxo group. $L^1$–$L^{13}$ each denotes a methine or a substituted methine group, and illustrative substituents include an alkyl group (e.g. methyl or ethyl), an aryl group (e.g. phenyl), an aralkyl group (e.g. benzyl ), and a halogen (e.g. chlorine or bromine) substituted alkoxy (e.g. methoxy or ethoxy) group. Substituonts on the methine group may combine to form a 4- to 6-membered ring.

The optionally substituted alkyl group denoted by $R^1$, $R^2$, $R^3$, $R^6$, $R^7$ and $R^8$ may be exemplified by alkyl groups having 1–18, preferably 1–7, more preferably 1–4, carbon atoms and specific examples include: unsubstituted alkyl groups (e.g. methyl, ethyl, propyl, isopropyl, butyl, isobutyl, hexyl, octyl, dodecyl, and octadecyl); substituted alkyl groups such as aralkyl groups (e.g. benzyl and 2-phenylethyl), hydroxyalkyl groups (e.g. 2-hydroxy-ethyl and 3-hydroxypropyl), carboxyalkyl groups (e.g. 2-carboxy-ethyl, 3-carboxypropyl, 4-carboxybutyl and carboxymethyl), alkoxy-alkyl groups (e.g. 2-methoxyethyl and 2-(2-methoxyethoxy)ethyl), sulfoalkyl groups [e.g. 2-sulfoethyl, 3-sulfopropyl, 3-sulfobutyl, 4-sulfobutyl, 2-(3-sulfopropoxy) ethyl, 2-hydroxy-3-sulfopropyl, and 3-sulfopropoxyethoxyethyl], sulfatoalkyl groups (e.g. 3-sulfatopropyl and 4-sulfatobutyl), hetero ring substituted alkyl groups (e.g. 2-(pyrrolidin-2-on-1-yl) ethyl and tetrahydrofurfuryl), 2-acetoxyethyl group, carbomethoxymethyl group, 2-methanesulfonylaminoethyl group, and allyl group.

Examples of the alkyl group, substituted alkyl group, aryl group, substituted aryl group, and heterocyclic group that are donoted by $R^4$, $R^6$, $R^9$ and $R^{10}$ include: alkyl groups having 1–18, preferably 1–7, more preferably 1–4, carbon atoms (e.g. methyl, ethyl, propyl, isopropyl, butyl, isobutyl, hexyl, octyl, dodecyl and octadecyl); substituted alkyl groups such as aralkyl groups (e.g. benzyl and 2-phenylethyl), hydroxyalkyl groups (e.g. 2-hydroxyethyl and 3-hydroxypropyl), carboxyalkyl groups (e.g. 2-carboxyethyl, 3-carboxypropyl, 4-carboxybutyl and carboxymethyl), alkoxyalkyl groups (e.g. 2-methoxyethyl and 2-(2-methoxyethoxy)ethyl), sulfoalkyl groups (e.g. 2-sulfoethyl, 3-sulfopropyl, 3-sulfobutyl, 4-sulfobutyl, 2-(3-sulfopropoxy)ethyl, 2-hydroxy-3-sulfopropyl, and 3-sulfopropoxyethoxyethyl), sulfatoalkyl groups (e.g. 3-sulfatopropyl and 4-sulfatobutyl), hetero ring substituted alkyl groups (e.g. 2-(pyrrolidin-2-on-1-yl)ethyl, tetrahydrofurfuryl and 2-morpholinoethyl), 2-acetoxyethyl group, carbomethoxymethyl group, -2methanesulfonylaminoethyl group, and allyl group); aryl groups (e.g. phenyl and 2-naphthyl); substituted aryl groups (e.g. 4-carboxyphenyl, 4-sulfophonyl, 3-chlorophenyl and 3-methylphenyl); and heterocyclic groups (e.g. 2-pyridyl and 2-thiazolyl).

Specific examples of the compounds that can be used as spectral sensitizing dyes In the present invention are listed below but they should by no means be taken as limiting.

S-1

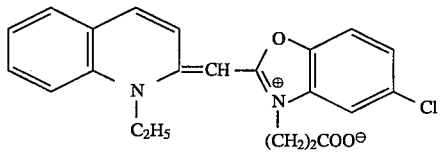

-continued
S-2
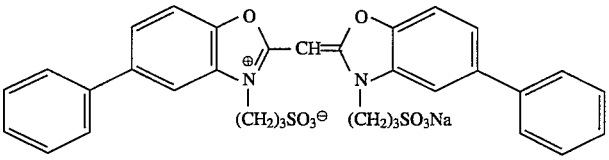
S-3
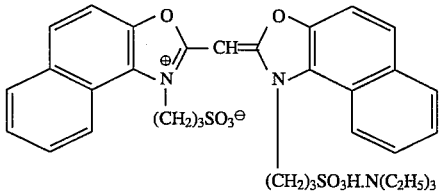
S-4
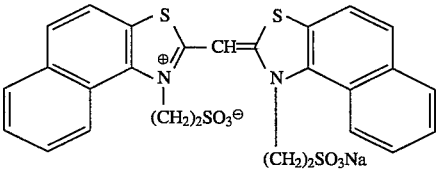
S-5
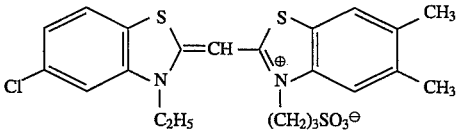
S-6
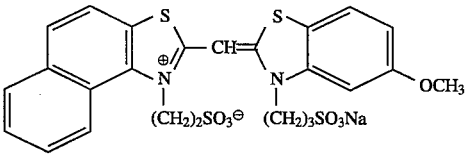
S-7
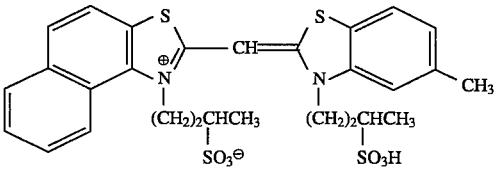
S-8
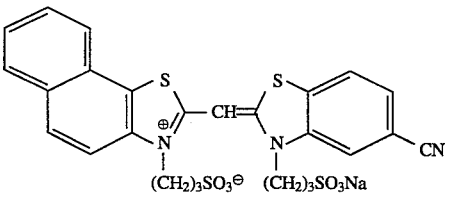
S-9
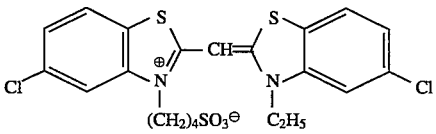
S-10
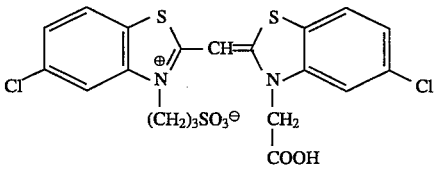

-continued
S-11
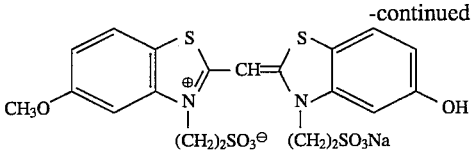
S-12
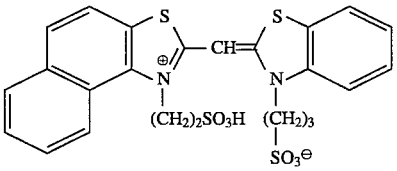
S-13
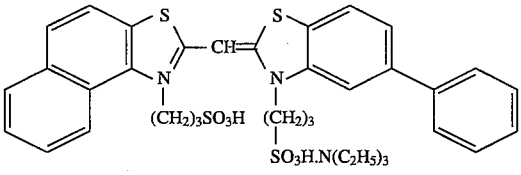
S-14
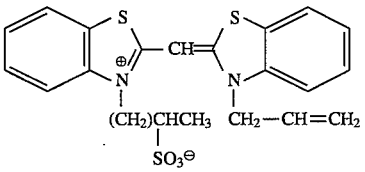
S-15
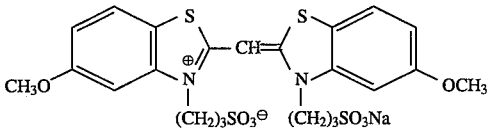
S-16
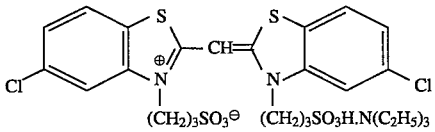
S-17
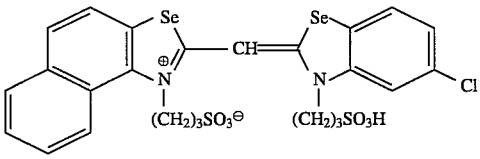
S-18
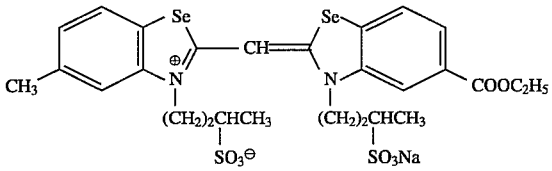
S-19
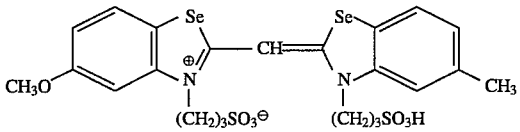
S-20
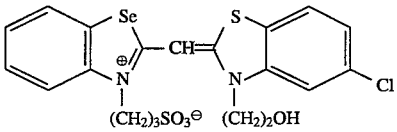

-continued
S-21
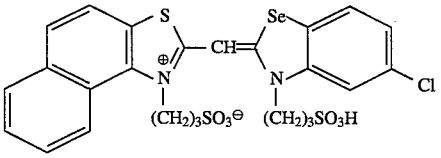
S-22
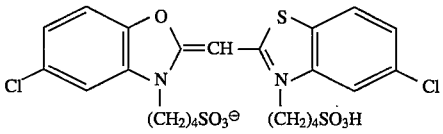
S-23
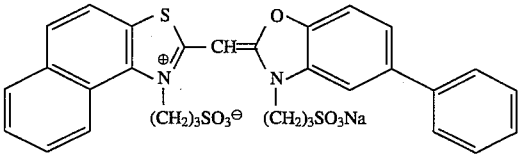
S-24
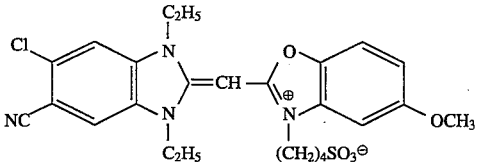
S-25
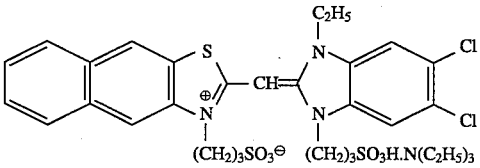
S-26
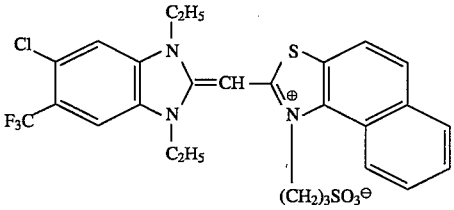
S-27
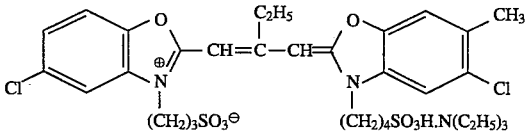
S-28
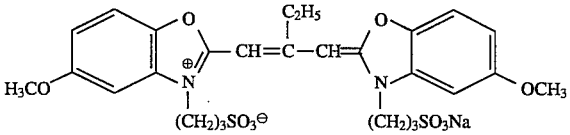
S-29
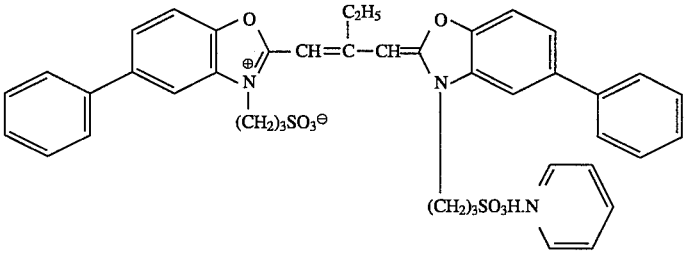

-continued
S-30
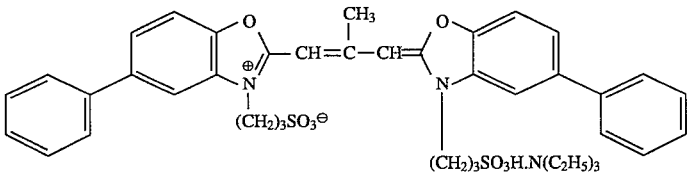
S-31
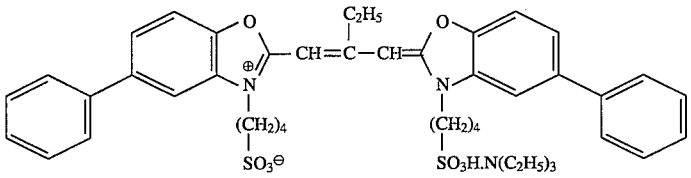
S-32
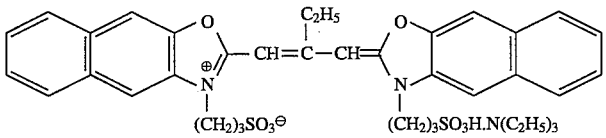
S-33
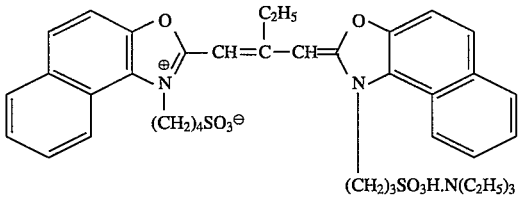
S-34
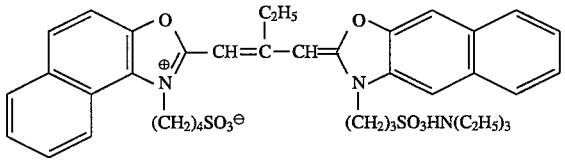
S-35
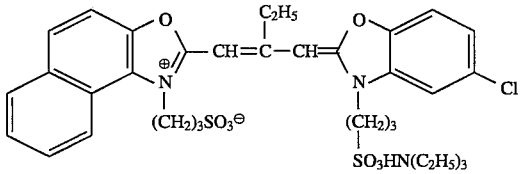
S-36
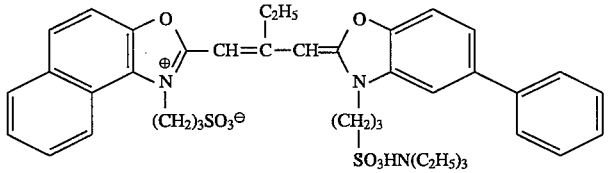
S-37
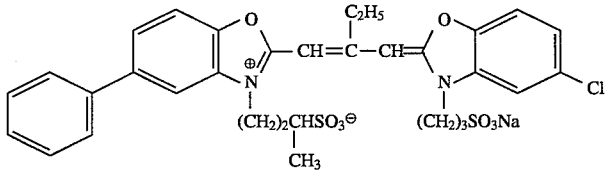
S-38
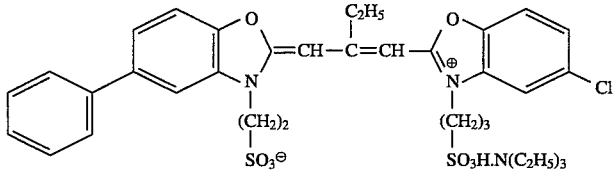

-continued
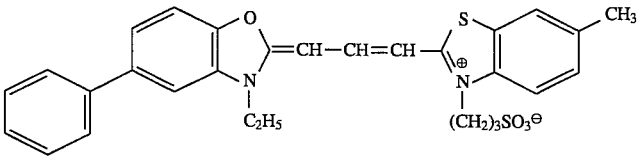
S-39
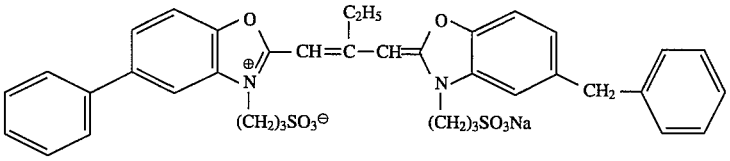
S-40
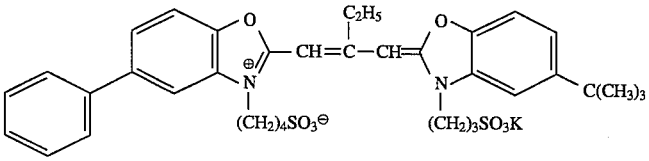
S-41
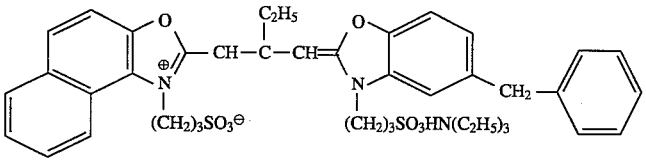
S-42
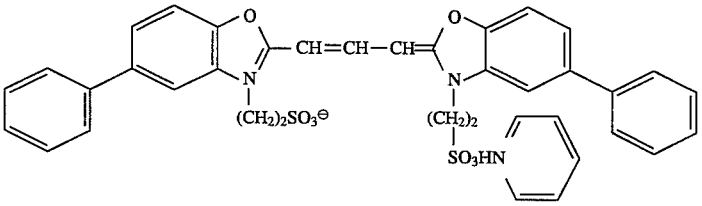
S-43
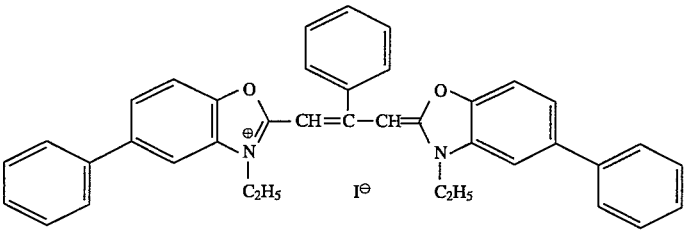
S-44
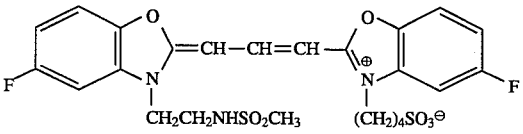
S-45
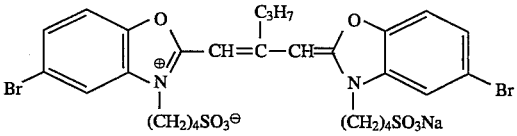
S-46
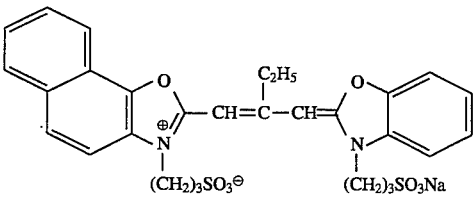
S-47

-continued
S-48
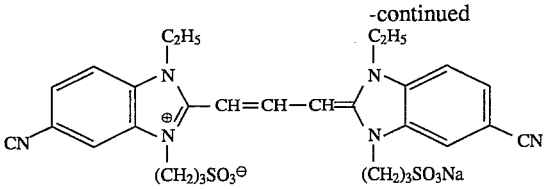
S-49
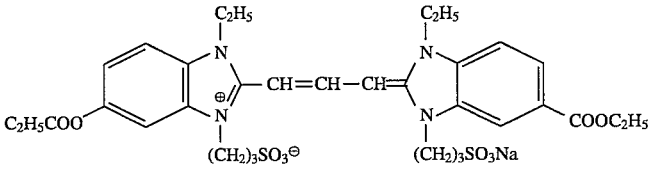
S-50
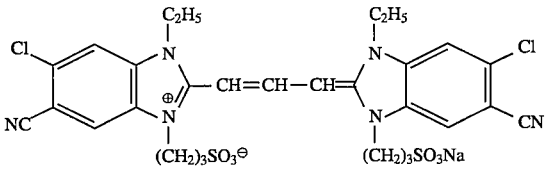
S-51
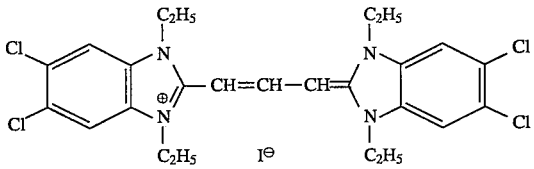
S-52
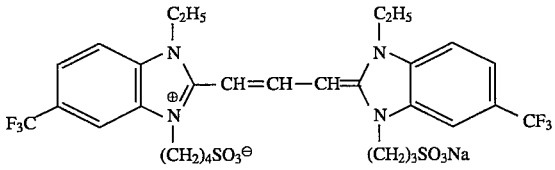
S-53
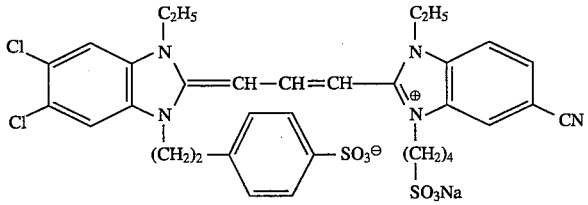
S-54
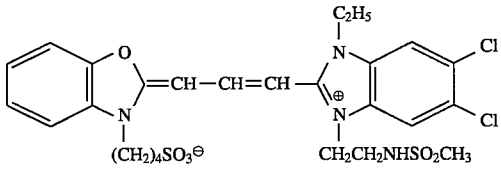
S-55
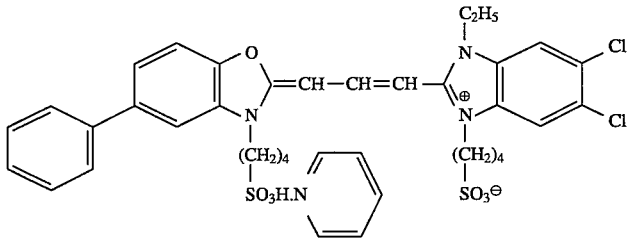
S-56
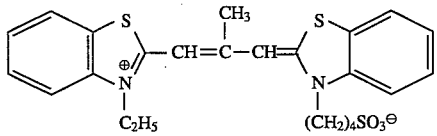

-continued
S-57
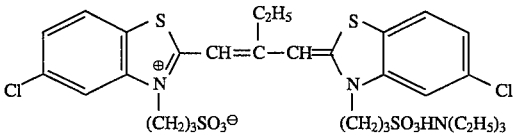
S-58
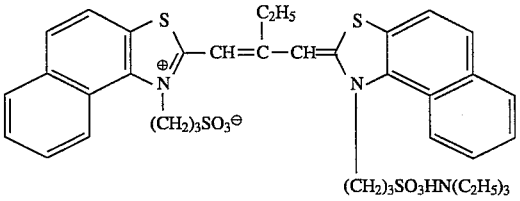
S-59
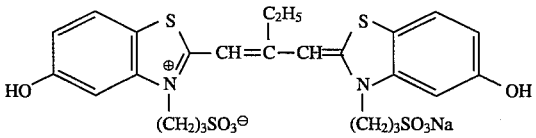
S-60
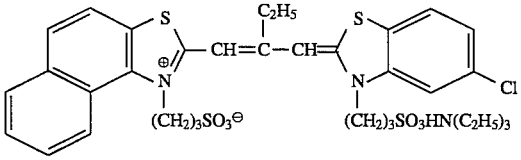
S-61
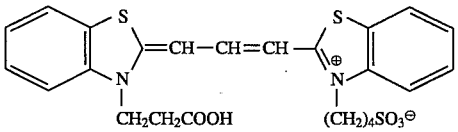
S-62
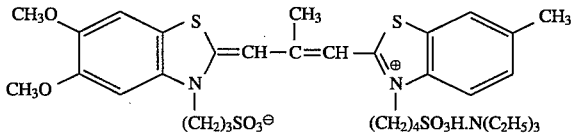
S-63
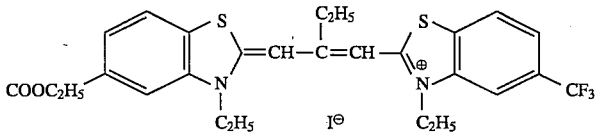
S-64
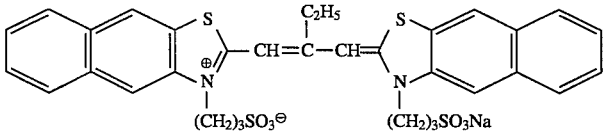
S-65
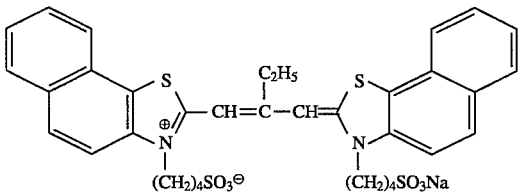
S-66
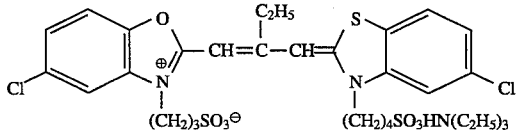

-continued
S-67
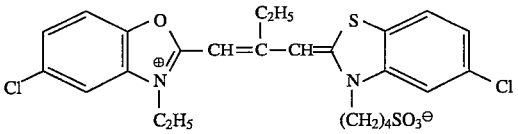
S-68
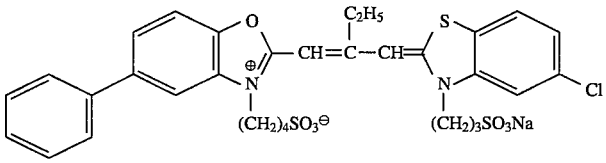
S-69
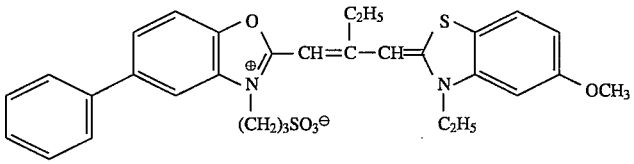
S-70
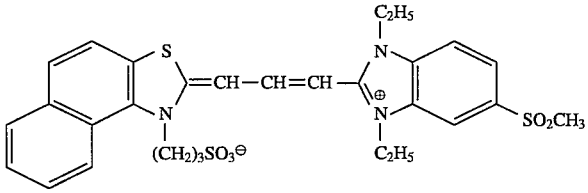
S-71
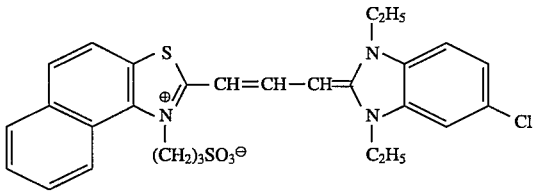
S-72
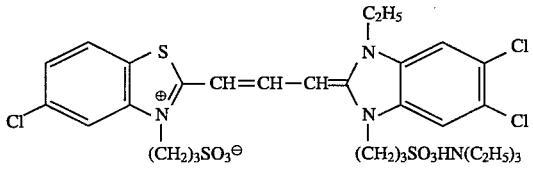
S-73
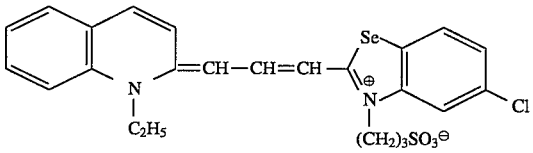
S-74
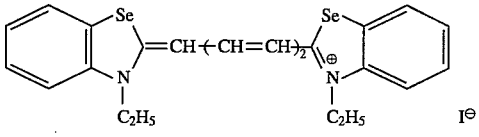
S-75
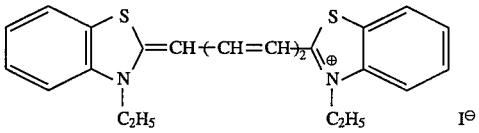

-continued
S-76
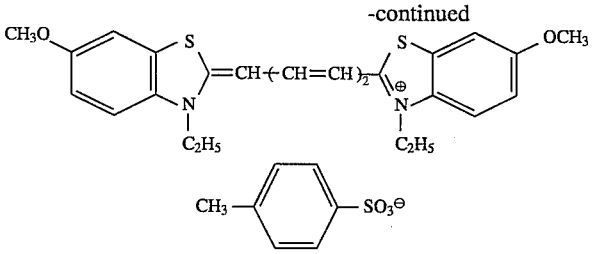
S-77
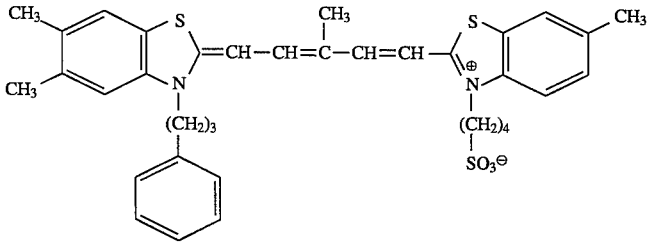
S-78
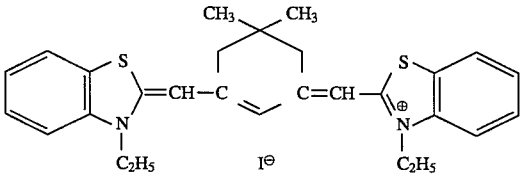
S-79
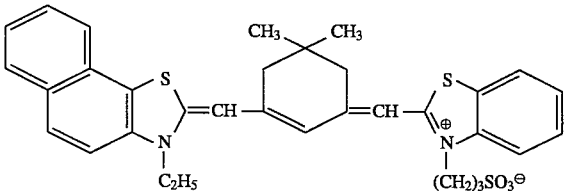
S-80
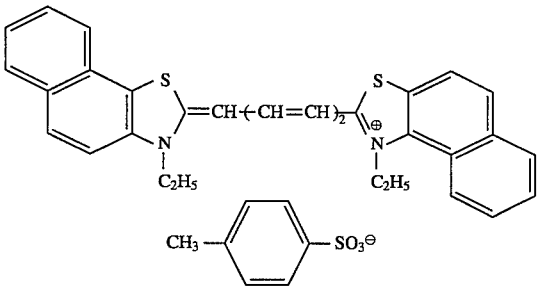
S-81
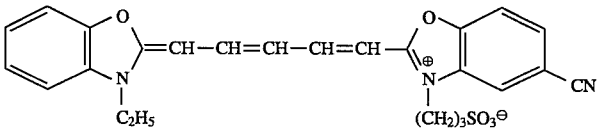
S-82
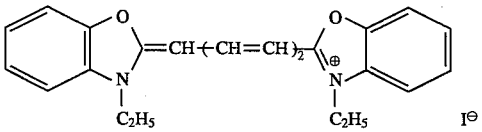
S-83
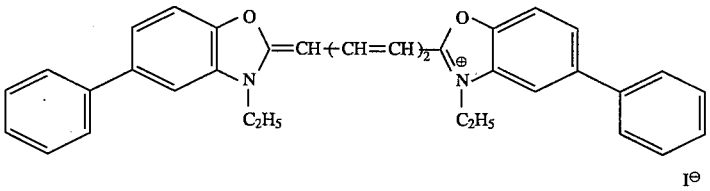

-continued
S-84
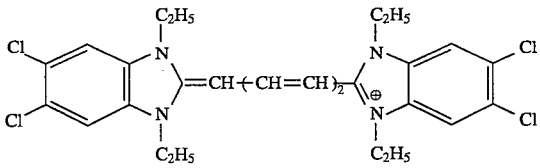
S-85
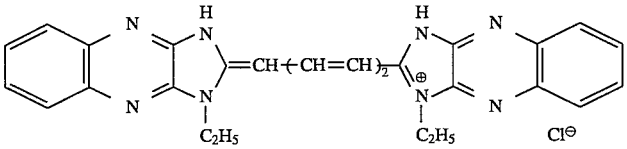
S-86
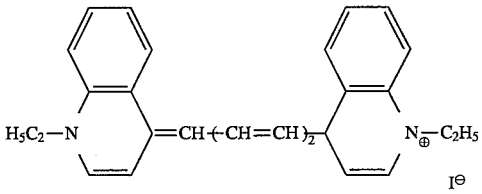
S-87
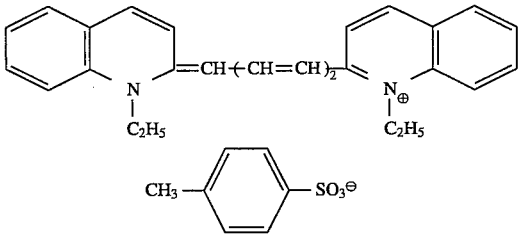
S-88
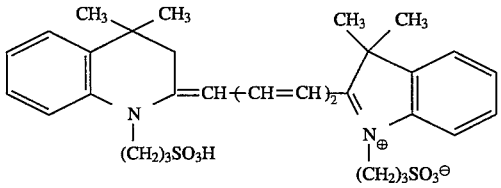
S-89
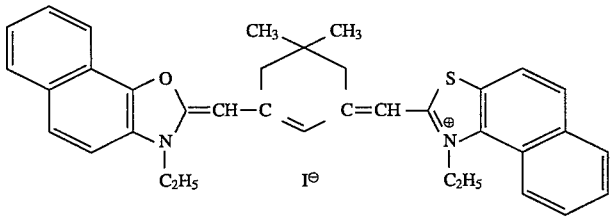
S-90
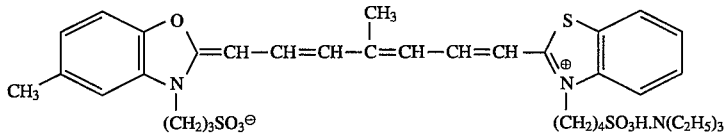
S-91
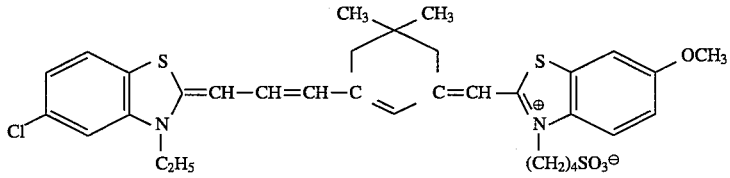

-continued
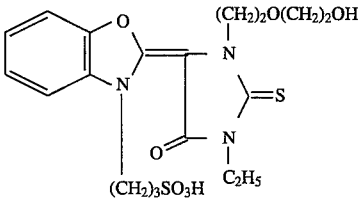
S-92
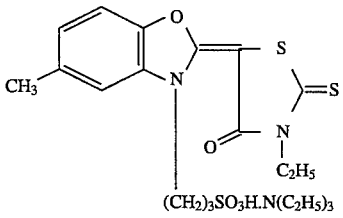
S-93
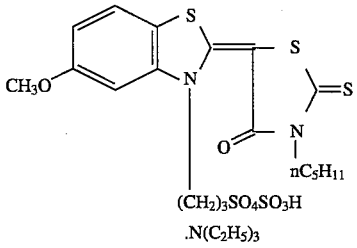
S-94
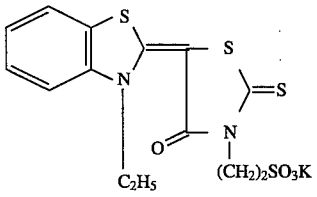
S-95
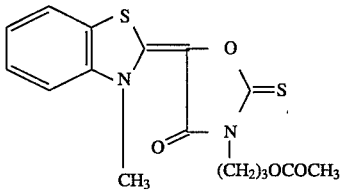
S-96
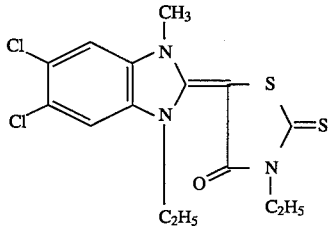
S-97
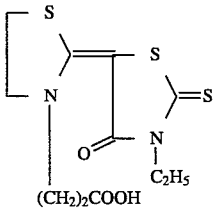
S-98

-continued
S-99
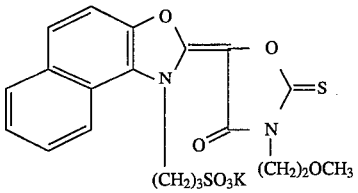
S-100
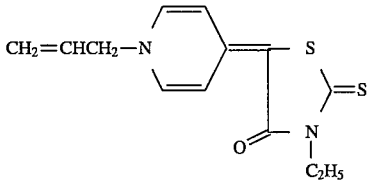
S-101
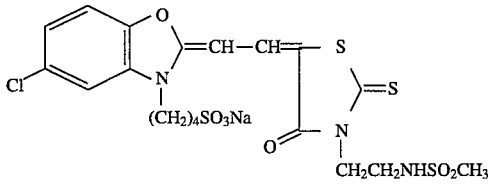
S-102
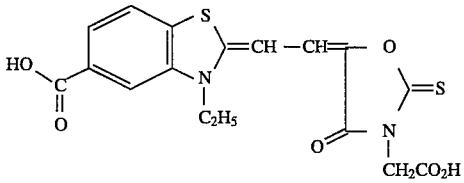
S-103
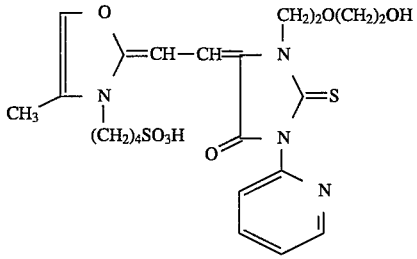
S-104
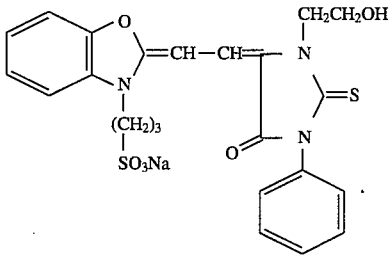
S-105
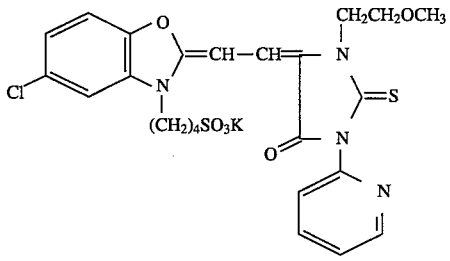

-continued
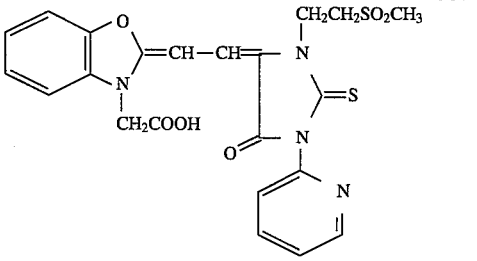
S-106
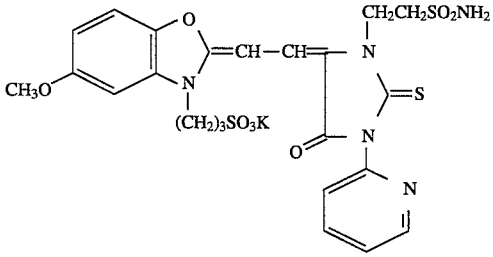
S-107
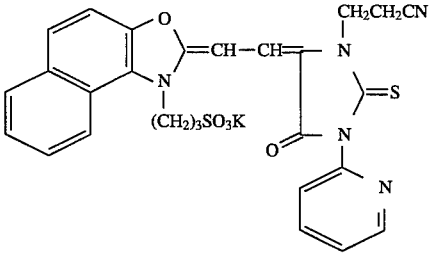
S-108
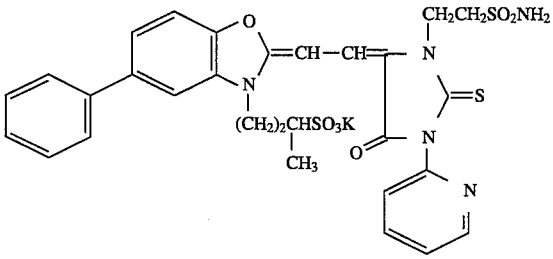
S-109
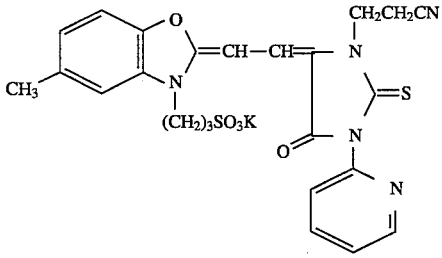
S-110
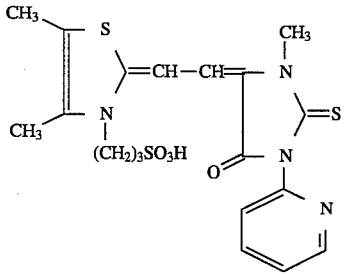
S-111

-continued
S-112
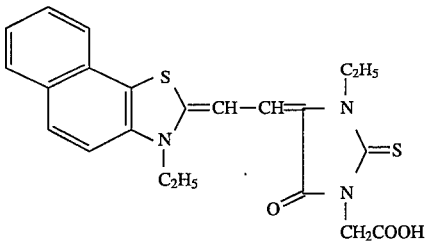
S-113
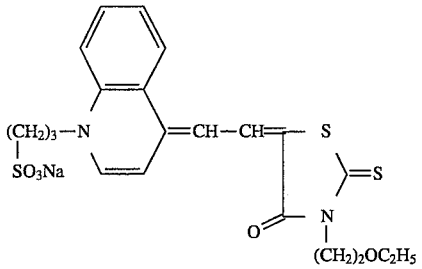
S-114
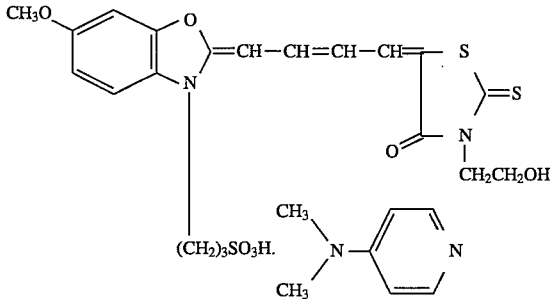
S-115
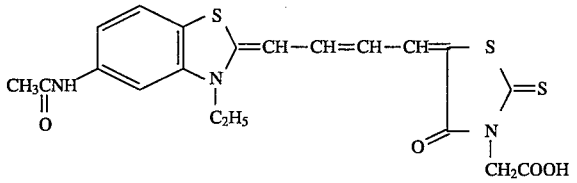
S-116
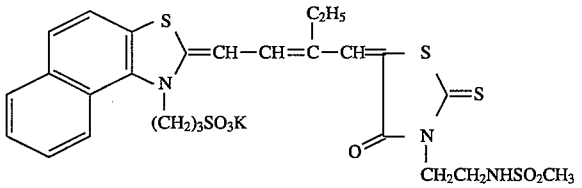
S-117
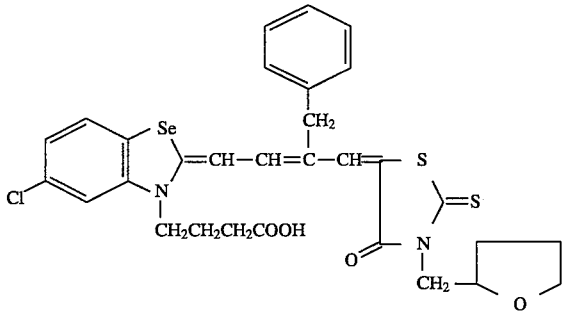

-continued
S-118
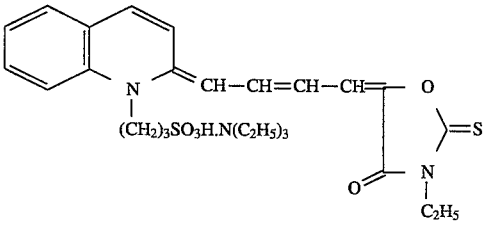
S-119
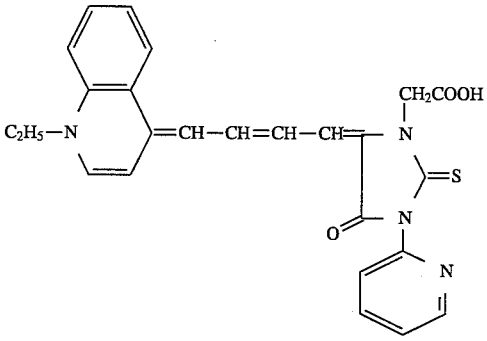
S-120
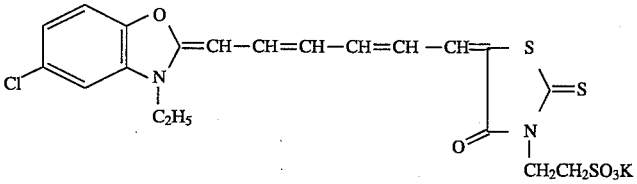
S-121
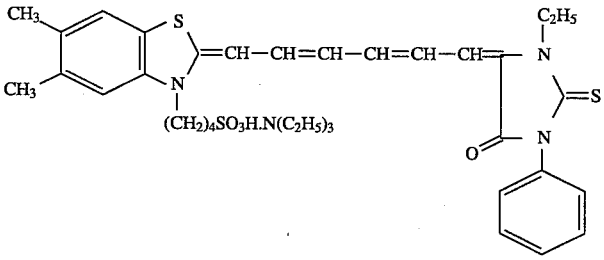
S-122
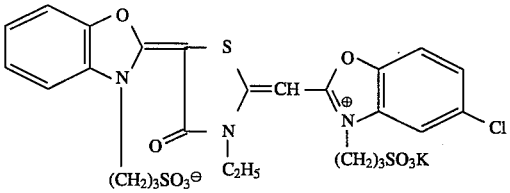
S-123
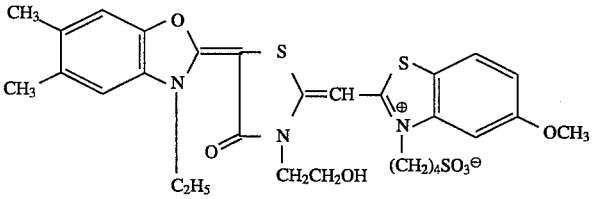

-continued
S-124
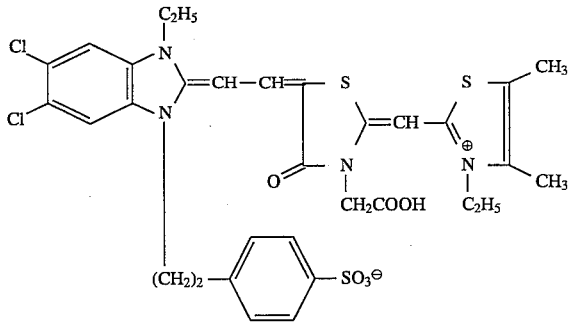
S-125
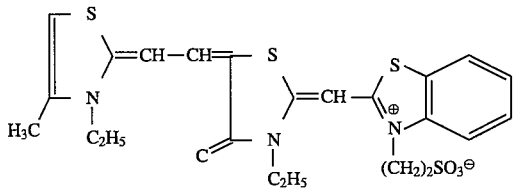
S-126
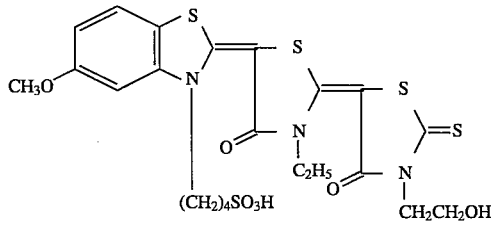
S-127
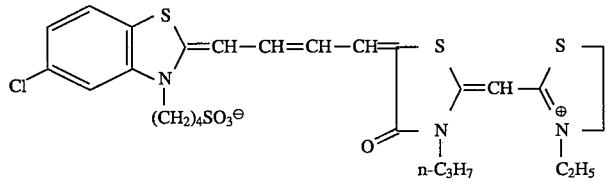
S-128
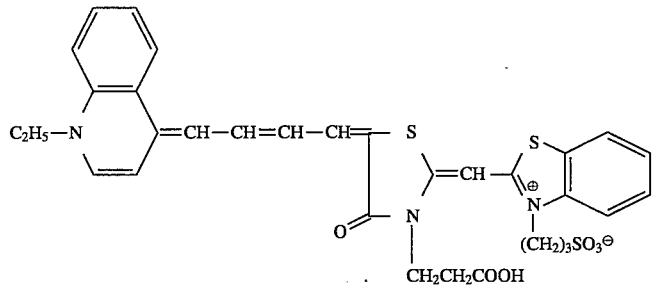
S-129
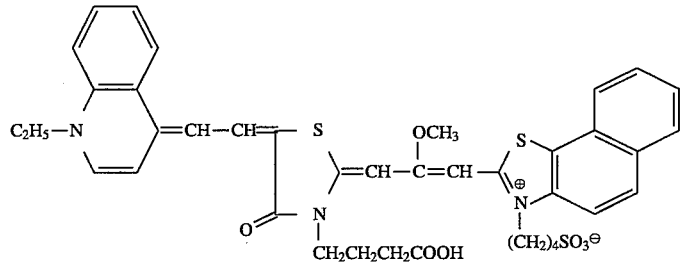

-continued

S-130

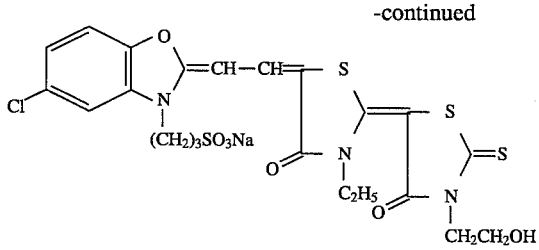

S-131

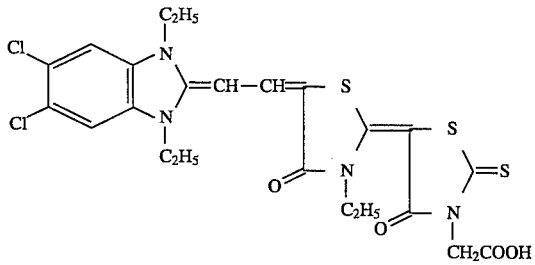

S-132

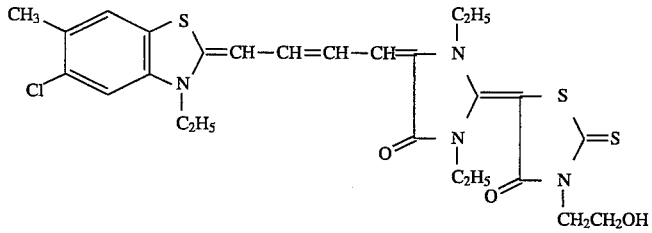

S-133

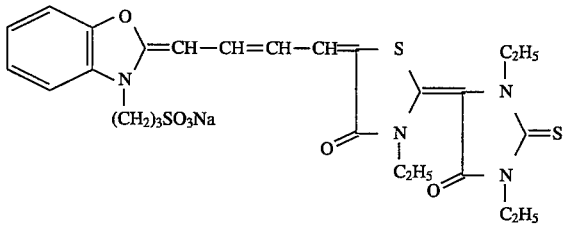

S-134

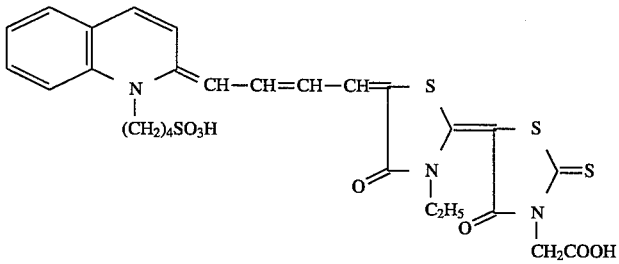

Spectral sensitization with these dyes may be performed by a method well known in the art. That is, sensitizing dyes are dissolved in suitable solvents (e.g. methanol, ethanol, propanol, fluorinated alcohols, 1-methoxyethanol, ethyl acetate, water, or aqueous acid or alkali solutions having appropriate pH values) to form solutions of suitable concentrations, which are then added to silver halide emulsions or aqueous solutions of hydrophilic colloids. The prepared solutions are added in any desired step of the preparation of silver halide emulsions, for example, prior to the formation of silver halide grains, during said formation, during physical ripening that follows the formation of silver halide grains, prior to their chemical ripening, during chemical ripening, after the completion of chemical ripening but prior to the preparation of an emulsion coating solution, or during the preparation of an emulsion coating solution. The solutions may be added either before or after the addition of stabilizers or antifoggants. Preferably, the solutions are added during the formation of silver halide grains or during their chemical ripening (i.e., in a stage prior to the preparation of an emulsion coating solution).

The sensitizing dyes under consideration are added In amounts that range widely depending on the case but they are generally used in amounts ranging from $1\times10^{-6}$ to $1\times10^{-2}$ mole per mole of silver, with the range or $5\times10^{-6}$ to $1\times10^{-3}$ mole being preferred.

These dyes can be used either on their own or as admixtures.

It is particularly preferred that the spectral sensitizing dyes to be incorporated in a silver halide emulsion in accordance with the present invention are used in compinations that exhibit supersensitization. To this end, two or more of the dyes described above may be combined together. If desired, compounds other than the dyes described above may be used as supersensitizing agents. Examples of such compounds include dyes that are used together with sensitizing dyes and which by themselves do not have a spectral sensitizing effect, as well as those materials which substantially are nonabsorbers of visible light but which are capable of supersensitization. Examples of such materials include the products of condensation between aromatic organic acids and formaldehyde (as described in U.S. Pat. No. 3,437,510), cadmium salts, azaindene compounds, and aminostilbene compounds substituted by nitrogenous heterocyclic groups (as described in U.S. Pat. Nos. 2,933,390 and 3,635,721). Particularly useful combinations are described in U.S. Pat. Nos. 3,615,613, 3,615,641, 3,617,295 and 3,635,721.

Typical examples of preferred supersensitizers of course include compounds S-1 to S-134 which can be used as supersensitizers and, in addition, the following compounds may be enumerated:

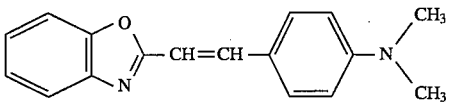

SS-1

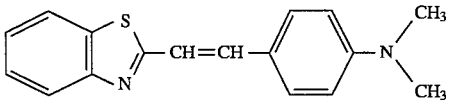

SS-2

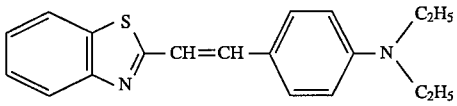

SS-3

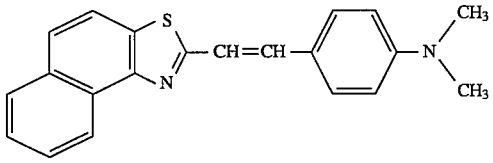

SS-4

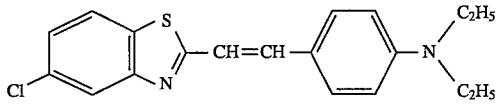

SS-5

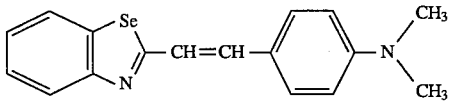

SS-6

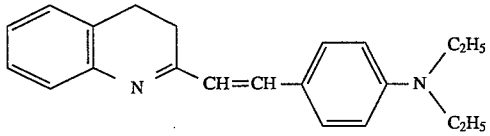

SS-7

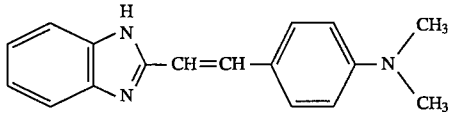

SS-8

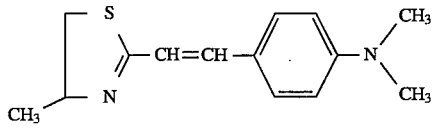

SS-9

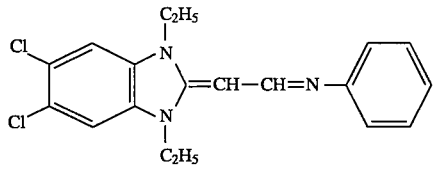

SS-10

-continued
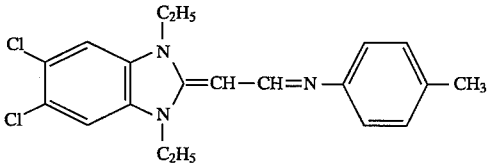
SS-11
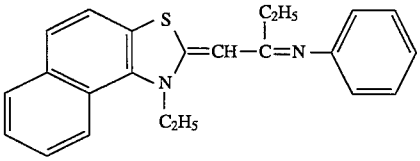
SS-12
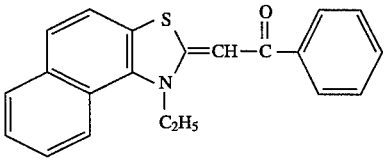
SS-13
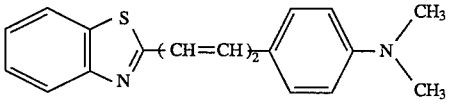
SS-14
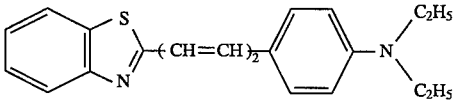
SS-15
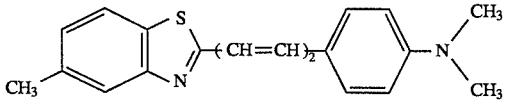
SS-16
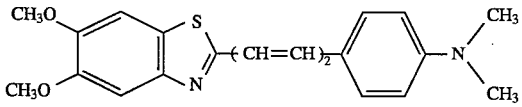
SS-17
SS-18
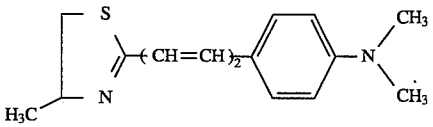
SS-19
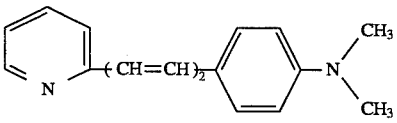
SS-20
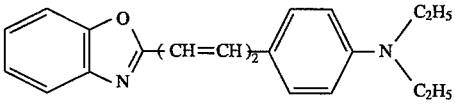
SS-21
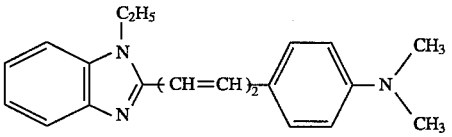
SS-22

-continued
SS-23
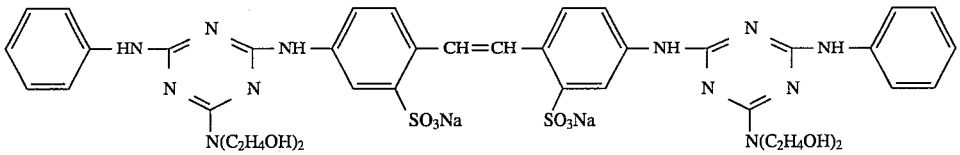
SS-24
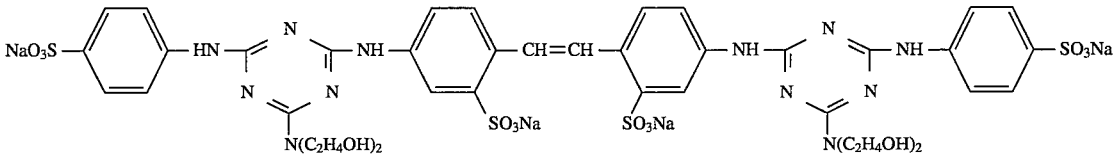
SS-25
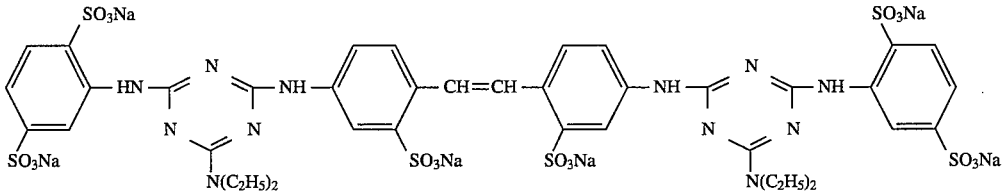
SS-26
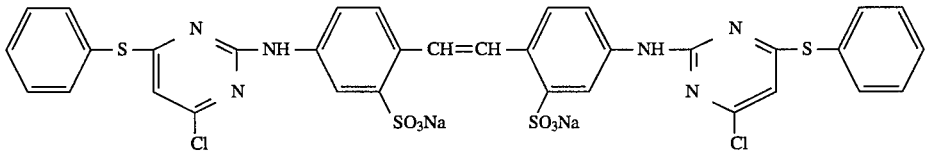
SS-27
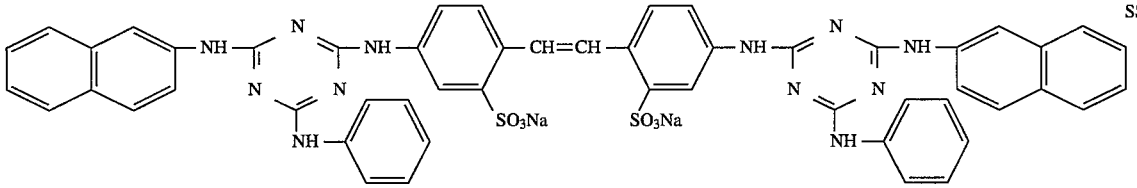
SS-28
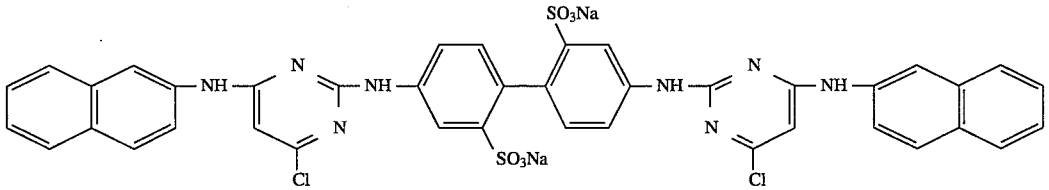
SS-29
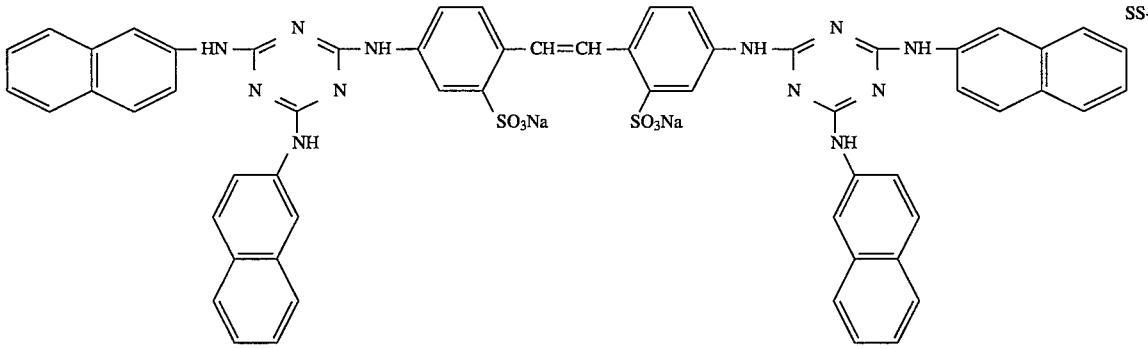
SS-30
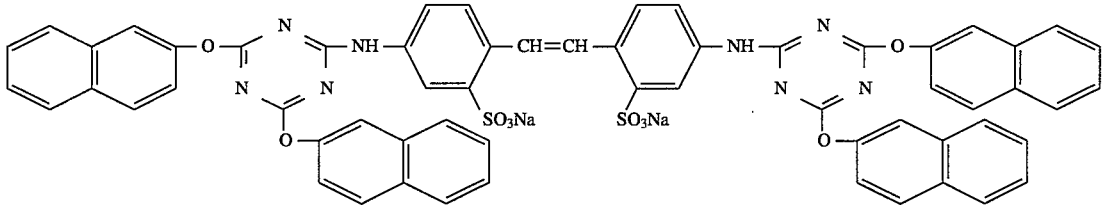

-continued

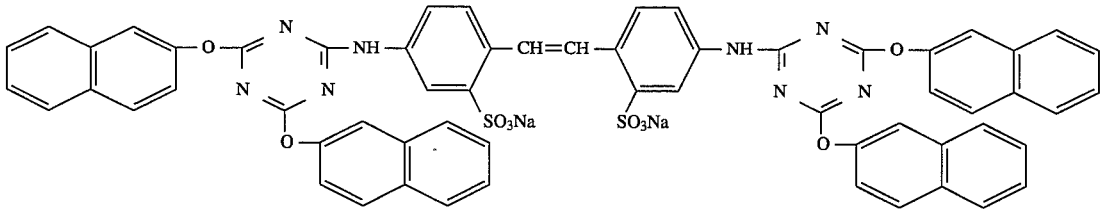

SS-31

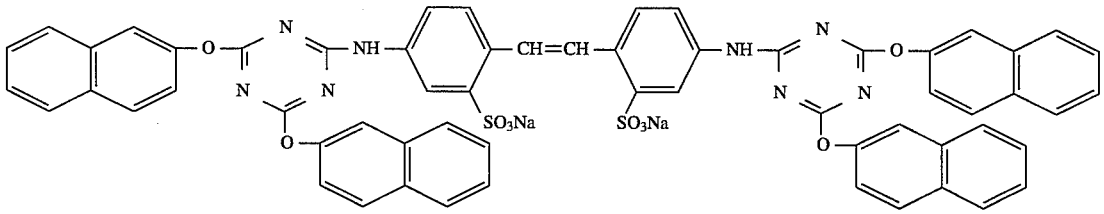

SS-32

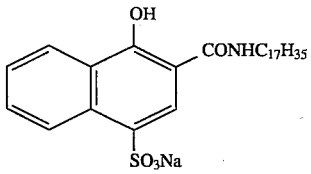

SS-33

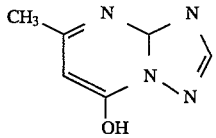

SS-34

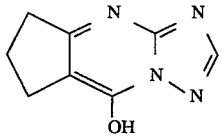

SS-35

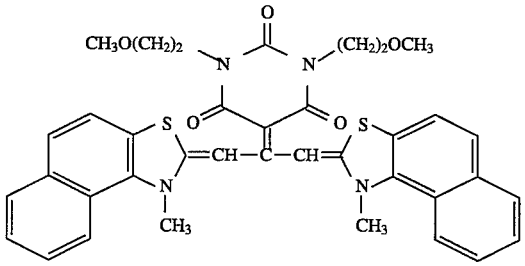

SS-36

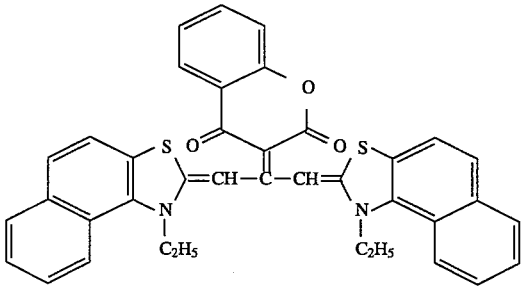

SS-37

If the silver halide photographic material of the present invention is to be embodied as a color photographic material, couplers may be used. Any couplers can be used in the present invention as long as they can be dissolved in high-boiling organic solvents for incorporation into the photographic materials.

However, in order to attain the objects of the present invention in an effective way, the use of the following couplers is preferred.

Yellow couplers that are preferably used in the silver halide photographic material of the present invention include benzoylacetanilidecontaining yellow couplers and pivaloylacetanilidecontaining yellow couplers, Among these, compounds represented by the following general formulas (I) and (II) can be used with particular advantage:

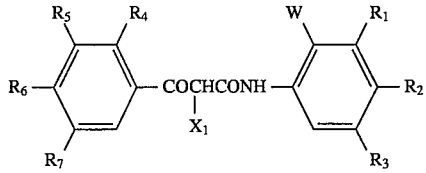

(I)

where $R_1$–$R_7$ and W each denotes a hydrogen atom or a substituent; $R_1$, $R_2$ and $R_3$ which may be the same or different are each preferably a hydrogen atom, a halogen atom, an alkyl group, an aryl group, an alkoxy group, an acylamino group, a carbamoyl group, an alkoxycarbonyl group, a sulfonamido group or a sulfamoyl group; $R_4$, $R_5$, $R_6$ and $R_7$ which may be the same or different are each preferably a hydrogen atom, an alkyl group, an alkoxy group, an aryloxy group, an acylamino group or a sulfonamide group; W is preferably a halogen atom, an alkyl group, an alkoxy group, an aryloxy group or a dialkylamino group; $X_1$ is a hydrogen atom or a group that is capable of leaving upon reaction with the oxidation product of a color developing agent, as exemplified by a halogen atom, a monovalent group such as a group containing an oxygen atom as a linkage (e.g. alkoxy, aryloxy, heterocycloxy or acyloxy), a group containing a sulfur atom as a linkage (e.g. alkylthio, arylthio or heterocyclothio) or a group containing a nitrogen atom as a linkage [e.g.

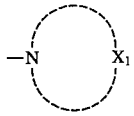

(where $X_1$ is the atomic group necessary to form a 5- or 6-membered ring together with the nitrogen atom and at least one atom selected from among a carbon atom, an oxygen atom, a nitrogen atom and a sulfur atom), acylamino or sulfonamido group], and a divalent group such as an alkylene group; preferred leaving groups are those which contain a nitrogen atom or an oxygen atom as a linkage; and compounds of the general formula (I) may form a dimer and other oligomers by means of $R_1$–$R_7$, W or $X_1$;

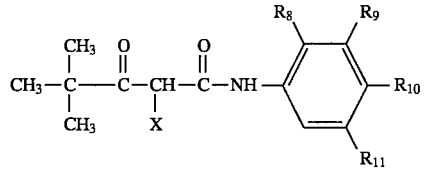

(II)

where $R_8$–$R_{11}$ each denotes a hydrogen atom or asubstituent; $R_8$ is preferably a hydrogen atom, a halogen atom or an alkoxy group, with a halogen atom being particularly preferred; $R_9$, $R_{10}$ and $R_{11}$ each preferably denotes a hydrogen atom, a halogen atom, an alkyl group, an alkenyl group, an alkoxy group, an aryl group, a carboxyl group, an alkoxycarbonyl group, a carbamyl group, a sulfone group, a sulfamyl group, an alkylsulfonamido group, an acylamido group, a uredio group or an amino group; in a particularly preferred case, $R_9$ and $R_{10}$ are each a hydrogen atom and $R_{11}$ is an alkoxycarbonyl group, an acylamido group or an alkylsulfonamido group; X has the same meaning as $X_1$ in the general formula (I) and examples of the leaving group are also the same inclusive of preferred examples; and compounds of the general formula (II) may form a dimer and other oligomers by means of $R_8$–$R_{11}$ and X.

Particularly preferred yellow couplers are those of a two-equivalent benzoyl type.

Magenta couplers that are preferably used in the present invention are those of a pyrazolone or pyrazoloazole type and may be represented by the following general formulas (III), (IV), (V) and (VI):

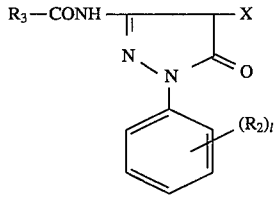

[III]

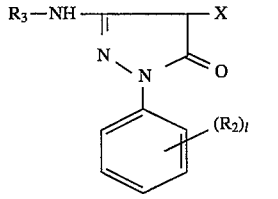

[IV]

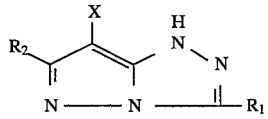

[V]

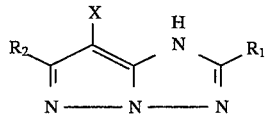

[VI]

where $R_3$ is a substituent; $R_1$ and $R_2$ are each a hydrogen atom or a substituent; X has the same meaning as $X_1$ in the general formula (I); l is an integer of 0–5, provided that when l is 2 or more, $R_2$ may be the same or different; examples of the substituent denoted by $R_1$ and $R_2$ include a halogen atom and a group such as alkyl, cycloalkyl, aryl or hereto ring that are bonded either directly or indirectly via a divalent atom, and these groups may optionally have substituents; examples of the substituent denoted by $R_3$ include alkyl, cycloalkyl, aryl, hereto ring and other groups, which may optionally have substituents.

The leaving group denoted by X in the magenta couplers described above may be exemplified by those given for $X_1$ in the general formula (I). Preferred examples of the leaving group denoted by X in the general formulas (III) and (IV) are those which contain a nitrogen atom or a sulfur atom as a linkage. A preferred example of the leaving group denoted by X in the general formulas (V) and (VI) is a halogen atom.

Compounds of the general formulas (III) and (IV) may form a dimer and other oligomers by means of $R_2$, $R_3$ or X, and compounds of the general formulas (V) and (VI) may form a dimer and other oligomers by means of $R_1$, $R_2$ or X.

Among the magenta couplers described above, two-equivalent magenta couplers are preferred, and pyrazoloazole containing couplers are also preferred.

Cyan couplers that are preferably used in the present invention are those which are represented by the following general formulas (VII), (VIII) and (IX):

(VII)

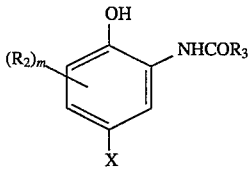

(VIII)

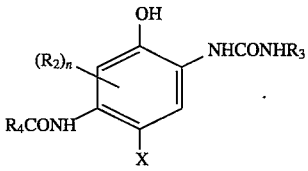

(IX)

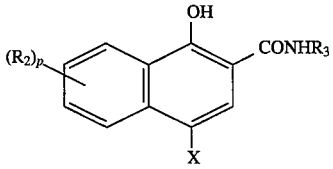

where $R_2$ and $R_3$ have the same meanings as $R_2$ and $R_3$ in the general formula (III); X has the same meaning as $X_1$ in the general formula (I); $R_4$ is a substituent; m is 1–3; n is 1–2; and p is 1–5, provided that when m, n and p are each 2 or more, $R_2$ may be the same or different.

Examples of $R_2$ and $R_3$ may be the same as those given in the definition of the general formula (III), and examples of $R_4$ may be the same as those given for $R_3$ in the definition off the general formula (III).

Examples of the leaving group denoted by X in the cyan couplers described above may be the same as those given in the definition of the general Formula (I), and a halogen atom and a leaving group that contains an oxygen atom as a linkage are particularly preferred For the purposes of the present invention, cyan couplers represented by the general formulas (VIII) and (IV) are preferred. Particularly preferred among the couplers that are represented by the general formula (IX) is one in which $R_2$ is —NHR that Is bonded to a 1-naphthol ring in the 5-position, where R is a hydrogen atom or a substituent. Preferred examples of the substituent denoted by R include a hydrogen atom, an aliphatic group having 1–30 carbon atoms, an aromatic group having 6–30 carbon atoms, a heterocyclic group having 1–30 carbon atoms, —$OR_5$,

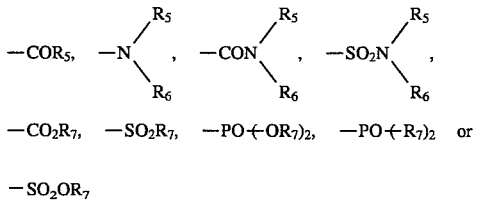

($R_5$, $R_6$ and $R_7$ are each a hydrogen atom, an aliphatic group, an aromatic group or a heterocyclic group), that are bonded to NH either directly or via CO or $SO_2$. These groups may optionally have substituents. If desired, R may form a ring together with X.

Compounds of the general formulas (VII) and (IX) may form a dimer and other oligomers by means of $R_2$, $R_3$ or X, and compounds of the general formula (VIII) may also form a dimer and other oligomers by means of $R_2$, $R_3$, $R_4$ or X.

Specific examples of the yellow, magenta, and cyan couplers that can be used in the present invention are listed below but they are in no way to be taken as limiting the scope of the present invention.

Two-equivalent yellow couplers

Y-1

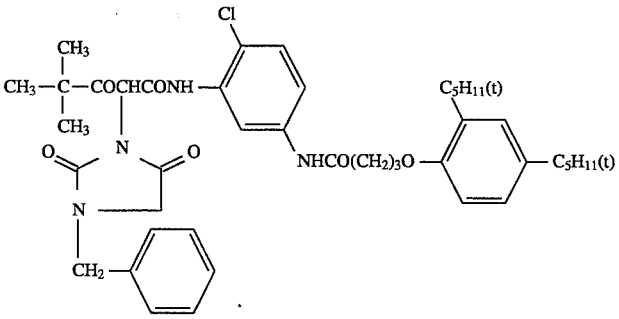

Y-2

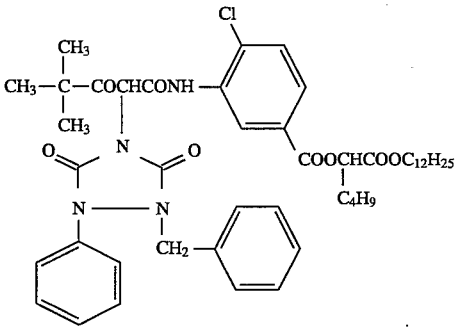

-continued
Y-3
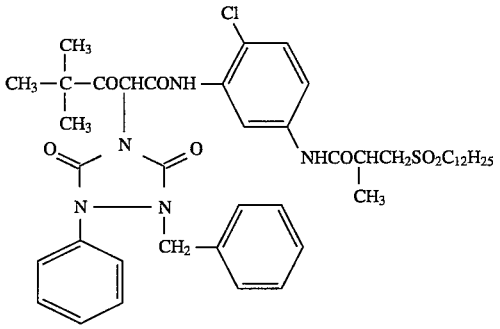
Y-4
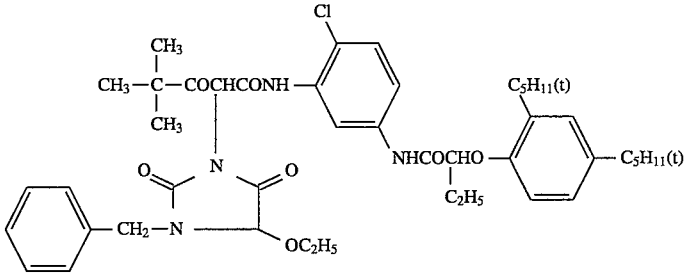
Y-5
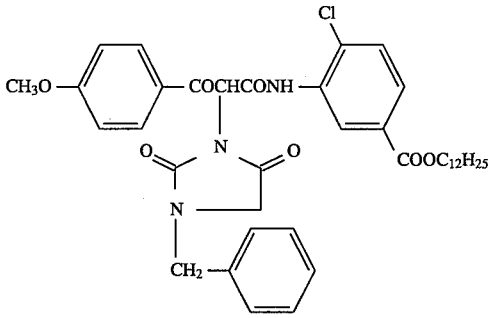
Y-6
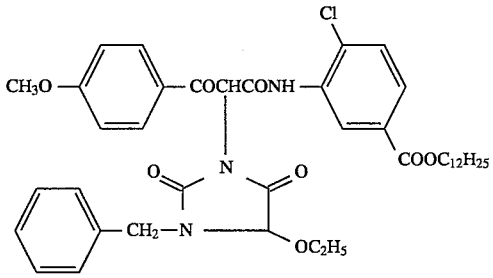
Y-7
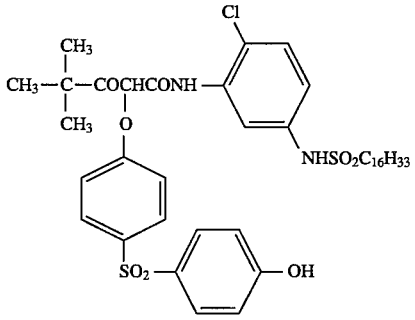

-continued
Y-8
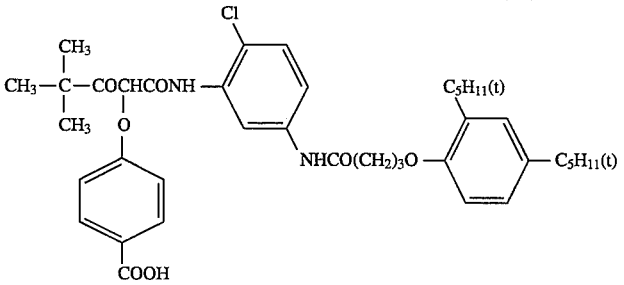
Y-9
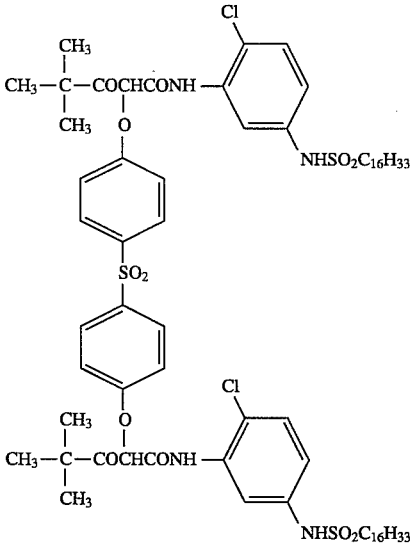
Y-10
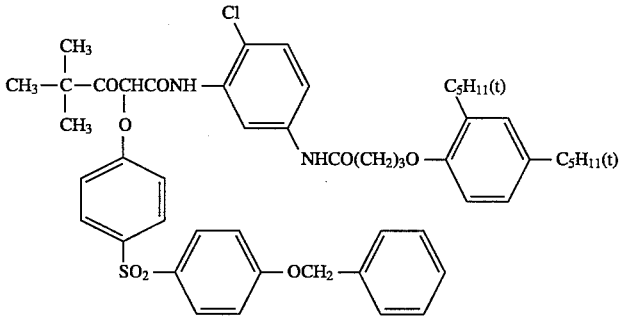
Y-11
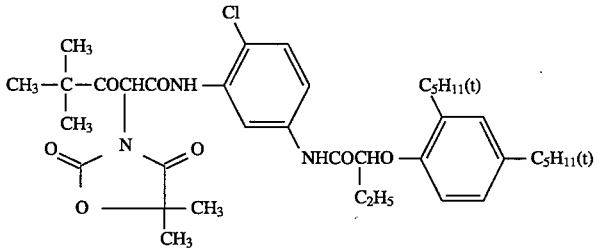
Y-12
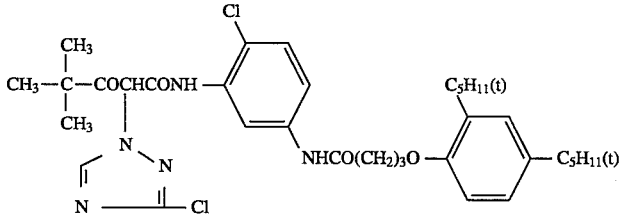

-continued
Y-13
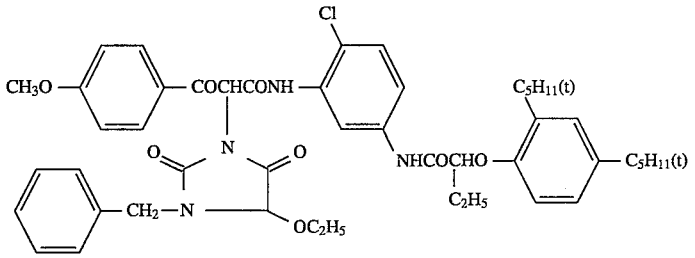
Y-14
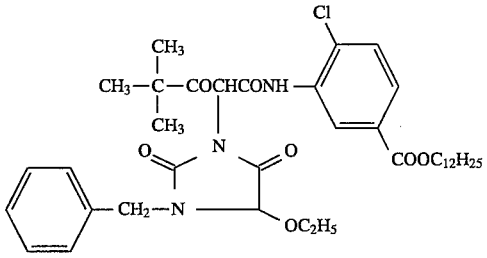
Y-15
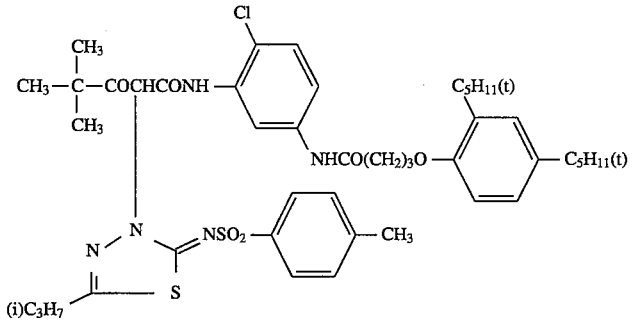
Y-16
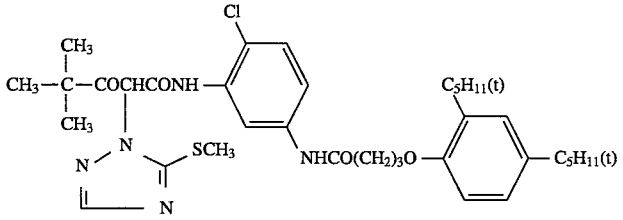
Y-17
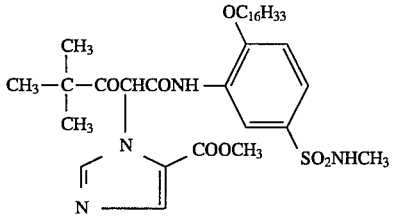
Y-18
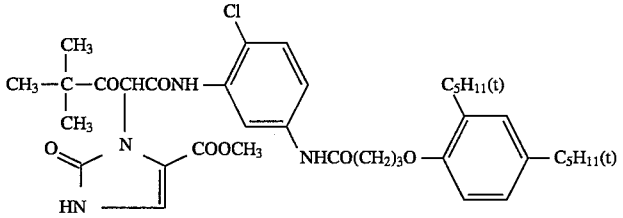

-continued
Y-19
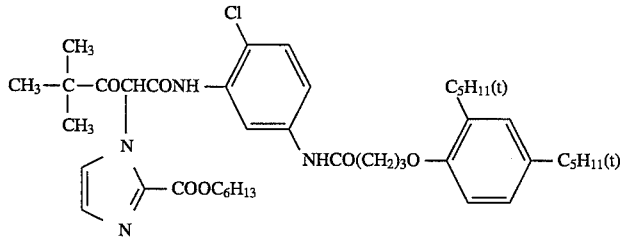
Y-20
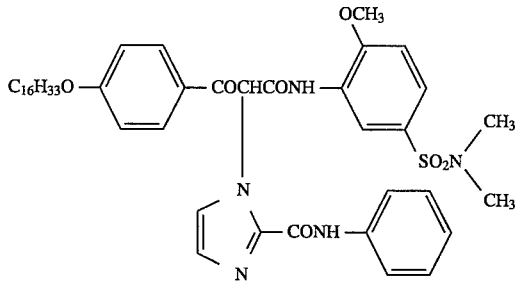
Y-21
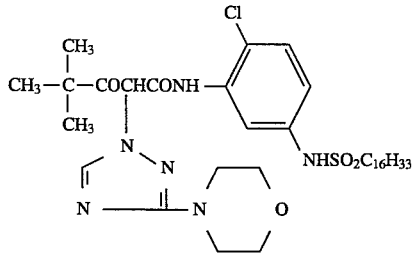
Y-22
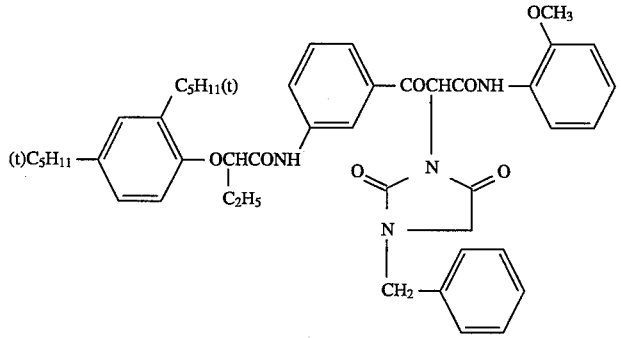
Y-23
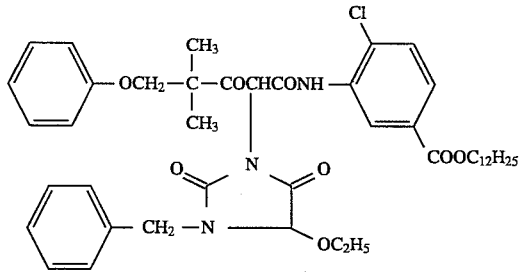

-continued
Y-24
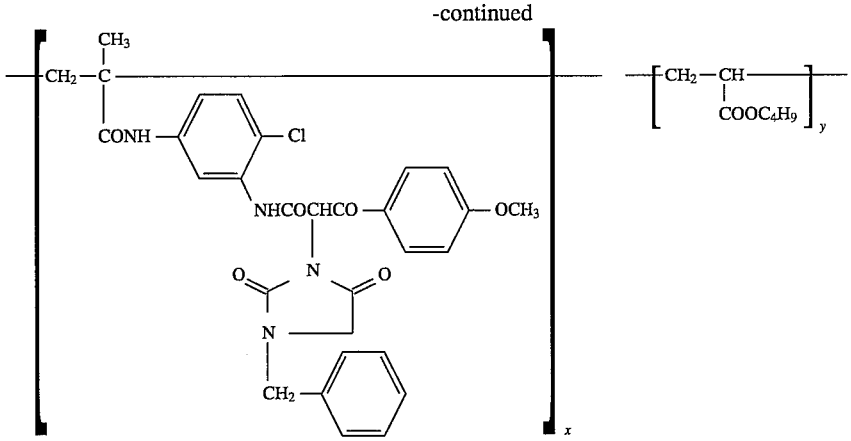
x:y = 50:50
(by weight)
Y-25
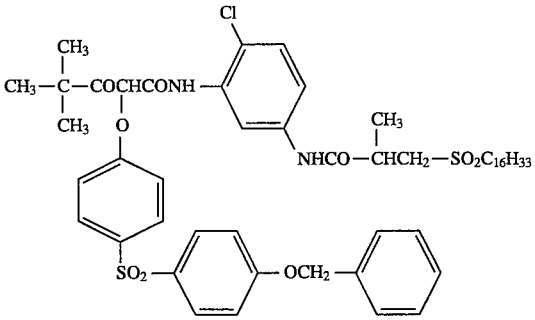
Y-26
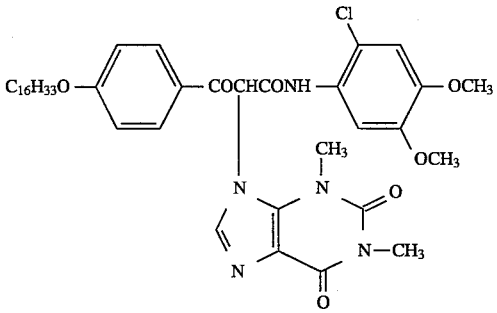
Y-27
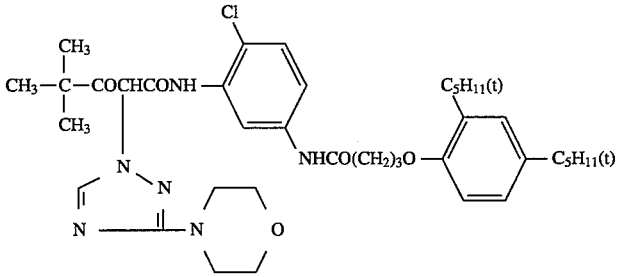

-continued
Two-equivalent magenta couplers
M-1
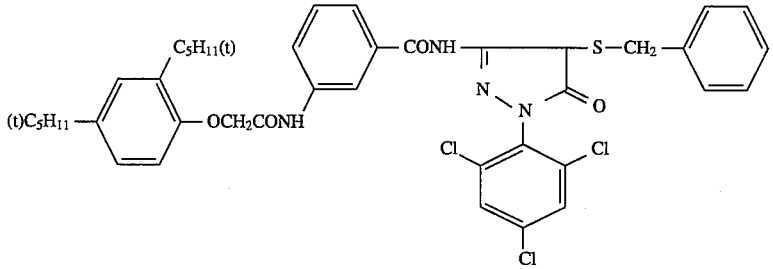
M-2
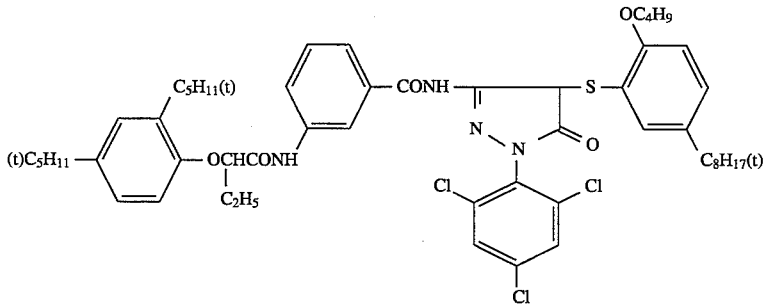
M-3
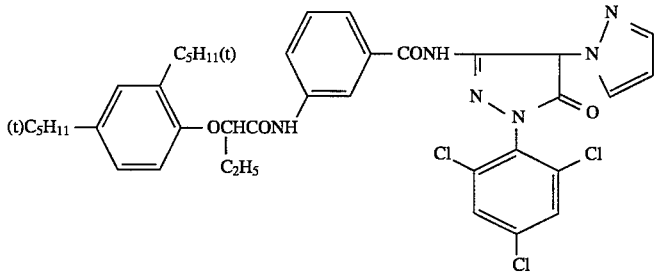
M-4
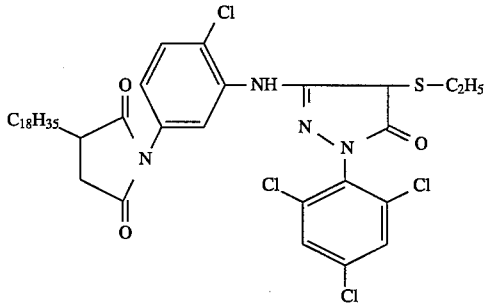
M-5
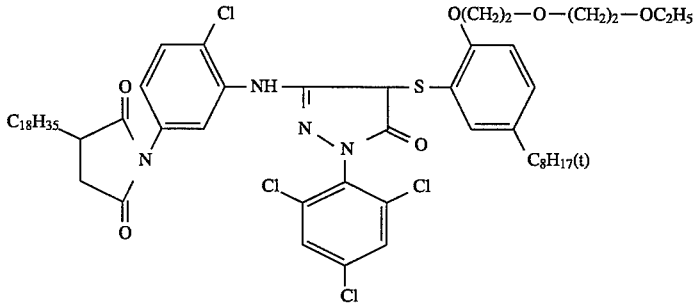

-continued
M-6
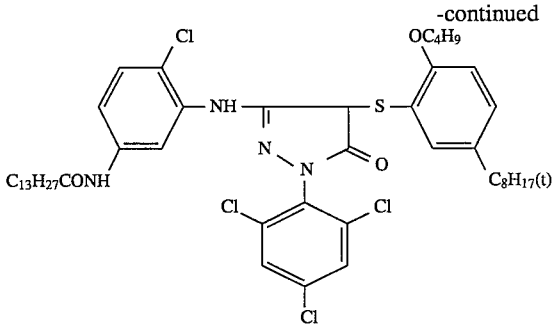
M-7
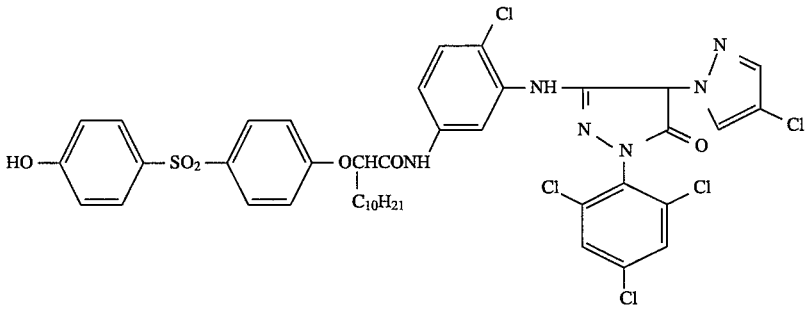
M-8
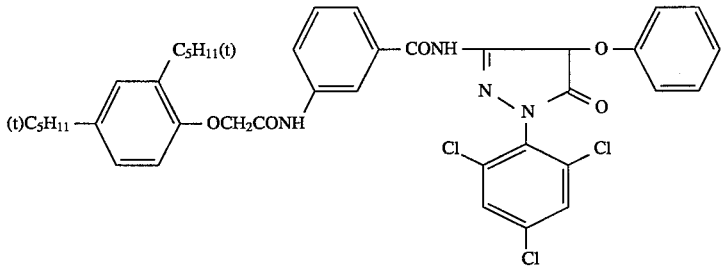
M-9
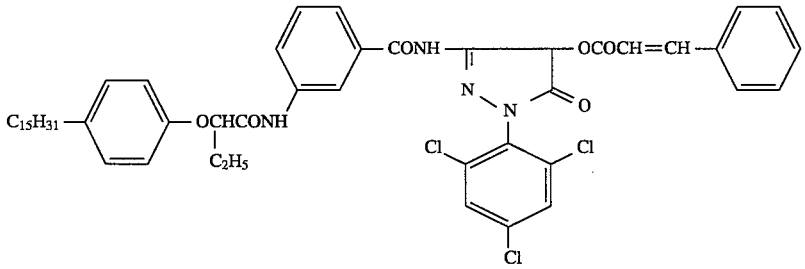
M-10
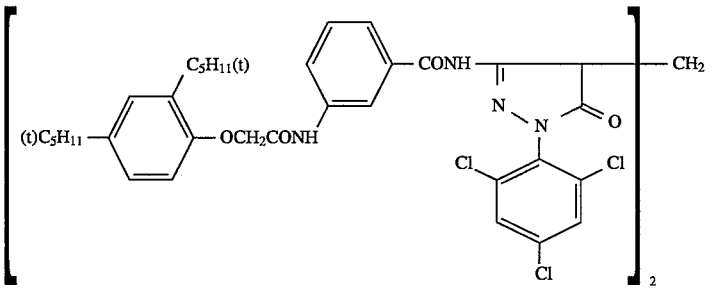

-continued
M-11
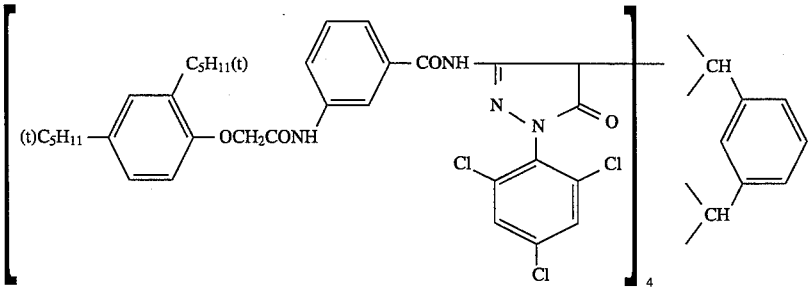
M-12
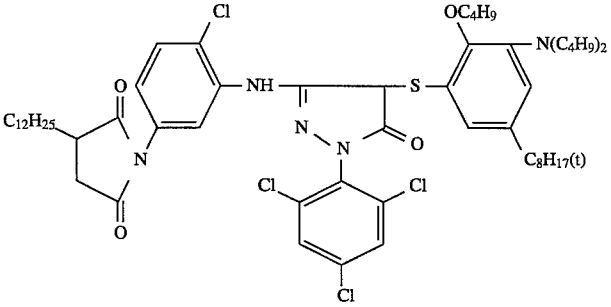
M-13
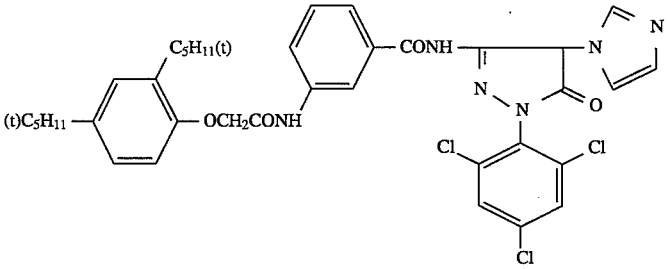
M-14
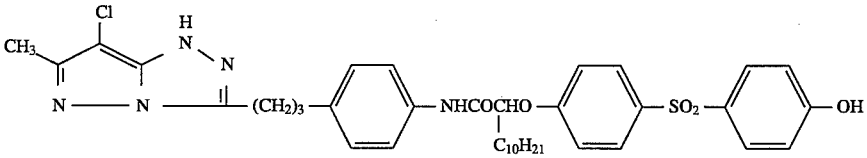
M-15
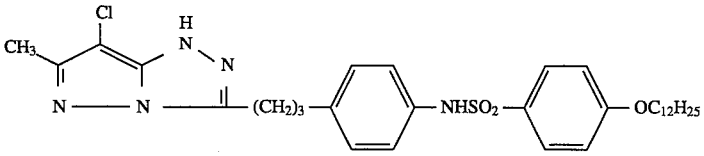
M-16
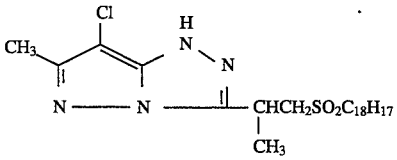
M-17
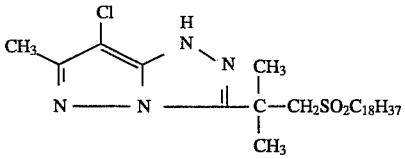

-continued
M-18
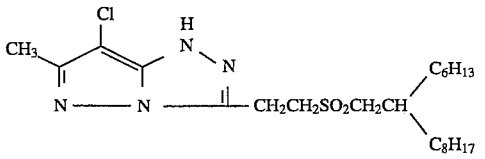
M-19
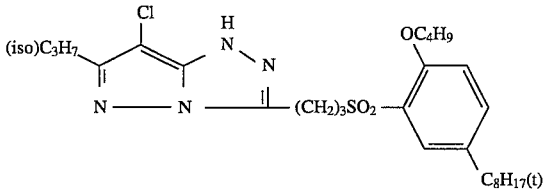
M-20
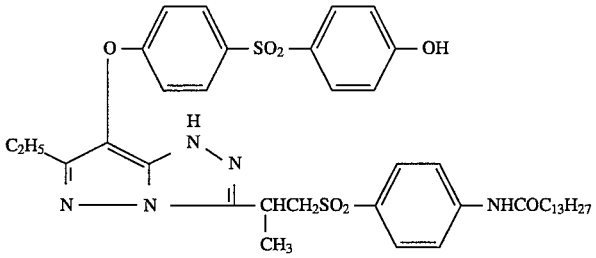
M-21
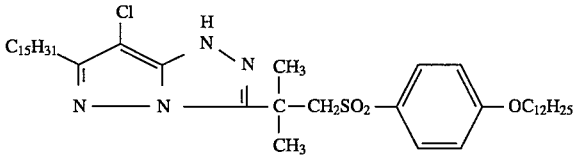
M-22
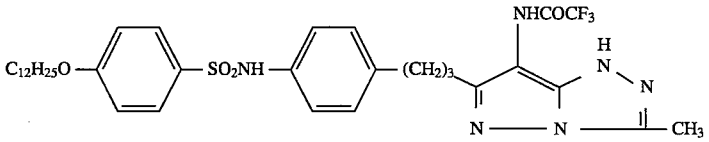
M-23
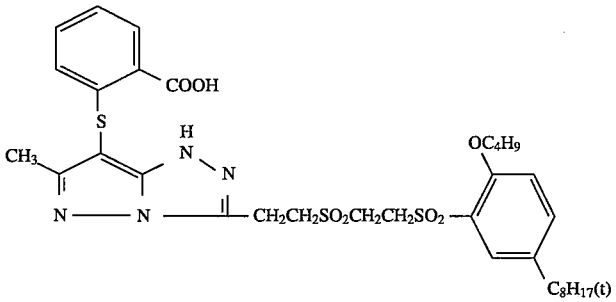
M-24
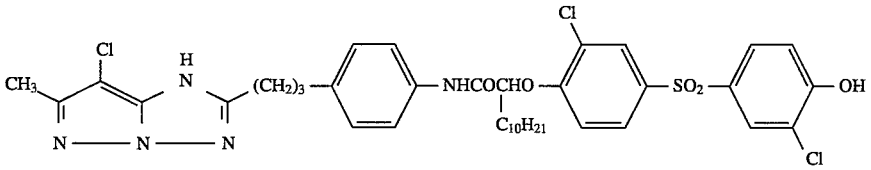
M-25
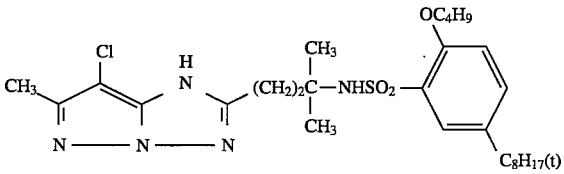

-continued
M-26
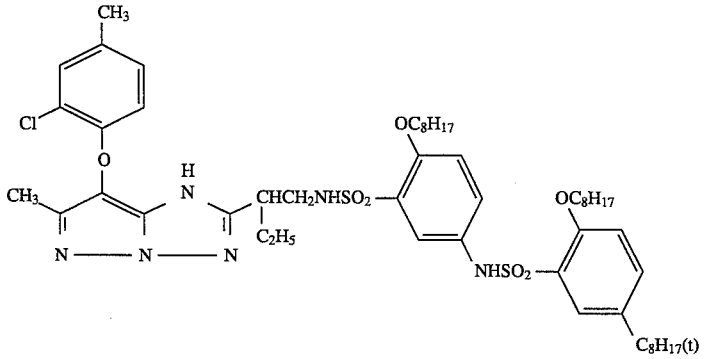
M-27
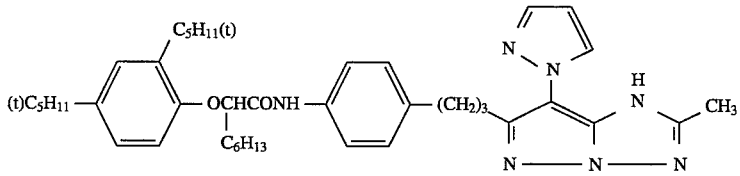
M-28
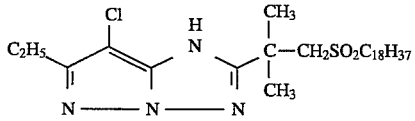
M-29
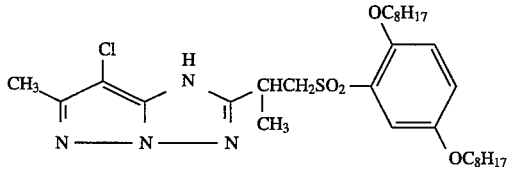
M-30
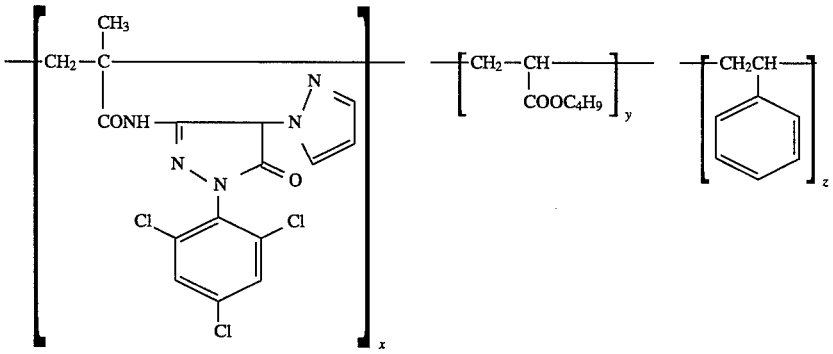
x:y:z = 50:25:25
(by weight)
M-31
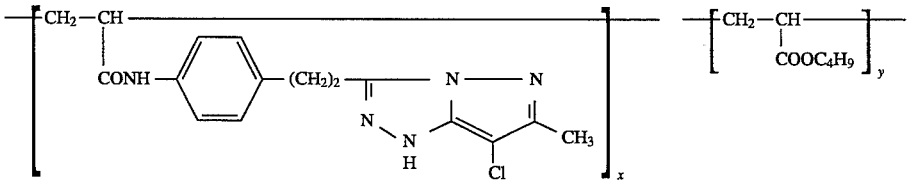
x:y = 50:50 (by weight)

-continued
M-32
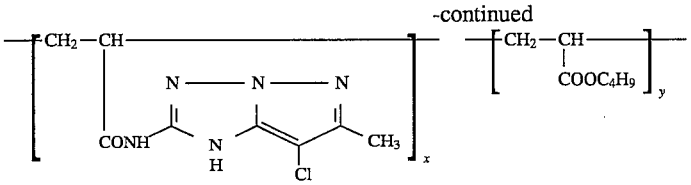
x:y = 50:50
(by weight)
M-33
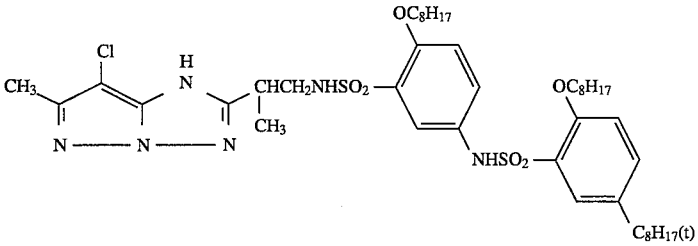
Two-equivalent cyan couplers
C-1
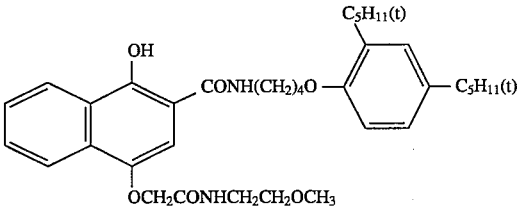
C-2
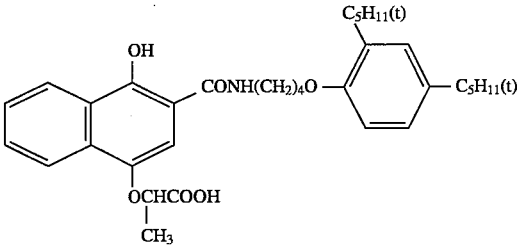
C-3
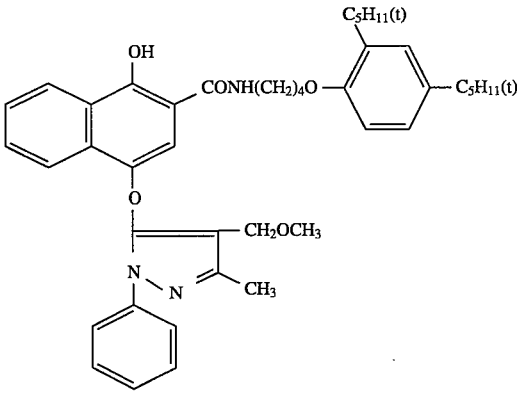
C-4
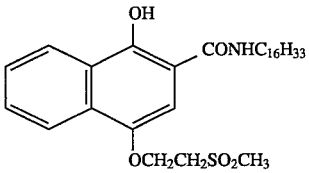

-continued
C-5
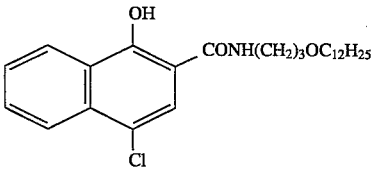
C-6
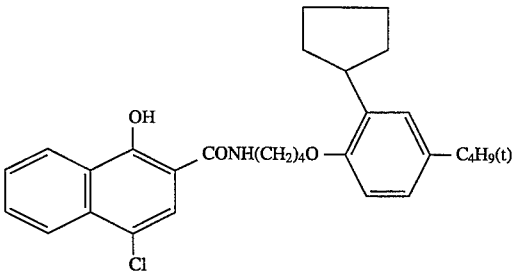
C-7
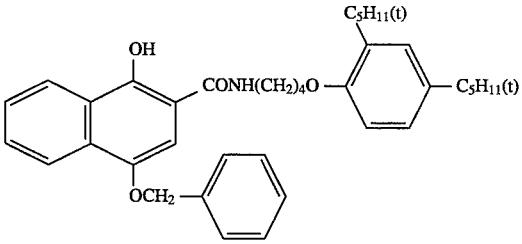
C-8
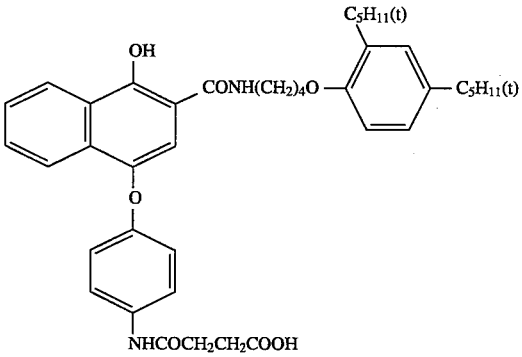
C-9
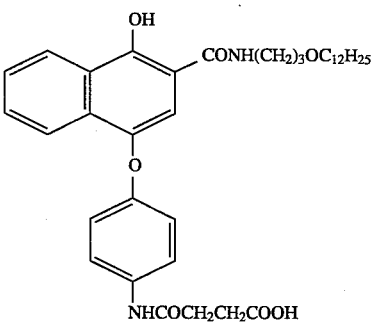

-continued
C-10
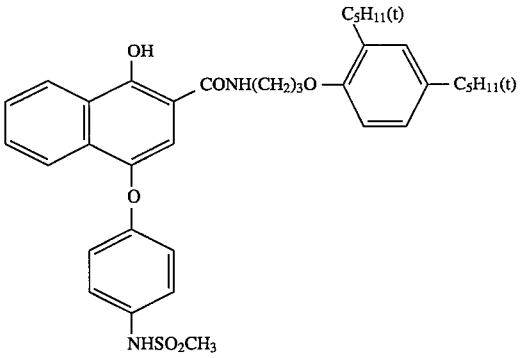
C-11
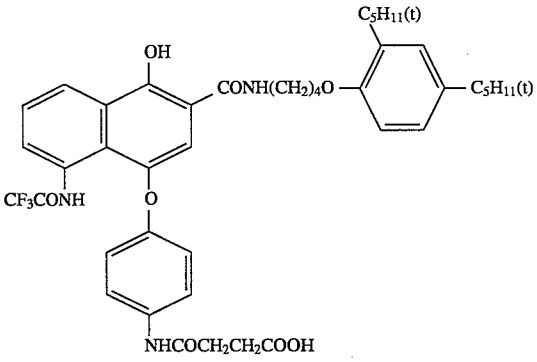
C-12
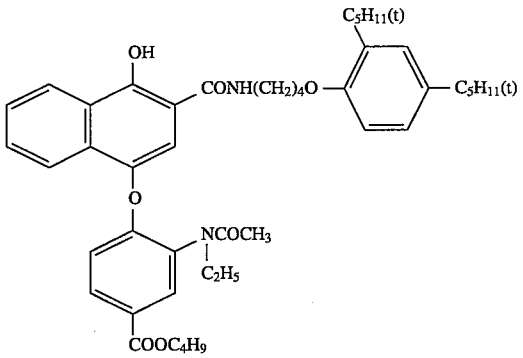
C-13
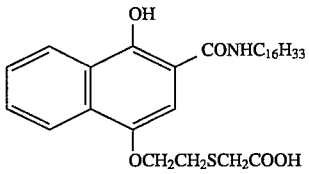
C-14
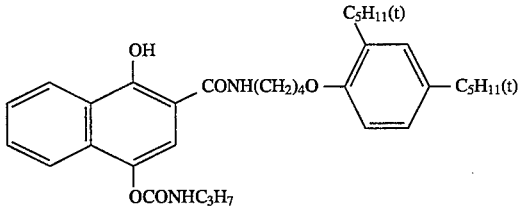

-continued
C-15
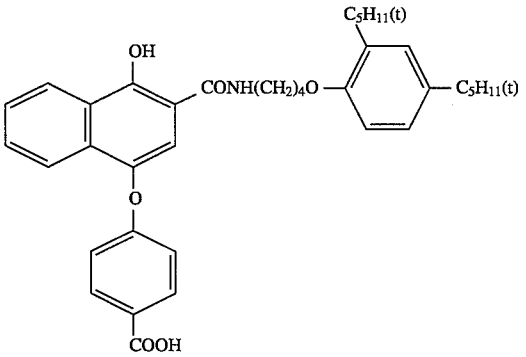
C-16
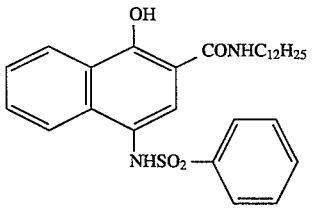
C-17
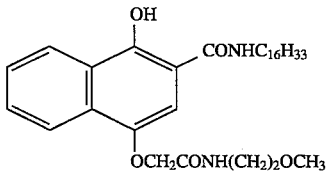
C-18
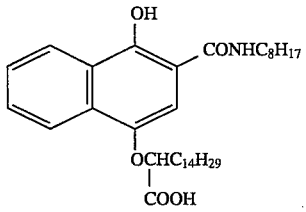
C-19
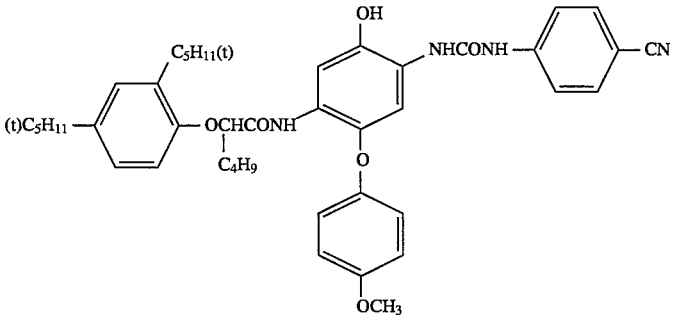
C-20
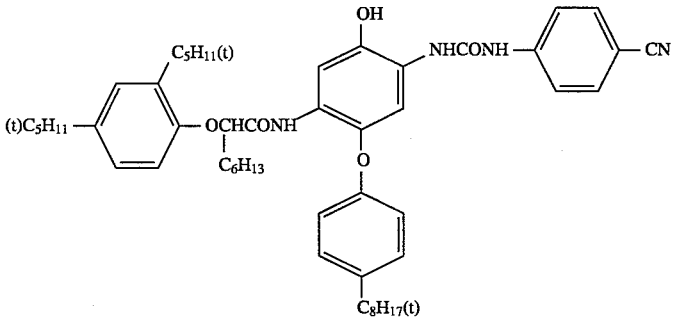

-continued
C-21
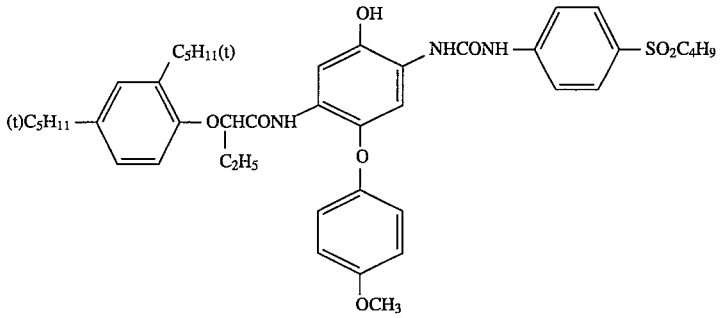
C-22
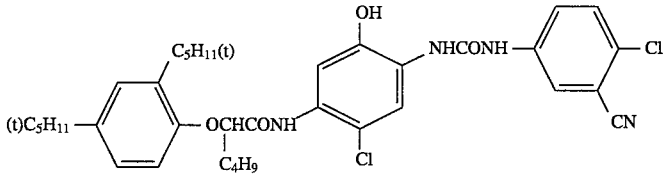
C-23
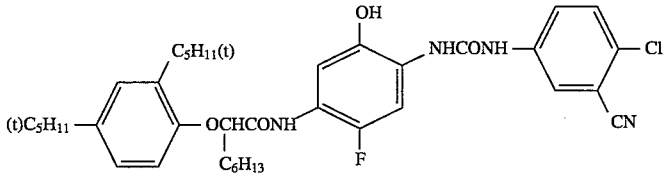
C-24
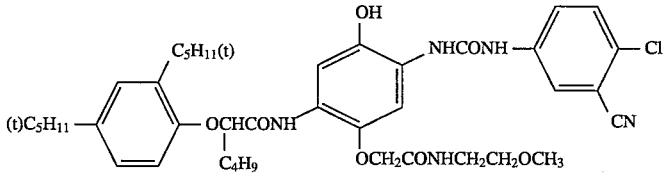
C-25
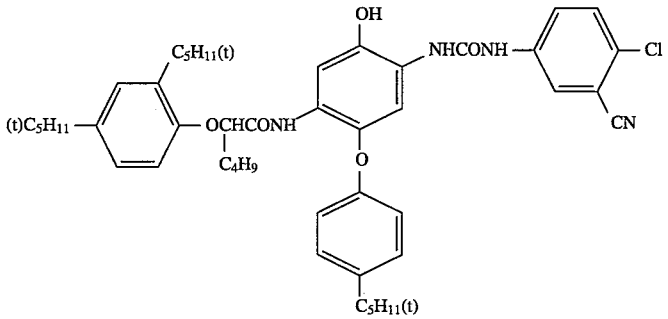
C-26
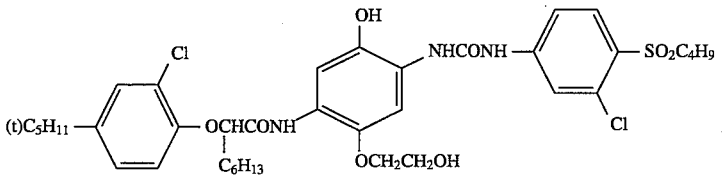

-continued
C-27
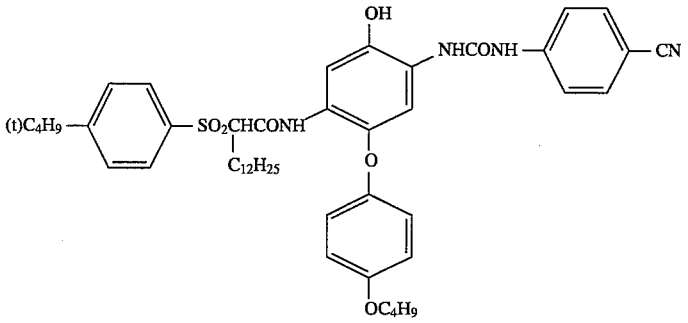
C-28
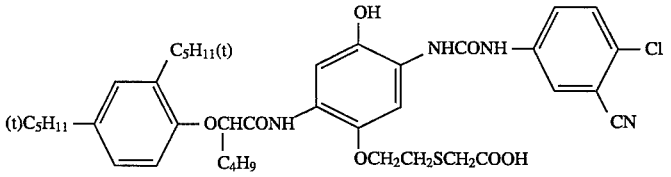
C-29
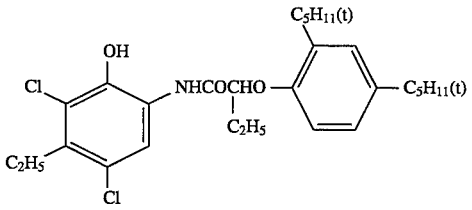
C-30
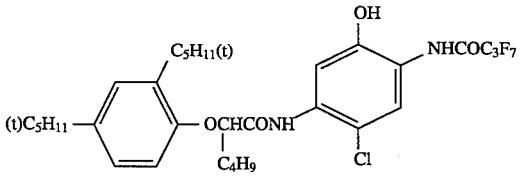
C-31
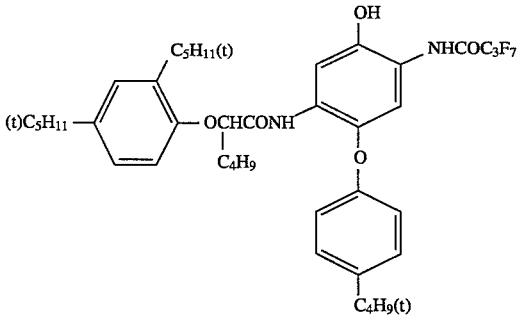
C-32
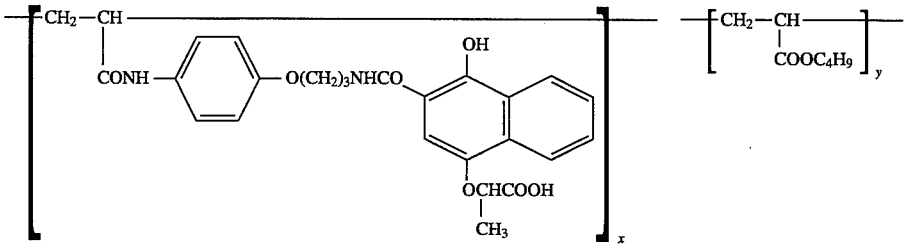
x:y = 40:60
(by weight)

-continued
C-33
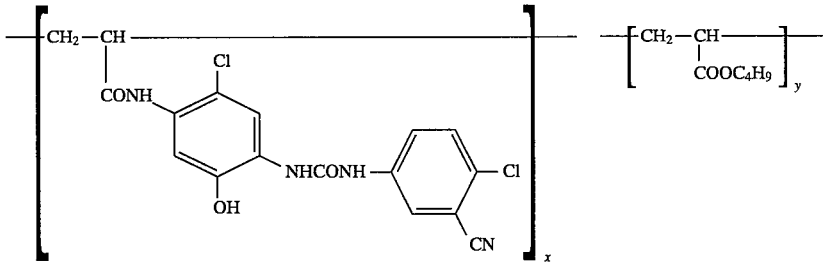
x:y = 50:50
(by weight)
C-34
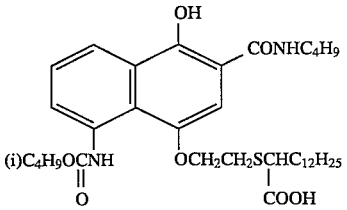
C-35
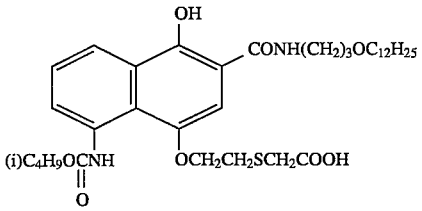
C-36
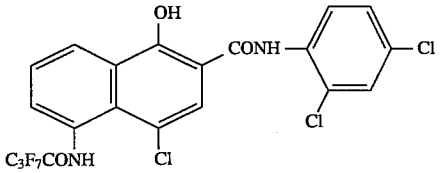
C-37
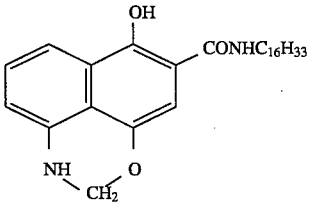
C-38
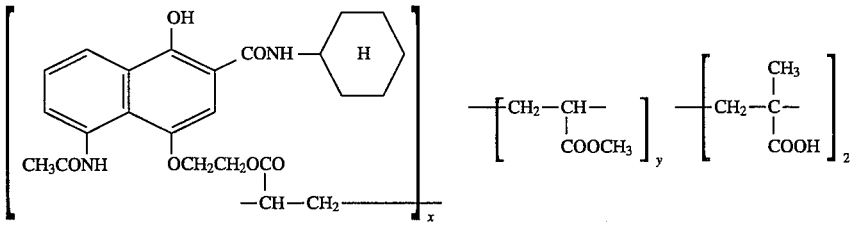
x:y:z = 5:4:1
(by weight)
C-39
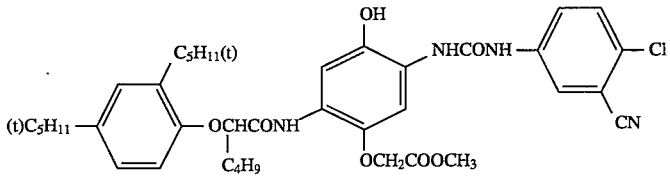

The four-equivalent couplers that can be used in the present invention are listed below.
Four-equivalent yellow couplers
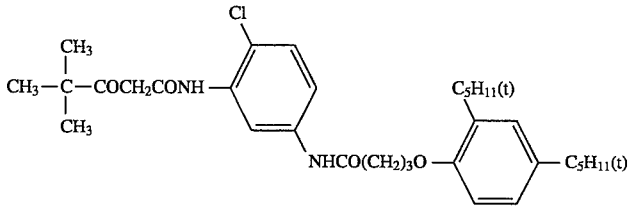
$Y_4$-1
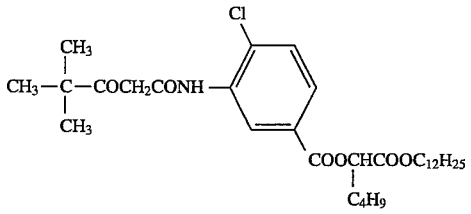
$Y_4$-2
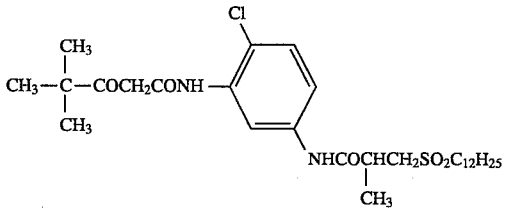
$Y_4$-3
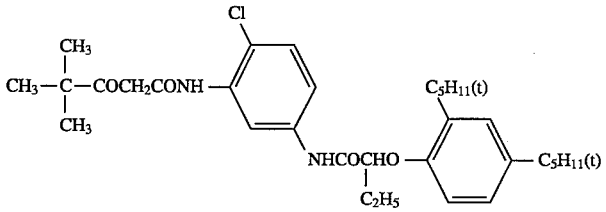
$Y_4$-4
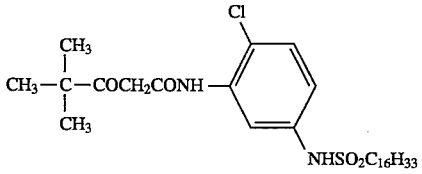
$Y_4$-5
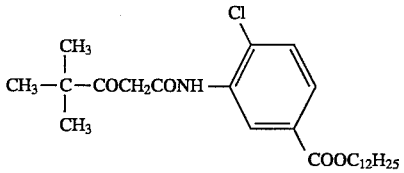
$Y_4$-6
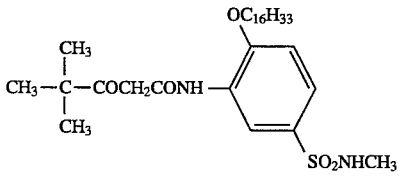
$Y_4$-7

-continued
$Y_4$-8
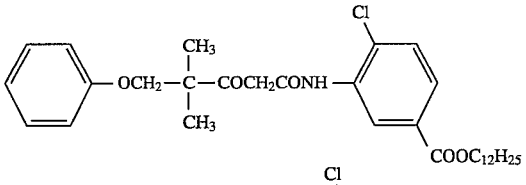
$Y_4$-9
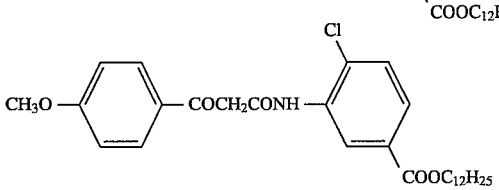
$Y_4$-10
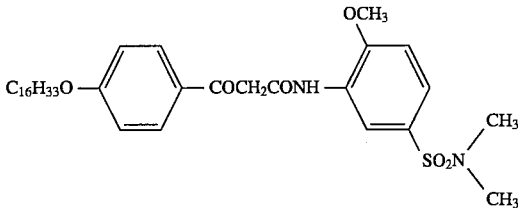
$Y_4$-11
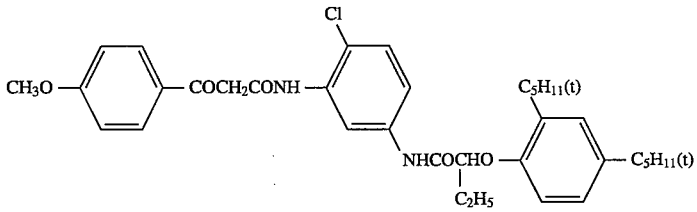
$Y_4$-12
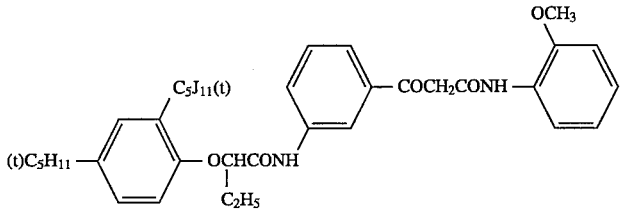
$Y_4$-13
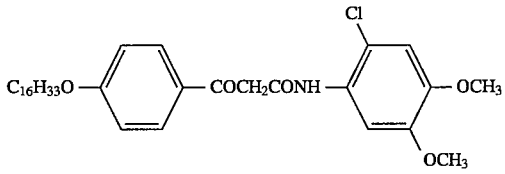
$Y_4$14
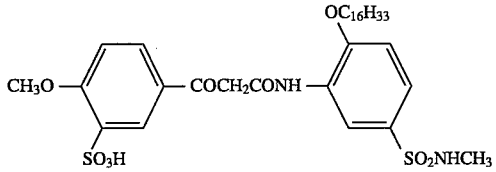
$Y_4$-15
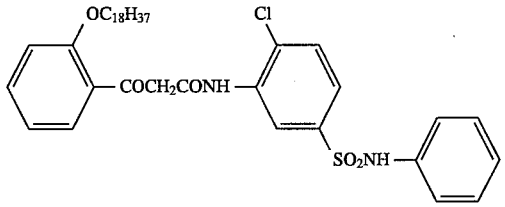

-continued
$Y_4$-16
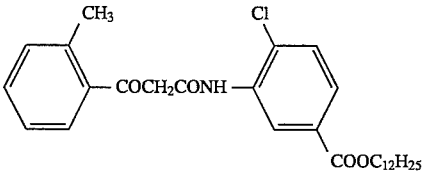
$Y_4$-17
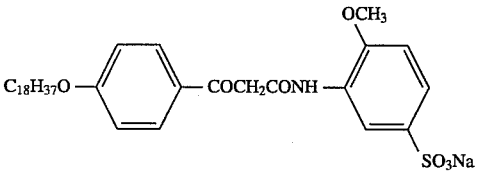
$Y_4$-18
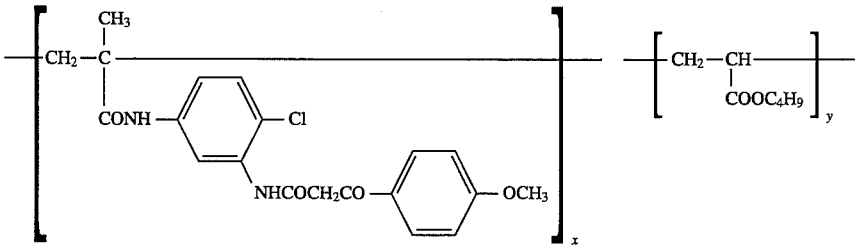
x:y = 50:50
(by weight)
Four-equivalent magenta couplers
$M_4$-1
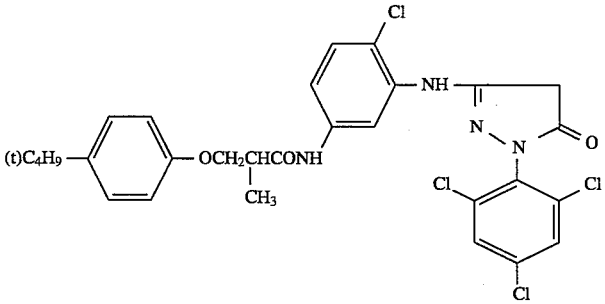
$M_4$-2
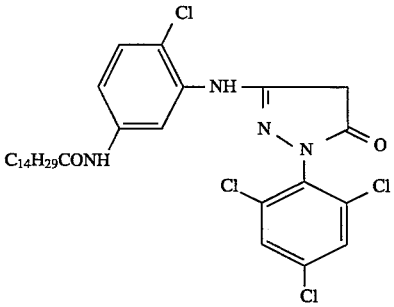
$M_4$-3
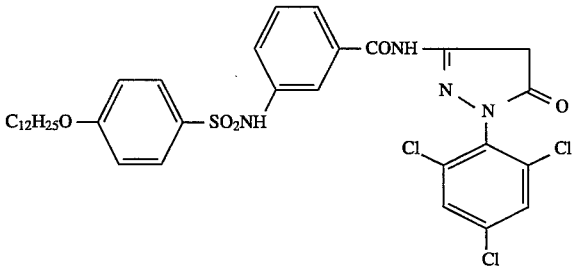

-continued
$M_4$-4
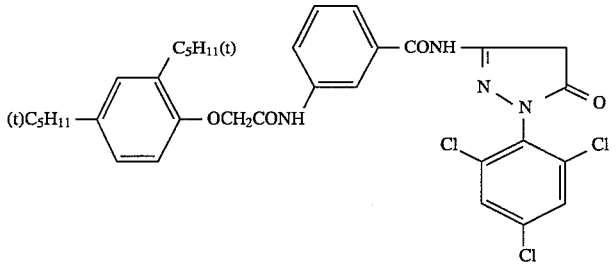
$M_4$-5
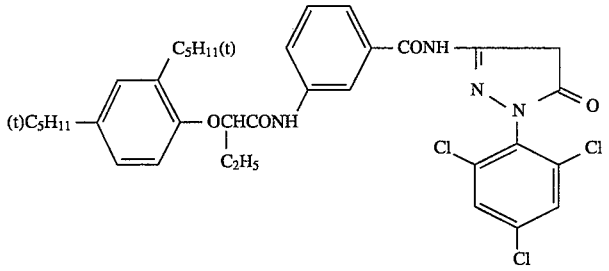
$M_4$-6
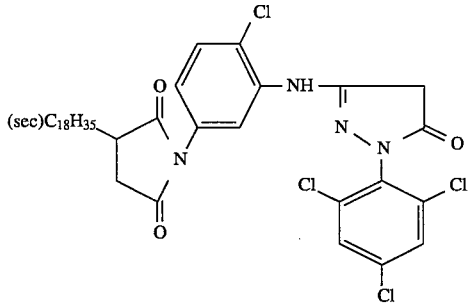
$M_4$-7
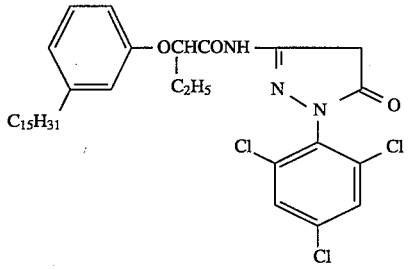
$M_4$-8
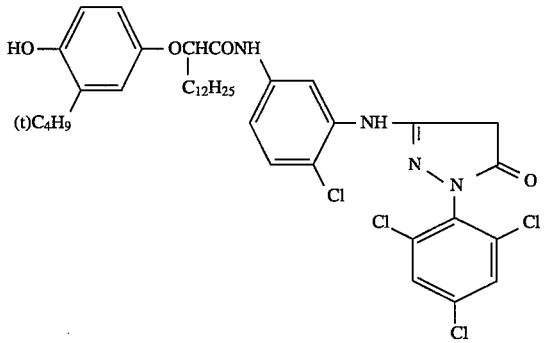

-continued
$M_4$-9
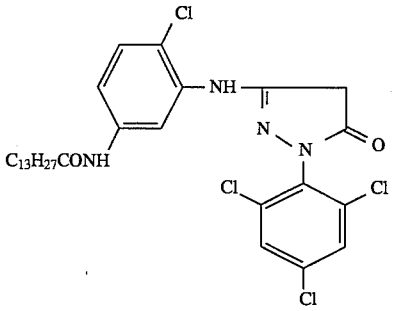
$M_4$-10
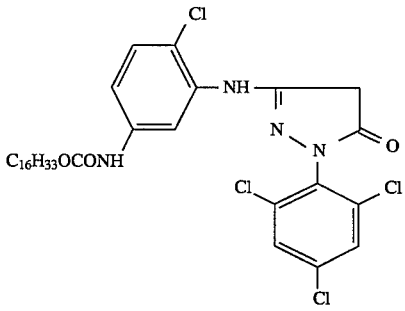
$M_4$-11
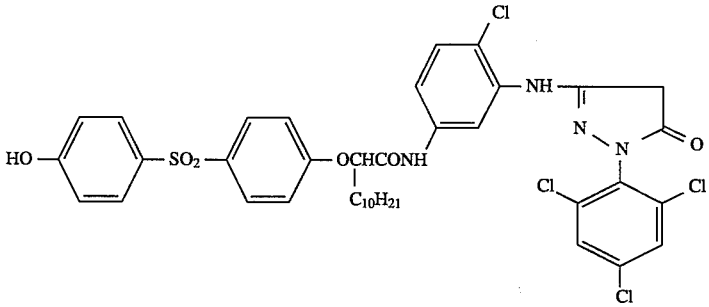
$M_4$-12
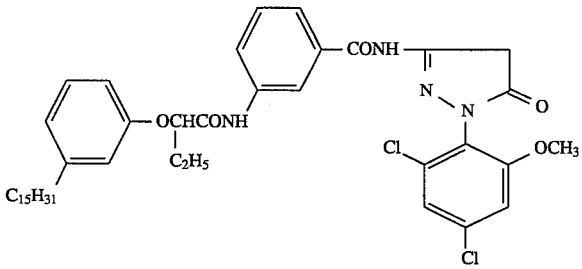
$M_4$-13
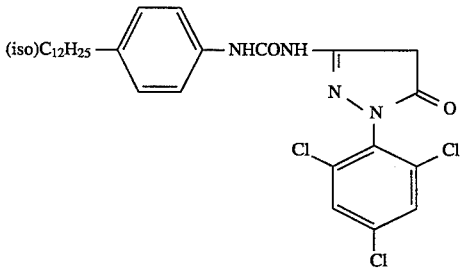

-continued
$M_4$-14
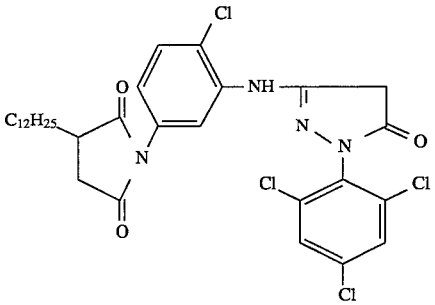
$M_4$-15
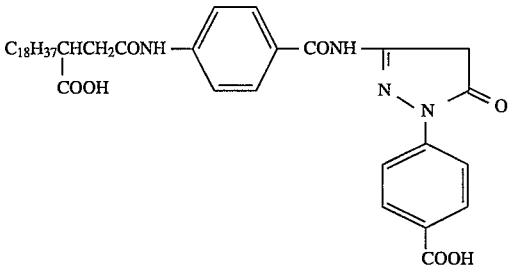
$M_4$-16
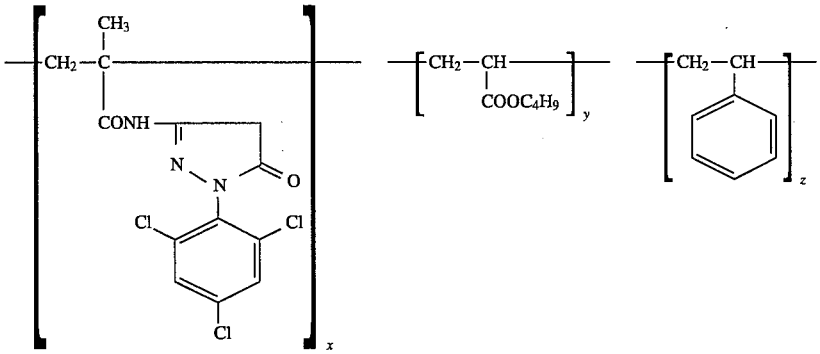
x:y:z = 50:25:25
(by weight)
$M_4$-17
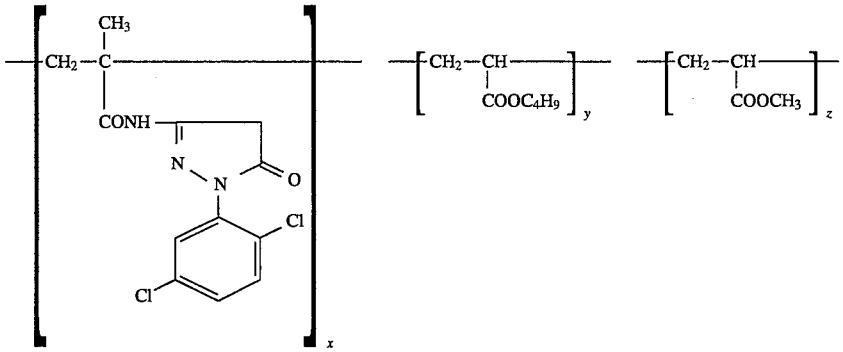
x:y:z = 50:25:25
(by weight)

-continued
$M_4$-18
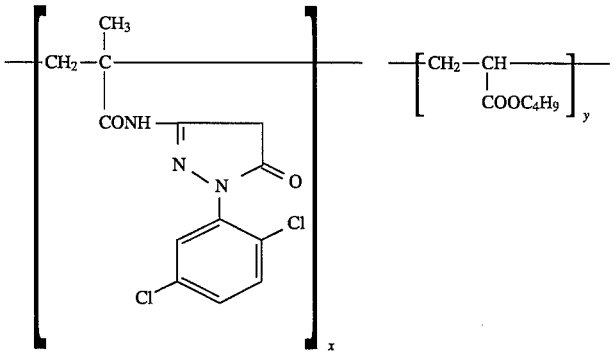
x:y = 55:45
(by weight)
$M_4$-19
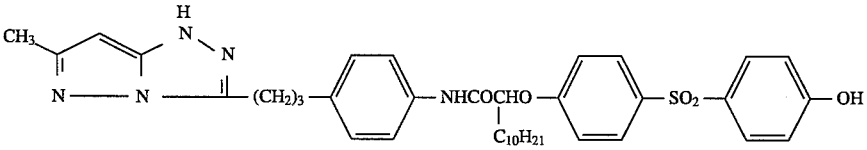
$M_4$-20
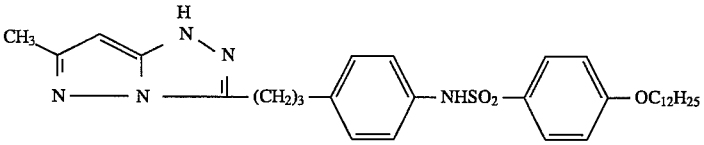
$M_4$-21
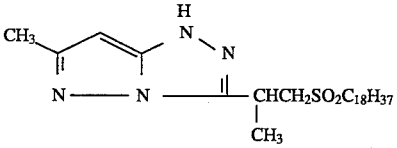
$M_4$-22
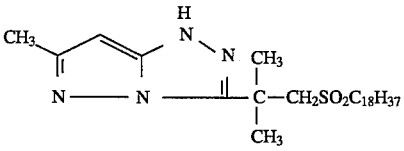
$M_4$-23
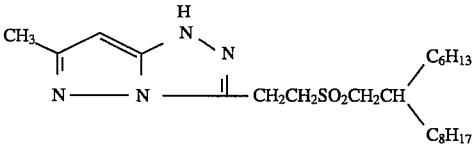
$M_4$-24
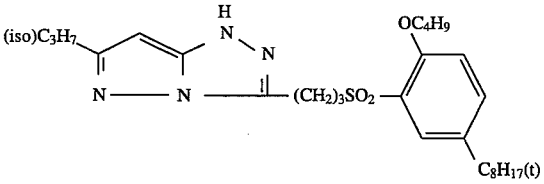
$M_4$-25
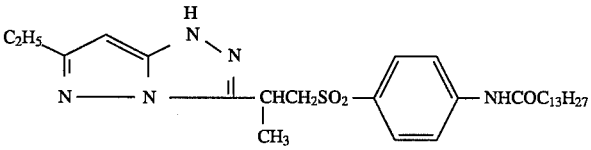

-continued
$M_4$-26
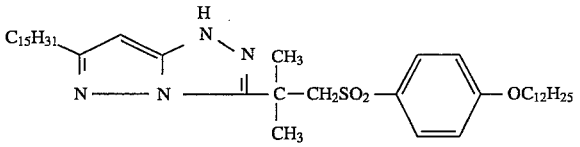
$M_4$-27
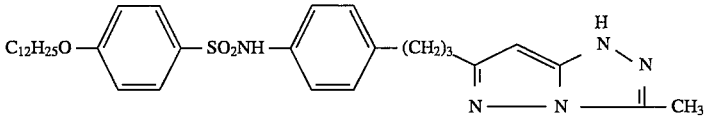
$M_4$-28
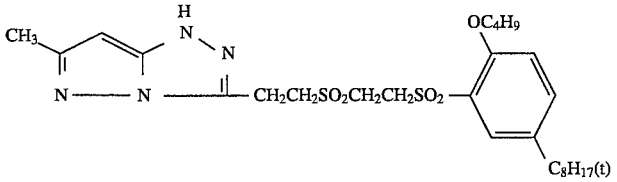
$M_4$-29
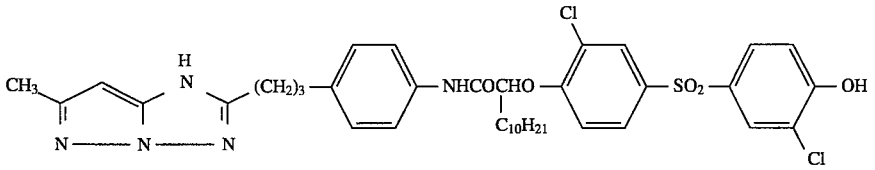
$M_4$-30
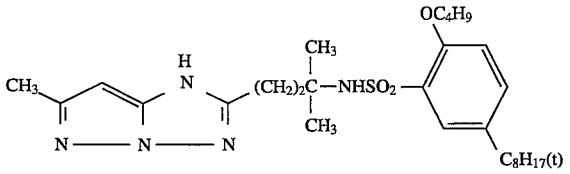
$M_4$-31
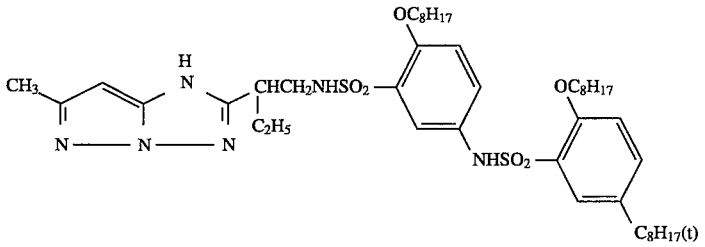
$M_4$-32
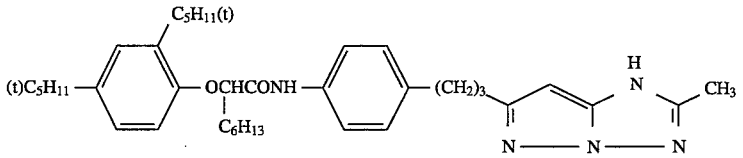
$M_4$-33
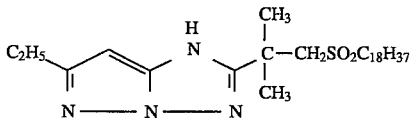
$M_4$-34
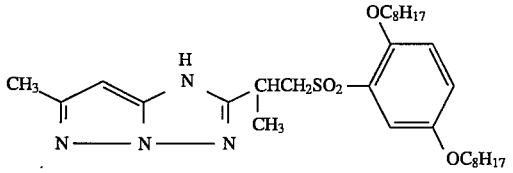

-continued
$M_4$-35
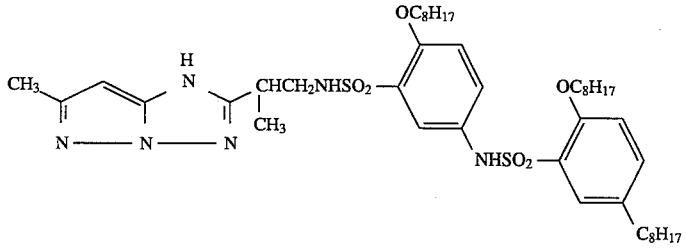
$M_4$-36
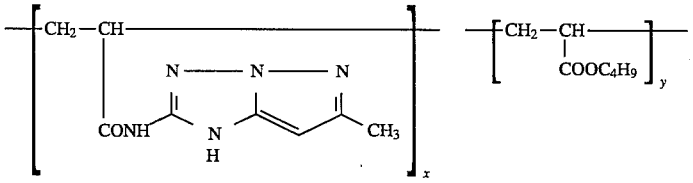
x:y = 50:50
(by weight)
$M_4$-37
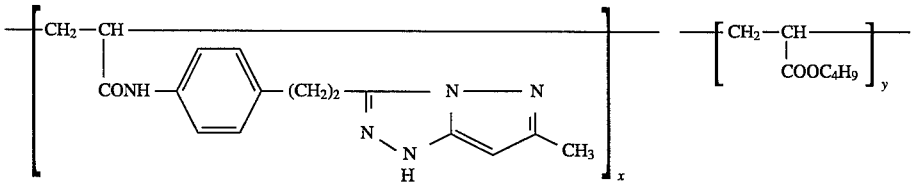
x:y = 50:50
(by weight)
Four-equivalent cyan couplers
$C_4$-1
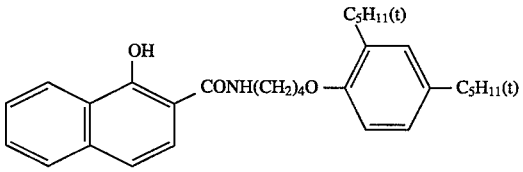
$C_4$-2
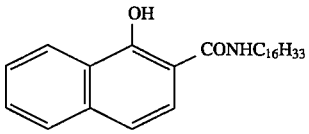
$C_4$-3
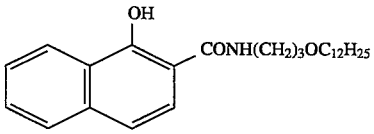
$C_4$-4
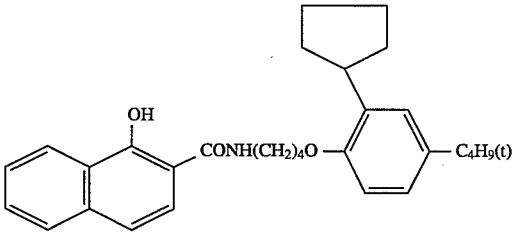
$C_4$-5
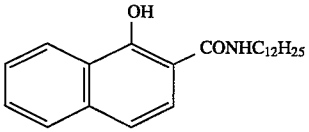

-continued
$C_4$-6
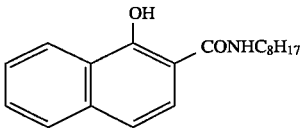
$C_4$-7
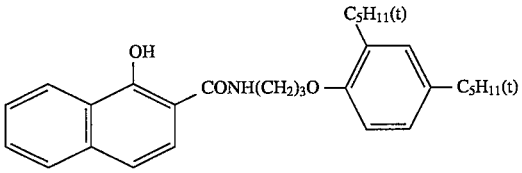
$C_4$-8
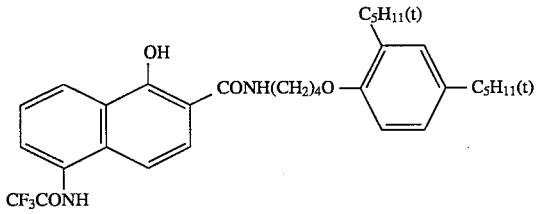
$C_4$-9
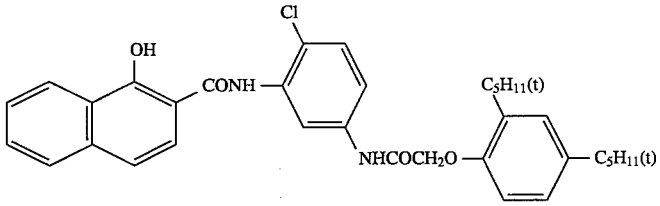
$C_4$-10
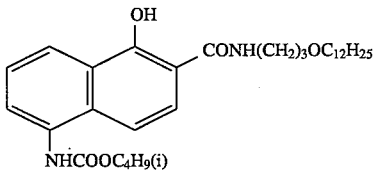
$C_4$-11
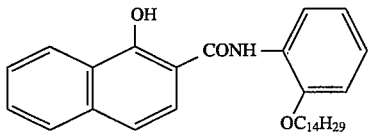
$C_4$-12
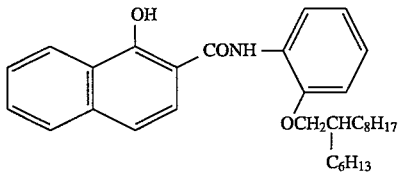
$C_4$-13
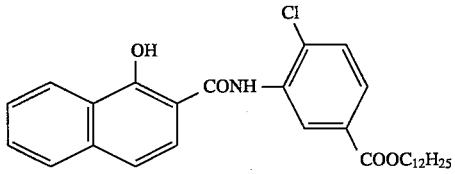
$C_4$-14
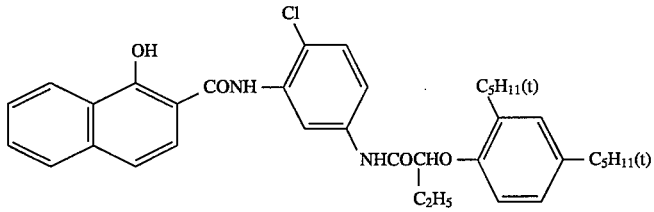

-continued
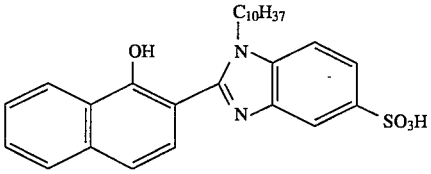
$C_4$-15
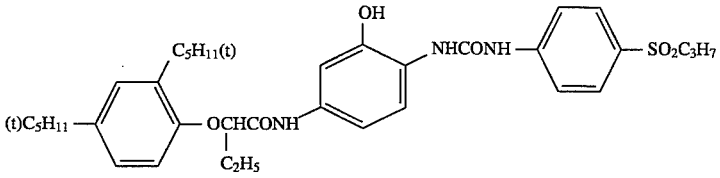
$C_4$-16
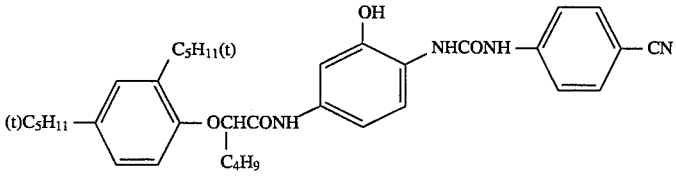
$C_4$-17
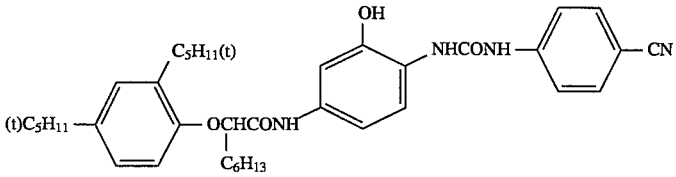
$C_4$-18
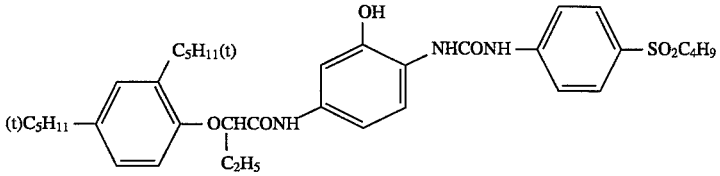
$C_4$-19
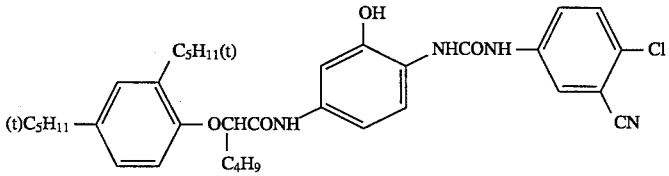
$C_4$-20
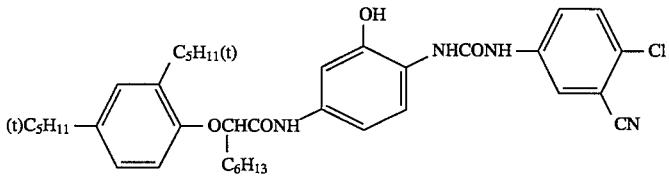
$C_4$-21
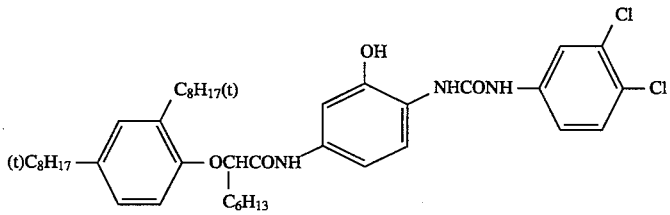
$C_4$-22

-continued
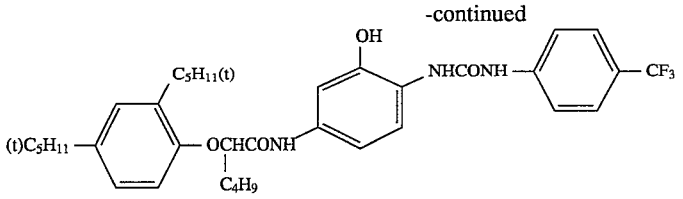
$C_4$-23
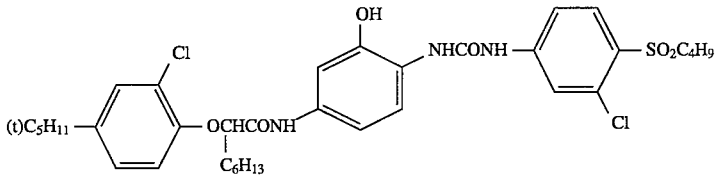
$C_4$-24
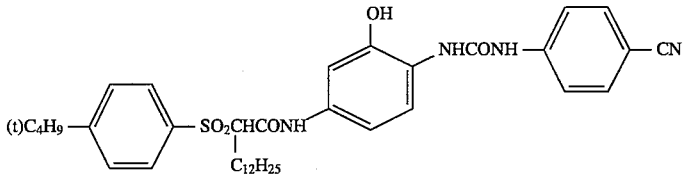
$C_4$-25
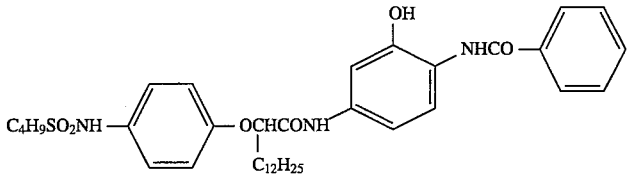
$C_4$-26
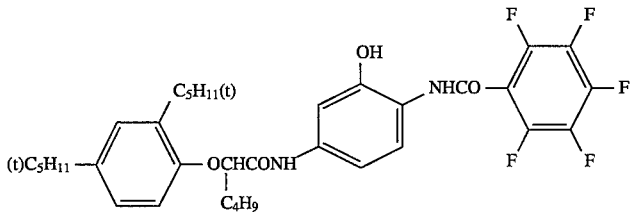
$C_4$-27
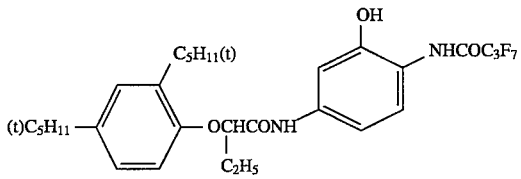
$C_4$-28
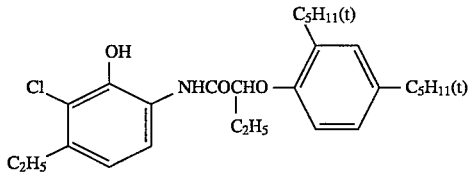
$C_4$-29
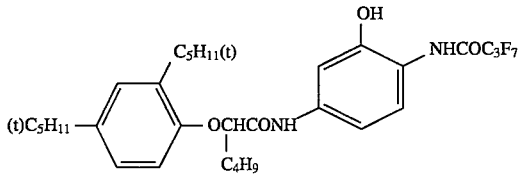
$C_4$-30

-continued
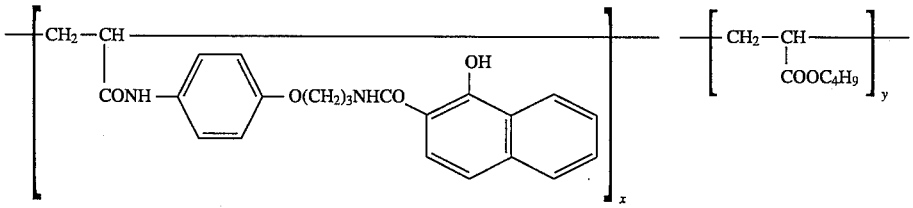
$C_4$-31
x:y = 40:60
(by weight)
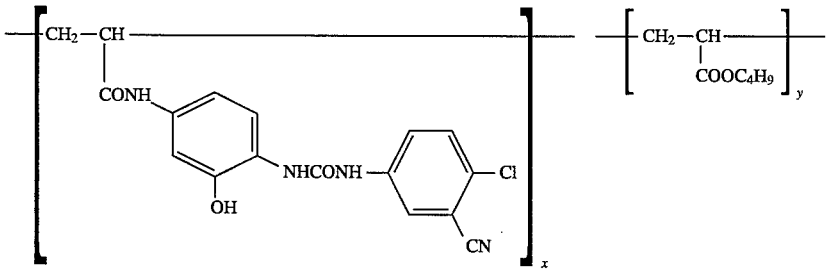
$C_4$-32
x:y = 50:50
(by weight)
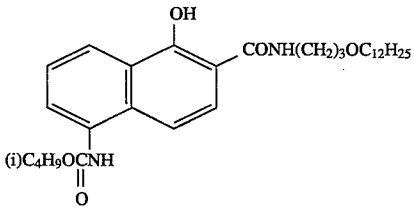
$C_4$-33
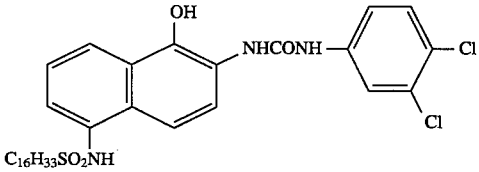
$C_4$-34
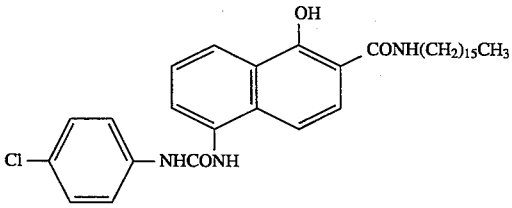
$C_4$-35
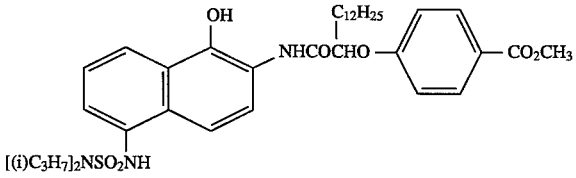
$C_4$-36
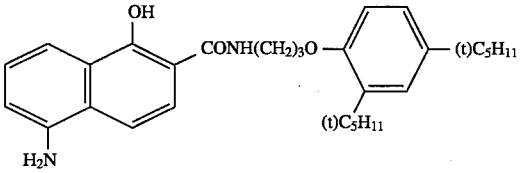
$C_4$-37

-continued

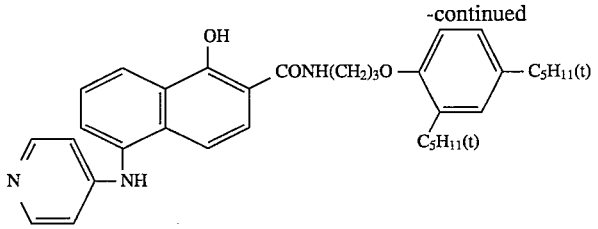

$C_4$-38

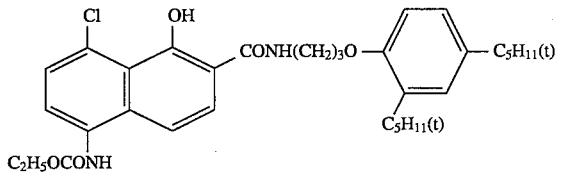

$C_4$-39

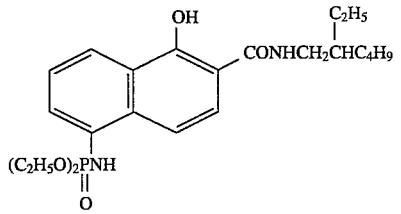

$C_4$-40

The yellow, magenta and cyan couplers described above are typically used in amounts ranging from $1\times10^{-4}$ to 10 moles per mole of silver halide.

The couplers described above which are chiefly responsible for image formation are preferably used in combination with other couplers such as those which release development inhibitors, bleach accerators or compounds that are capable of scavenging time oxidation product of color developing agents (e.g. DIR couplers, BAR couplers and DSR couplers), and masking couplers capable of color correction (e.g. colored couplers).

Preferred DIR couplers (i.e., couplers that release development inhibitors) are diffusible DIR couplers.

transparent support.

Sample (I): sample having a green-sensitive silver halide emulsion layer

A gelatin solution that contains both silver iodobromide (6 mol % AgI) grains (average grain size, 0.48 μm) spectrally sensitized for green light and a coupler (see below) in an amount of 0.07 mole per mole of Ag is coated on a transparent support to provide a silver deposit of 1.1 g/m$^2$ and a gelatin deposit of 3.0 g/m$^2$; the emulsion layer is overcoated with a protective layer by applying a gelatin solution that contains neither chemically nor spectrally sensitized silver iodobromide (2 mol % AgI) grains (average grain size, 0.03 μm); the silver deposit is 0.1 g/m$^2$ and the gelatin deposit is 0.8 g/m$^2$;

Coupler

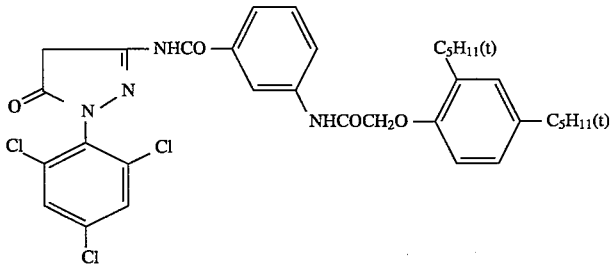

The diffusible DIR coupler that is preferably used in the present invention is such that the diffusibility of a development inhibitor or a compound that is capable of releasing a development inhibitor, which are eliminated upon reaction with the oxidation product of a color developing agent, is at least 0.34, preferably at least 0.40, as evaluated by the method to be described just below.

Diffusiblity evaluation is performed by the following method.

1. First, prepare two samples of light-sensitive material (I) and (II) that have layers of the following compositions on a Sample (II): Same as sample (I) except that the protective layer does not contain silver iodobromide grains.

Each or the layers in samples (I) and (II) also contains a gelatin hardener and a surfactant.

Samples (I) and (II) are exposed to white light through an optical wedge and subsequently processed according to the scheme shown below. Two developers are used: one contains various development inhibiors in amounts that are sufficient to reduce the sensitivity or sample (II) to 60% ($-\Delta\log E=0.22$), and the other does not contain any development inhibitor.

| Processing steps (38° C.) | |
|---|---|
| Color development | 2 min and 40 sec |
| Bleaching | 6 min and 30 sec |
| Washing | 3 min and 15 sec |
| Fixing | 6 min and 30 sec |
| Washing | 3 min and 15 see |
| Stabilizing | I min and 30 sec |
| Drying | |

The processing solutions have the following compositions.

| Color developer | |
|---|---|
| 4-Amino-3-methyl-N-ethyl-N-(β-hydroxyethyl)-aniline sulfate | 4.75 g |
| Anhydrous sodium sulfite | 4.25 g |
| Hydroxylamine hemisulfate | 2.0 g |
| Anhydrous potassium carbonate | 37.5 g |
| Sodium bromide | 1.3 g |
| Nitrilotriacetie acid trisodium salt (monohydrate) | 2.5 g] |
| Potassium hydroxide | 1.0 g |
| Water | to make 1,000 ml |
| Bleaching solution | |
| Ethylenediaminetetraacetic acid iron ammonium salt | 100.0 g |
| Ethylenediaminetetraacetic acid diammonium salt | 10.0 g |
| Ammonium bromide | 150.0 g |
| Glacial acetic acid | 10.0 ml |
| Water | to make 1,000 ml |
| pH adjusted to 6.0 with aqueous ammonia | |
| Fixing solution | |
| Ammonium thiosulfate | 175.0 g |
| Anhydrous sodium sulfite | 8.5 g |
| Sodium metasulfite | 2.3 g |
| Water | to make 1,000 ml |
| pH adjusted to 6.0 with acetic acid | |
| Stabilizing solution | |
| Formaldehyde (37% aq. sol.) | 1.5 ml |
| Konidax (Konica Corp.) | 7.5 ml |
| Water | to make 1,000 ml |

Suppose that samples (I) and (II) have sensitivities of So and So', respectively in the absence of a development inhibitor, and also suppose that the respective samples have sensititives of $s_I$ and $S_{II}$ in the presence of a development inhibitor. Then, diffusibility is expressed by $\Delta S/\Delta So$, where $\Delta S=So-S_I$ and represents the degree of desensitization occurring in sample (I), and $\Delta So=So'-S_{II}$ and represents the degree of desensitization occurring in sample (II).

In all instances, sensitivity is determined as –logE, or the logarithm of the reciprocal of the amount of exposure necessary to provide a fog density +0.3.

The diffusible DIR compound to be used in the present invention may be of any chemical structure as long as the released group has a diffusibility within the range specified above.

Representative structural formulas for the diffusible DIR compound are shown below:

$$A—(Y)_m \qquad \text{(D-1)}$$

where A is a coupler residue; m is i or 2; Y is a group that is bonded to the coupling site of coupler residue A and that leaves upon reaction with the oxidation product of a color developing agent; Y is a development inhibitor group or a group capable of releasing a development inhibitor; the diffusibility of Y is at least 0.34.

In the general formula (D-1), Y is typically represented by the following general formulas (D-2) to (D-19):

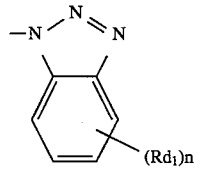
(D-2)

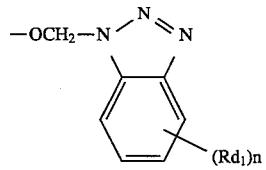
(D-3)

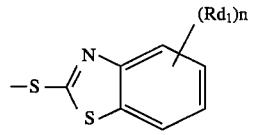
(D-4)

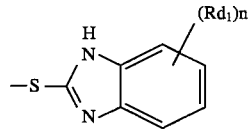
(D-5)

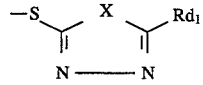
(D-6)

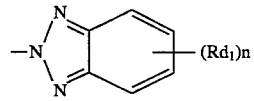
(D-7)

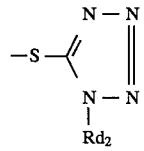
(D-8)

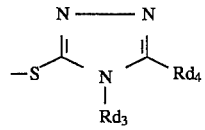
(D-9)

In the general formulas (D-2) to (D-7), $Rd_1$ denotes a hydrogen atom, a halogen atom, or a group such as alkyl, alkoxy, acylamino, alkoxycarbonyl, thiazolidinylidene-amino, aryloxycarbonyl, acyloxy, carbamoyl, N-alkylcarbamoyl, N,N-dialkylcarbamoyl, nitro, amino, N-arylcarbamoyloxy, sulfamoyl, N-alkylcarbamoyloxy, hydroxy, alkoxycarbnoylamino, alkylthio, arylthio, aryl, hetero ring, cyano, alkylsulfonyl or aryloxycarbonylamino; n is 0, 1 or 2, provided that when n=2, $Rd_1$ may be the same or different, and n $Rd_1$s contain a total of 0–10 carbon atoms. The number of carbon atoms in $Rd_1$ in the general formula (D-6) is 0–15.

In the general formula (D-6), X denotes an oxygen or sulfur atom.

In the general formula (D-8), $Rd_2$ denotes an alkyl group, an aryl group or a heterocyclic group.

In the general formula (D-9), $Rd_3$ denotes a hydrogen atom or a group selected from among an alkyl, a cycloalkyl, an aryl and a hereto ring; $Rd_4$ denotes a hydrogen atom, a halogen atom, or a group selected from among an alkyl, a cycloalkyl, an aryl, an acylamino, an alkoxycarbonylamino, an aryloxycarbonylamino, an alkanesulfonamido, a cyano, a hetero ring, an alkylthio and an amino.

When $Rd_1$, $Rd_2$, $Rd_3$ or $Rd_4$ denotes an alkyl group, it may have a substituent and may either be straight-chained or branched. When $Rd_1$, $Rd_2$, $Rd_3$ and $Rd_4$ denotes an aryl group, it may have a substituent.

When $Rd_1$, $Rd_2$, $Rd_3$ or $Rd_4$ denotes a heterocyclic group, It may have a substituent and is preferably exemplified by a 5- or 6-membered single or fused ring containing at least one of nitrogen, oxygen and sulfur atoms as a hetero atom; such heterocyclic group is selected from among pyridyl, quinolyl, furyl, benzothiazolyl, oxazolyl, imidazolyl, thiazolyl, triazolyl, benzotriazolyl, imide, oxazine, etc.

In the general formulas (D-6) and (D-8), $Rd_2$ contains 0–15 carbon atoms.

In the general formula (D-9), $Rd_3$ and $Rd_4$ contain a total of 0–15 carbon atoms.

- TIME - INHIBIT (D-10)

Where the group TIME that is bonded to the coupling site of A and which, upon reaction with the oxidation product of a color developing agent, is capable of cleavege from the coupler to release the group INHIBIT in an appropriately controlled amount; the group INHIBIT serves as a development inhibitor upon said release [INHIBIT may be represented by the general formulas (D-2) to (D-9)].

In the general formula (D-10), the group -TIME-INHIBIT is typically represented by the following general formulas (D-11) to (D-19):

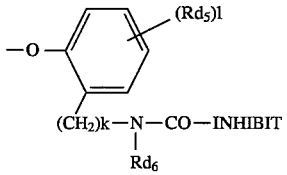
(D-11)

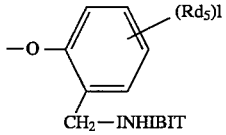
(D-12)

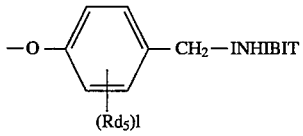
(D-13)

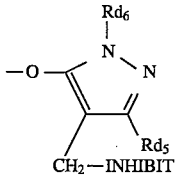
(D-14)

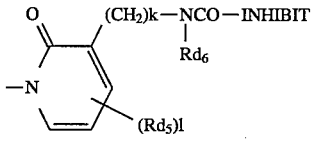
(D-15)

-continued

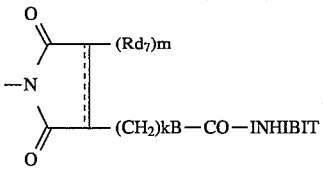
(D-16)

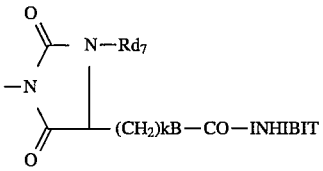
(D-17)

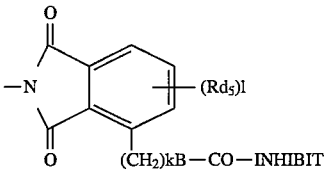
(D-18)

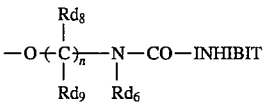
(D-19)

In the general-formulas (D-11) to (D-15) and (D-18), $Rd_5$ denotes a hydrogen atom, a halogen atom or a group selected from among alkyl, cycloalkyl, alkenyl, aralkyl, alkoxy, alkoxycarbonyl, anilino, acylamino, ureido, cyano, nitro, sulfonaamido, sulfamoyl, carbamoyl, aryl, carboxy, sulfo, hydroxy and alkanesulfonyl. In the general formulas (D-II) to (D-13), (D-15) and (D-18), $Rd_5$ may combine together to form a condensed ring. In general formulas (D-11), (D-14), (D-15) and (D-19), $Rd_6$ denotes a group selected from among alkyl, alkenyl, aralkyl, cycloalkyl, hetero ring and aryl. In the general formulas (D-16) and (D-17), $Rd_7$ denotes a hydrogen atom or a group selected from among alkyl, alkenyl, aralkyl, cycloalkyl, hetero ring and aryl. In the general formula (D-19), $Rd_8$ and $Rd_9$ each denotes a hydrogen atom or an alkyl group (preferably containing 1–4 carbon atoms). In the general formulas (D-11) and (D-15) to (D-18), k is an integer or 0, 1 or 2. In the general formulas (D-11) to (D-13), (D-15) and (D-18), l is an integer of 1–4. In the general formula (D-16), m is an integer or 1 or 2, provided that when m=2, $Rd_7$ may be the same or different. In the general formula (D-19), n is an integer or 2–4, and n $Rd_8$ and $Rd_9$ may be the same or different. In the general formulas (D-16) to (I)-18), B denotes an oxygen atom or

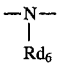

($Rd_6$ has the same meaning as already defined above). In the general formula (D-16), --- may be a simple bond or a double dond; in the case of a simple bond, m is 2, and in the case of a double bond, m is 1. group The INHIBIT in the general formulas (D-11) to (D-19) has the same meaning as already defined in the general formulas (D-2) to (D-9) except for the number of carbon atoms.

As regards the group INHIBIT, the total number of carbon atoms in $R_1$ in one molecule for the general formulas (D-2) to (D-7) is 0–32; the total number of carbon atoms in $Rd_2$ in the general formula (D-8) is 1–32; and the total number of carbon atoms in $Rd_3$ and $Rd_4$ in the general formula (D-9) is 0–32.

When $Rd_5$, $Rd_6$ and $Rd_7$ each denotes an alkyl group, an aryl group or a cyloalkyl group, such groups may optionally have substituents.

Preferred examples of the diffusible DIR compound are such that Y is represented by the general formula (D-2), (D-8), (D-6), (D-8) or (D-10). Among the examples of (D-10), those which are represented by (D-13) or (D-14) or those in which INHIBIT is represented by the general formula (D-2) or (D-6) (particularly in the case where X in (D-6) is an oxygen atom) or (D-8) (particularly in the case where $Rd_2$ in (D-8) is a hydroxylaryl group or an alkyl group having 1–3 carbon atoms) are preferred.

Examples of the coupler component represented by A in the general formula (D-1) include a yellow color image forming coupler residue, a magenta color image forming coupler residue, a cyan color image forming coupler residue, or a colorless coupler residue.

The following are non-limiting examples of the diffusible DIR coupler that is preferably used in the present invention.

Illustrative compounds

D-1

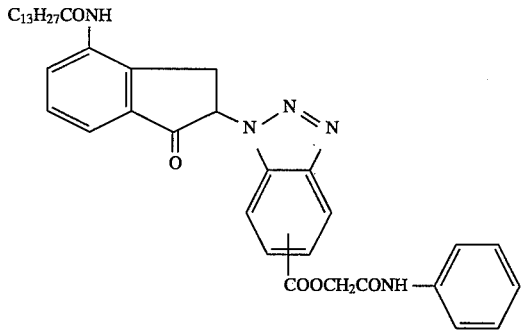

| Compound No. | $R_1$ | $R_2$ | Y |
|---|---|---|---|
| | $R_1—COCHCO—R_2$ (Y) | | |
| D-2 | (1) | (1) | (30) |
| D-3 | (2) | (3) | (30) |
| D-4 | (2) | (4) | (30) |
| D-5 | (5) | (6) | (31) |
| D-6 | (2) | (4) | (32) |
| D-7 | (2) | (3) | (32) |
| D-8 | (7) | (8) | (33) |
| D-33 | (2) | (4) | (55) |
| | 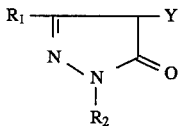 | | |
| D-9 | (9) | (10) | (30) |
| D-10 | (11) | (10) | (30) |
| D-11 | (12) | (7) | (34) |
| D-12 | (12) | (13) | (35) |
| D-13 | (9) | (14) | (36) |
| D-14 | (15) | (16) | (37) |
| | 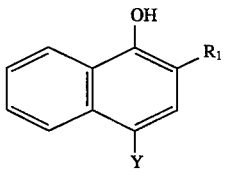 | | |

-continued

Illustrative compounds

| | | |
|---|---|---|
| D-15 | (17) | (38) |
| D-16 | (17) | (39) |
| D-17 | (18) | (40) |
| D-18 | (19) | (41) |
| D-19 | (18) | (42) |
| D-20 | (18) | (43) |
| D-21 | (18) | (44) |
| D-22 | (18) | (45) |
| D-23 | (18) | (46) |
| D-24 | (20) | (47) |
| D-25 | (18) | (48) |
| D-26 | (21) | (49) |
| D-27 | (21) | (50) |
| D-28 | (21) | (51) |
| D-29 | (22) | (52) |
| D-30 | (18) | (53) |
| D-31 | (18) | (54) |
| D-32 | (22) | (49) |

1

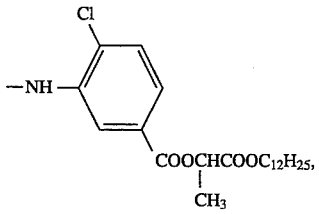

2

$—C(CH_3)_3$,

3

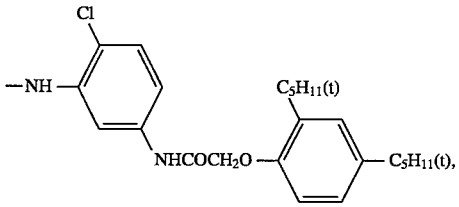

4

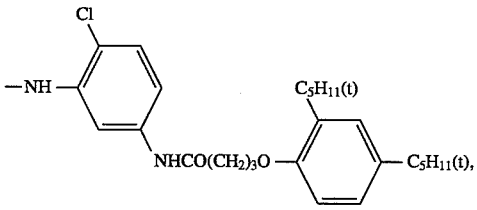

5

$—OCH_3$,

6

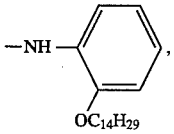

7

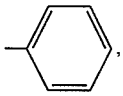

Illustrative compounds
8
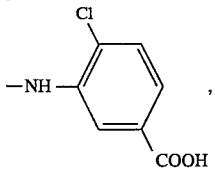
9
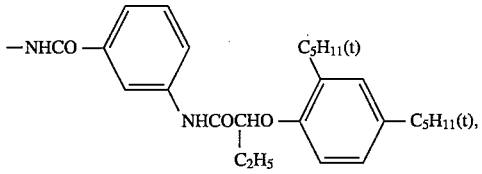
10
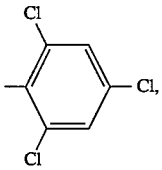
11
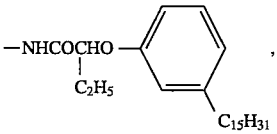
12
$-C_{17}H_{35}$,
13
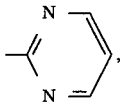
14
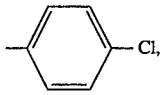
15
$-CH_3$,
16
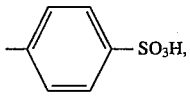
17
$-CONHC_{18}H_{37}$,
18
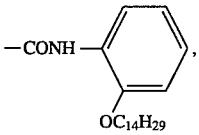
Illustrative compounds
19
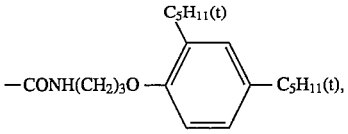
20
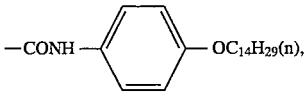
21
$-CONHCH_2CH_2COOH$
22
$-CONHCH_2CH_2COOCH_3$
30
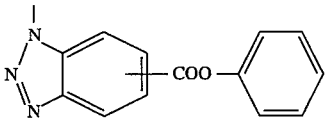
31
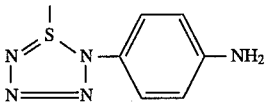
32
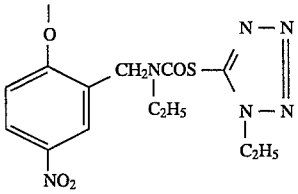
33
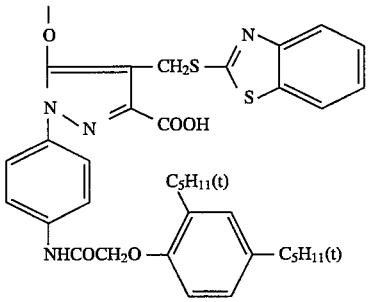
34
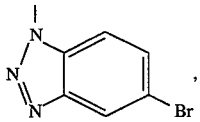
35
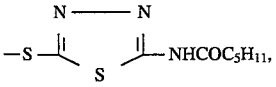

Illustrative compounds
36
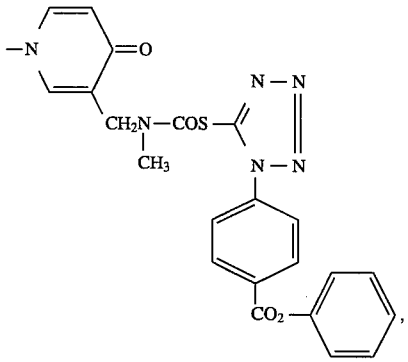
37
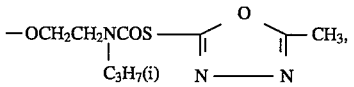
38
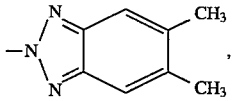
39
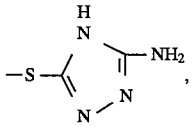
40
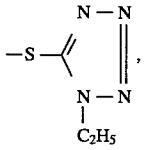
41
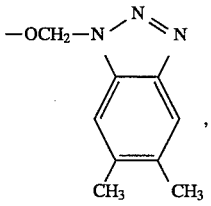
42
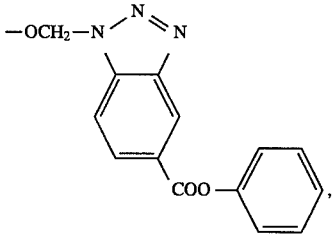
Illustrative compounds
43
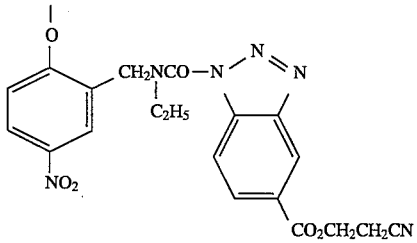
44
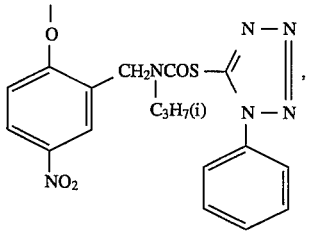
45
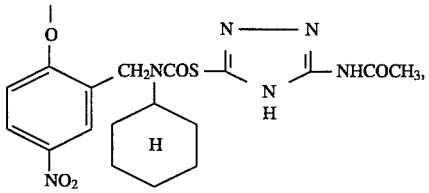
46
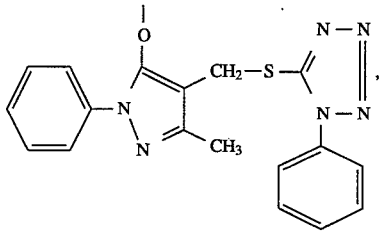
47
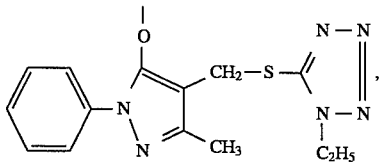
48
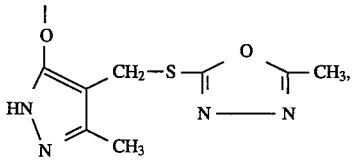

Illustrative compounds

49

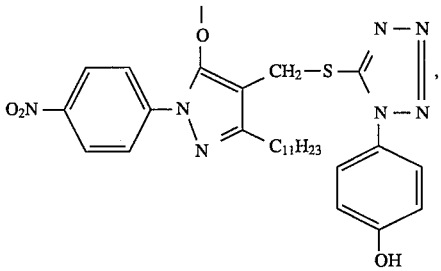

50

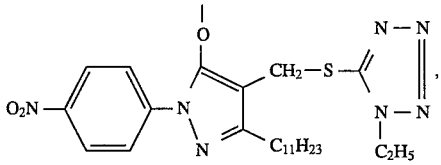

51

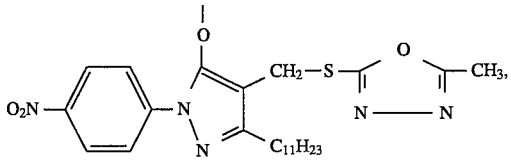

52

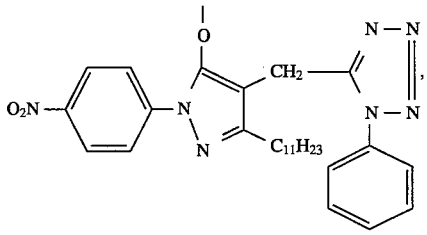

53

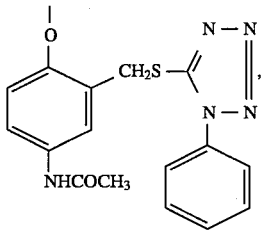

54

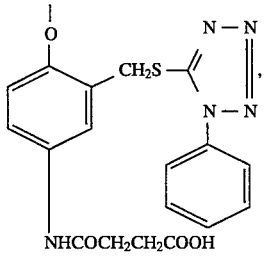

Illustrative compounds

55

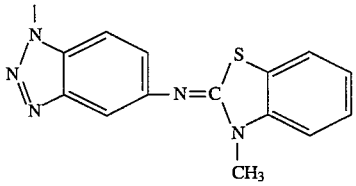

These and other specific examples of diffusible DIR compounds that can be used in the present invention are described in U.S. Pat. Nos. 4,234,678, 3,227,554, 3,617,291, 3,958,993, 4,149,886, 3,933,500, Unexamined Published Japanese Patent Application Nos. 56837/1982, 13239/1976, U.S. Pat. Nos. 2,072,363 and 2,070,266, and Research Disclosure No. 21228, December 1981.

The diffusible DIR compounds are preferably used in amounts of 0.0001–0.1 mole per mole of silver halide, with the range of 0.001–0.05 moles being particularly preferred.

A DSR coupler that is preferably used in the present invention means a coupler that, upon reaction with the oxidation product of a developing agent, is capable of releasing either a compound that has the ability to scavenge said oxidation product or a precursor of said compound. Such a DSR coupler may be represented by the following general formula(S):

$$\text{Coup}\text{-}(\text{Time})_l\text{-Sc} \qquad \text{(S)}$$

where Coup denotes a coupler residue which, upon reaction with the oxidation product of a color developing agent, is capable of releasing $$\text{-}(\text{Time})_l\text{-Sc};$$

Time denotes a timing group capable of releasing Sc after Time-Sc is released from Coup; Sc denotes a scavenger or the oxidation product of a color developing agent which, after being released from Coup or Time-Sc, is capable of scavenging said oxidation product by a redox reaction or a coupling reaction; and l is 0 or 1.

The compound represented by the general formula (S) is described below in greater detail. The coupler residue denoted by Coup is typically a yellow coupler residue, a magenta coupler residue, a cyan coupler residue or a coupler residue that is substantially incapable of producing an image forming color dye, and Coup is preferably a coupler residue that is represented by the following general formulas (Sa) to (Sh):

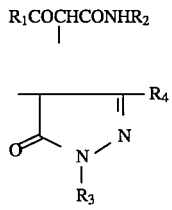

[Sa]

[Sb]

-continued

[Sc]

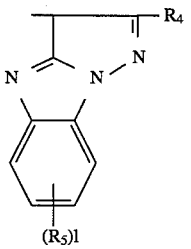

[Sd]

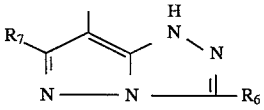

[Se]

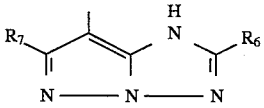

[Sf]

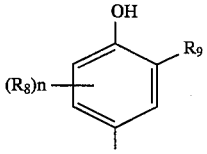

[Sg]

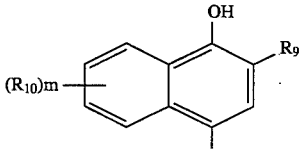

[Sh]

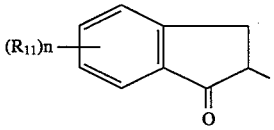

In the general formula (Sa), $R_1$ is an alkyl group, an aryl group or an arylamino group, and $R_2$ is an aryl group or an alkyl group.

In the general Formula (Sb), $R_3$ is an alkyl group or an aryl group, and $R_4$ is an alkyl group, an acylamino group, an arylamino group, an arylureido group or an alkylureido group.

In the general Formula (Sc), $R_4$ has the same meaning as $R_4$ in the general formula (Sb), and $R_5$ is an acyl amino group, a sulfonamido group, an alkyl group, an alkoxy group or a halogen atom.

In the general formulas (Sd) and (Se), $R_7$ Is an alkyl group, an aryl group, an acylamino group, an arylamino group, an alkoxy group, an arylureido group, or an alkylureido group, and $R_6$ is an alkyl or aryl group.

In the general formula (Sf), $R_9$ is an acylamino group, a carbamoyl group or an arylureido group, and $R_8$ is a halogen atom, an alkyl group, an alkoxy group, an acylamino group or a sulfonamido group.

In the general formula (Sg), $R_9$ has the same meaning as defined for the general Formula (Sf), and $R_{10}$ is an amino group, a carbonylamido group, a sulfonamido group or a hydroxyl group.

In the general formula (Sh), $R_{11}$ is a nitro group, an acylamino group, a succinimido group, a sulfonamido group, an alkoxy group, an alkyl group, a halogen atom or a cyano group.

In the general Formula (Sc), l is an integer of 0–3; in the general formulas (Sf) and (Sh), n is an integer of 0– 2; and in the general formula (Sg), m is an integer of 0 or 1; when l and n are each 2 or more, $R_5$, $R_8$ or $R_{11}$ may be the same or different.

The groups $R_1$–$R_{11}$ may optionally have substituents and preferred substituents include: a halogen atom, a nitro group, a cyano group, a sulfonamido group, a hydroxyl group, a carboxyl group, an alkyl group, an alkoxy group, a carbonyloxy group, an acylamino group, and an aryl group, as well as those which contain a coupler portion of "bis type couplers" and polymer couplers.

The oleophilicity of the groups $R_1$–$R_{11}$ in the general formulas (Sa)-(Sh) may be properly selected according to the specific object. In the case of ordinary image forming couplers, the total number of carbon atoms in $R_1$–$R_{10}$ is preferably in the range of from 10 to 60, with the range of 15–30 being more preferred. In the case where the dye produced by color development is to be adapted to migrate by a suitable degree through the photographic material, the total number of carbon atoms in $R_1$–$R_{10}$ is preferably no more than 15.

The term "coupler that is substantially incapable of producing an image forming color dye" means not only couplers that do not produce a color dye but also those couplers which leave no color image behind after development such as "flowable dye forming couplers" which permit color dyes to flow out of the photographic material into processing solutions and "bleachable dye forming couplers" which are bleached upon reaction with components in the processing solutions. In the case of flowable dye forming couplers, the total number of carbon atoms in $R_1$–$R_{10}$ is preferably no more than 15, and it is also prefered that $R_1$–$R_{10}$ have at least one substitute selected from among a carboxyl group, an arylsulfonamido group and an alkylsulfonamido group.

Among the coupler residues described above, those which are represented by the general formulas (Sa) and (Sg) are preferred.

The timing group represented by Time in the general formula (S) is preferably represented by the following general formula (Si), (Sj) or (Sk):

(Si)

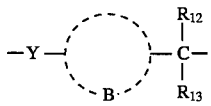

where B denotes the atomic group necessary to complete a benzene ring or a naphthalene ring; Y is

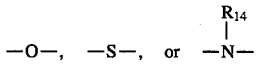

and bonded to the active point of Coup (coupling component) in the general formula (S); $R_{12}$, $R_{13}$ and $R_{14}$ are each a hydrogen atom, an alkyl group or an aryl group; the group

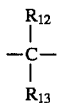

is substituted in the position ortho or para to Y and the bond which is not attached to Y is attached to Sc in the general formula (S);

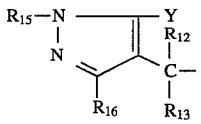

(Sj)

where Y, $R_{12}$ and $R_{13}$ each has the same meaning as defined for the general formula (Si); $R_{15}$ is a hydrogen atom, an alkyl group, an aryl group, an acyl group, a sulfone group, an alkoxycarbonyl group or a heterocyclic residue; $R_{16}$ is a hydrogen atom, an alkyl group, an aryl group, a heterocyclic residue, an alkoxy group, an amino group, an acid amido group, a sulfonamido group, a carboxy group, an alkoxycarbonyl group, a carbamoyl group or a cyano group.

The timing group represented by the general formula (Sj) is such that as in the general formula (Si), Y is bonded to the active point of Coup (coupling component) in the general formula (S) whereas

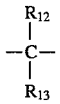

is bonded to Sc.

The group Time that releases Sc upon intramolecular nucelophilic reaction may be represented by the following general formula (Sk):

—Nu—D—E (Sk)

where Nu denotes a nucleophilic group having an electron-rich atom such as an oxygen, sulfur or nitrogen atom and is bonded to the active point or Coup (coupling component) in the general formula (S); E denotes an electrophilic group having an electron-lean group such as a carbonyl, thiocarbonyl, phosphinyl or thiophosphinyl group; the electrophilic group E is bonded to the hetero atom in Sc; and D which relates Nu and E sterically denotes a bonding group that, after Nu is released from Coup (coupling component), is capable of destroying the intramolecular nucloophilic substitution by a reaction involving the formation of a 3- to 7-membered ring, whereby Sy is released.

The scavenger Sc of the oxidation product of a color developing agent Is either of a redox type or of a coupling type.

In the case where Sc in the general formula (S) is of a type that scavenges the oxidation product of a color developing agent by a redox reaction, said Sc is a group capable of reducing the oxidation product of a color developing agent. Preferred examples of such Sc are reducing agents of the type described in Angew. Chem.

Int. Ed., 17, 875–886 (1978) , T. H. James, ed.," The Theory of the Photographic Process", 4th ed., Macmillan, 1977, Chapter 11, and Unexamined Published Japanese Patent Application No. 5247/1984. Alternatively, Sc may be a precursor that is capable of releasing such reducing agents during development. Specific preferred examples of such precursor Sc are an aryl group and a heterocyclic group that have at least two groups selected from among a group —OH, a group —$NHSO_2R$, a group

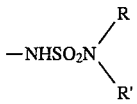

and a group

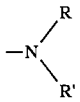

(where R and R are each a hydrogen atom, an alkyl group, a cycloalkyl group, an alkenyl group or an aryl group), with the aryl group being more preferred. A phenyl group is particularly preferred. As in the case of the couplers represented by the general formulas (Sa) to (Sh), the oleophilicity of Sc may be properly selected according to the specific object. In order to attain the intended advantages of the present invention to the fullest extent, the total number of carbon atoms in Sc typically ranges from 6 to 50, preferably from 6 to 30, more preferably from 6 to 20.

In the case where Sc Is of a type that scavenges the oxidation product of a color developing agent by a coupling reaction, said Sc can be of various coupler residues. Preferably, Sc is a coupler residue that is substantially incapable of producing an image forming color dye and in this case, the already-described flowable dye forming coupler, the bleachable dye forming coupler, a Weiss coupler which has a non-leaving substitute in the reaetive point and which does not form a dye, and other suitable couplers can be used.

Specific examples of the compound represented by the general formula (S)

Coup$\leftarrow$Time$\rightarrow_{\gamma}$Sc are described in many prior patents including British Patent No. 1,546,837, Unexamined Published Japanese Patent Application Nos. 150631/1977, 111536.1982, 111537/1982, 138636/1982, 185950/1985, 203943/1985, 213944/1985, 214358/1985, 53643/1986, 84646/1986, 86751/1986, 102646/1986, 102647/1986, 107245/1986, 113060/1986, 231553/1986, 233471/1986, 236550/1986, 236551/1986, 238057/1986, 240240/1986, 249052/1986, 81638/1987, 205346/1987 and 287249/1987.

Scavengers of redox type are preferably used as Sc and, in this case, the oxidation product of a color developing agent may be reduced so that the color developing agent can be put to another use.

The DSR compound represented by the general formula (S) may be exemplified by, but not limited to, the following compounds.

Illustrative compounds
DSR-1
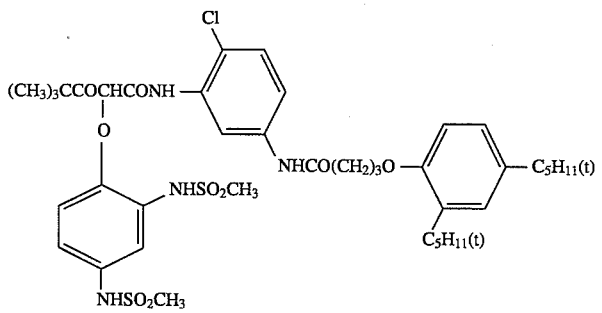
DSR-2
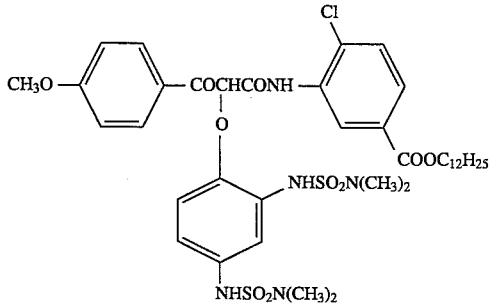
DSR-3
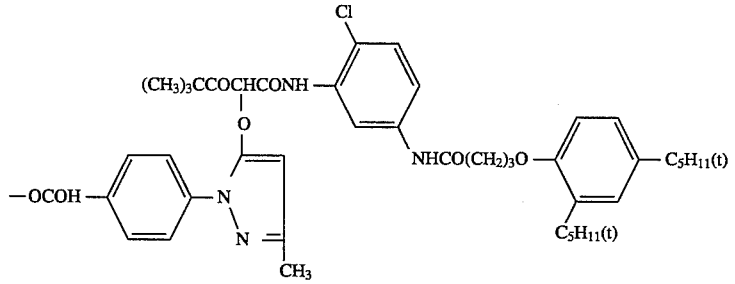
DSR-4
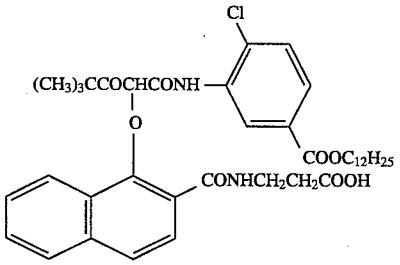
DSR-5
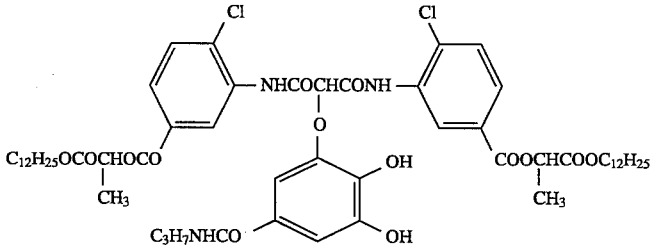

-continued
Illustrative compounds
DSR-6
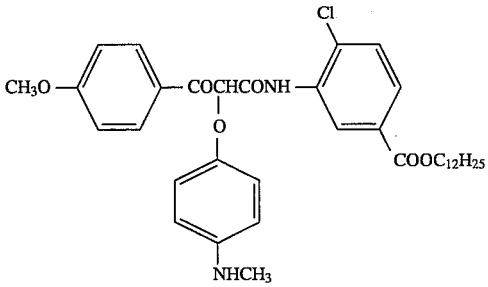
DSR-7
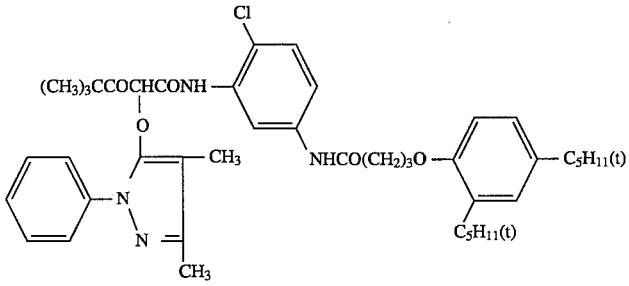
DSR-8
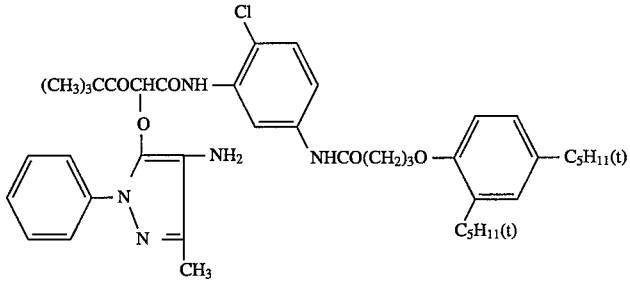
DSR-9
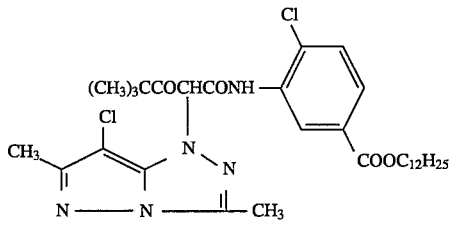
DSR-10
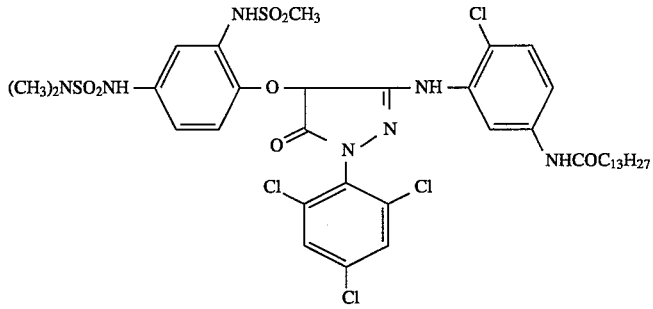

-continued
Illustrative compounds
DSR-11
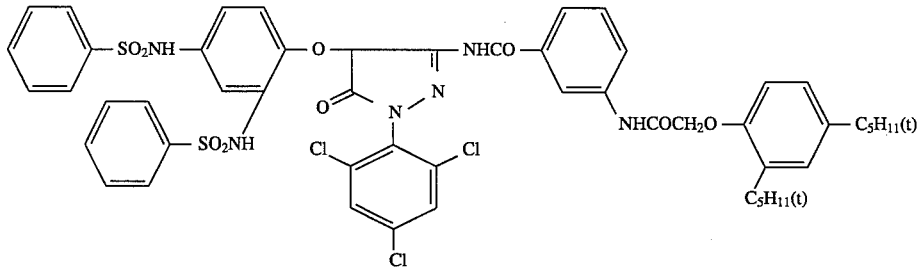
DSR-12
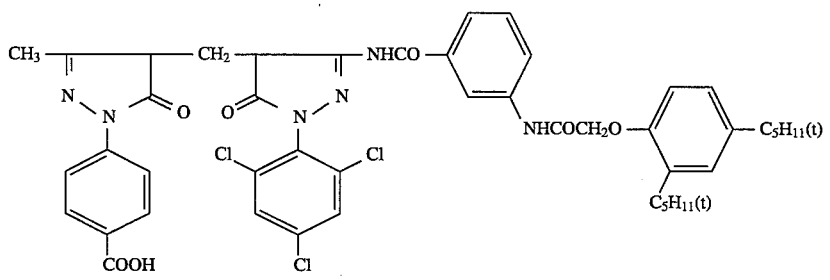
DSR-13
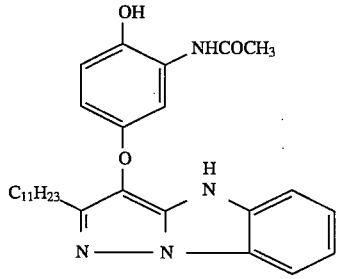
DSR-14
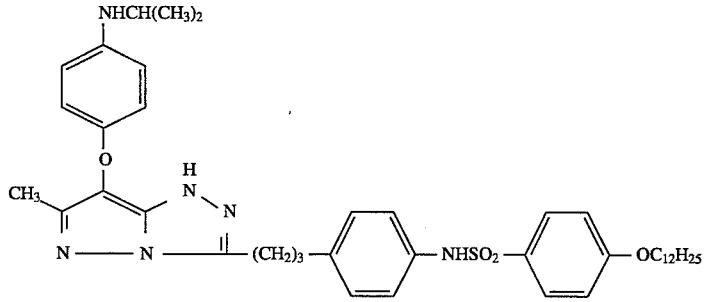
DSR-15
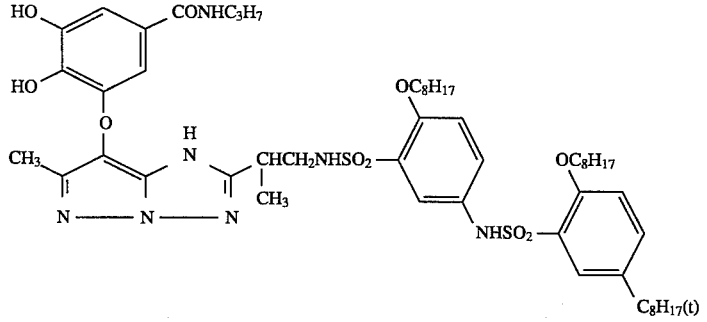

-continued
Illustrative compounds
DSR-16
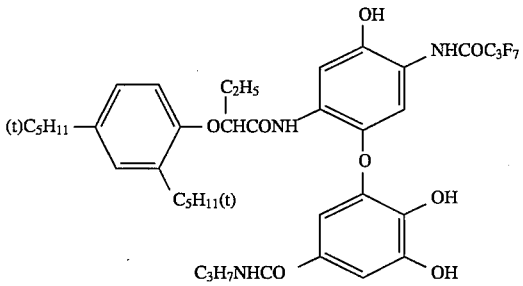
DSR-17
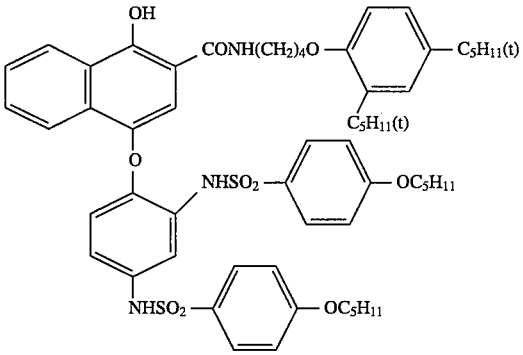
DSR-18
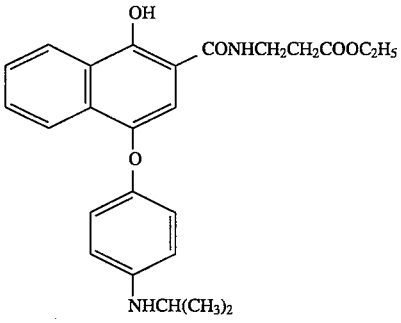
DSR-19
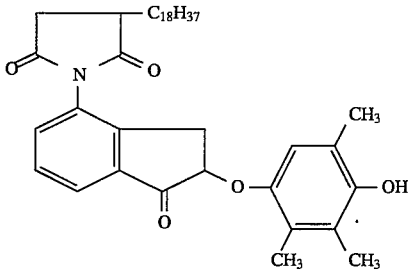
DSR-20
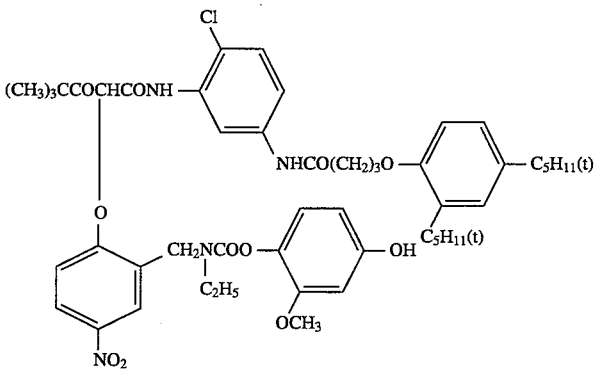

-continued
Illustrative compounds
DSR-21
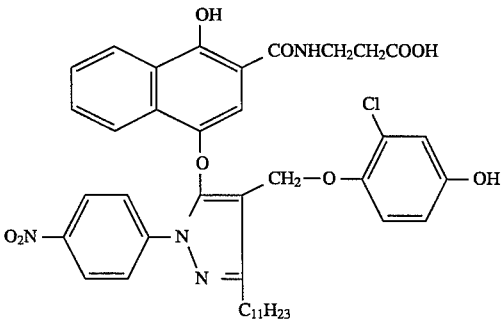
DSR-22
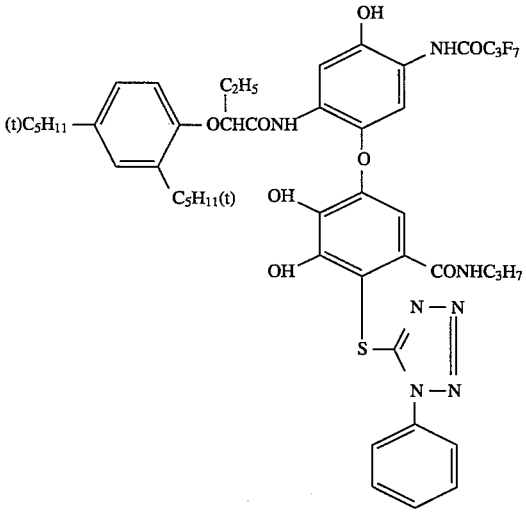
DSR-23
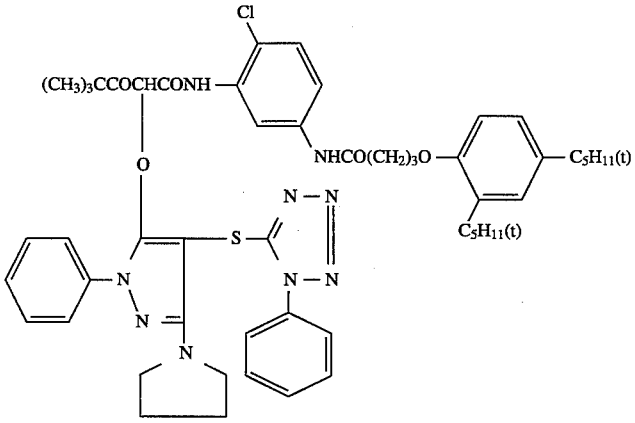
DSR-24
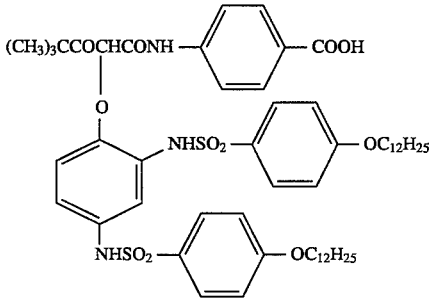

-continued
Illustrative compounds
DSR-25
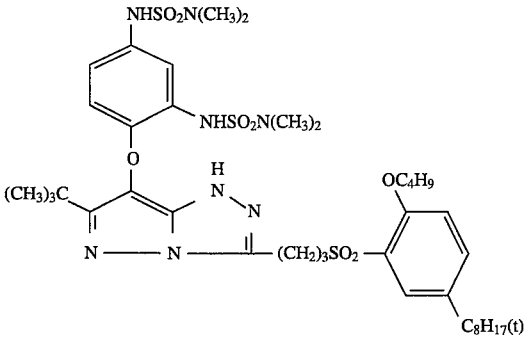
DSR-26
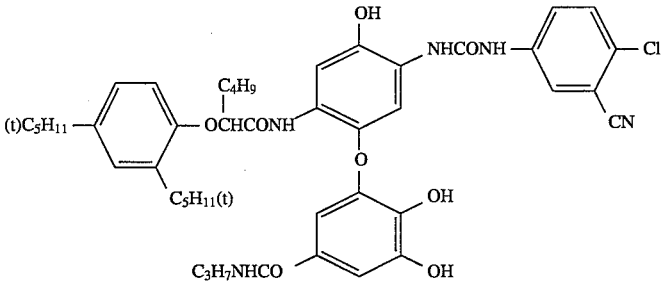
DSR-27
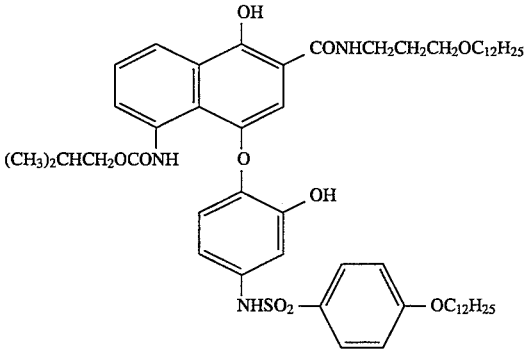
DSR-28
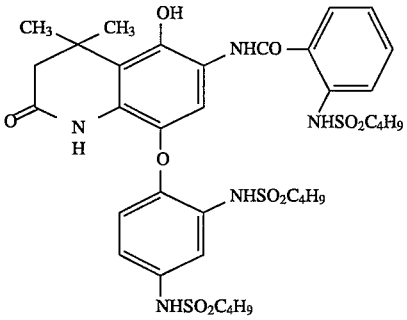

-continued
Illustrative compounds
DSR-29
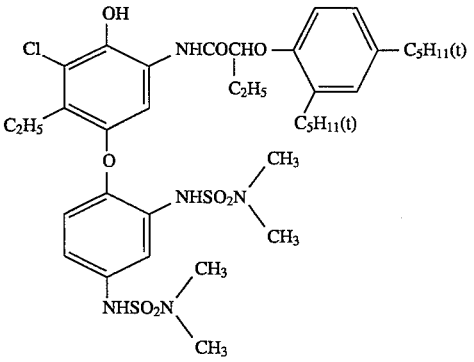
DSR-30
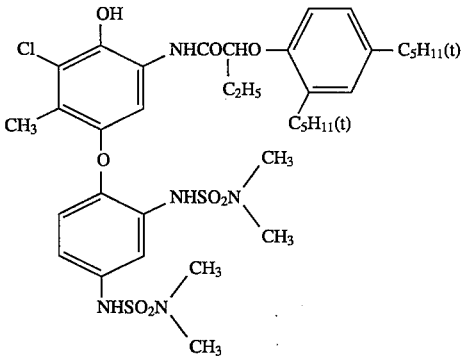
DSR-31
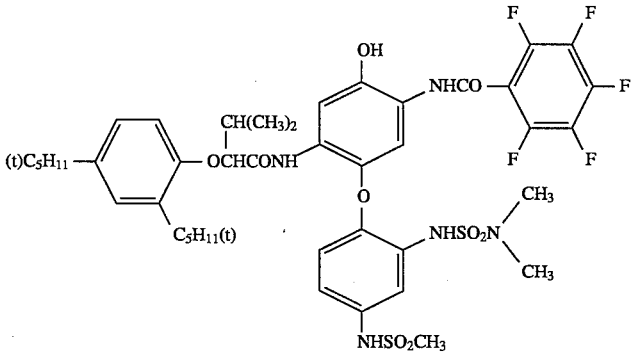
DSR-32
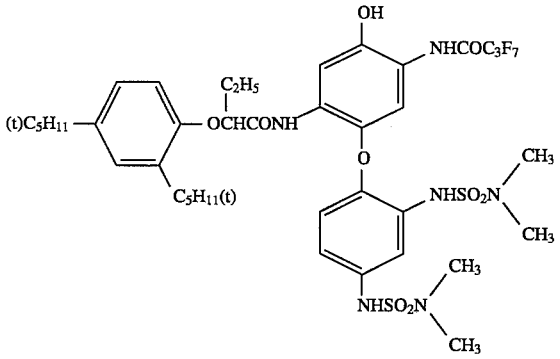

-continued
Illustrative compounds
DSR-33
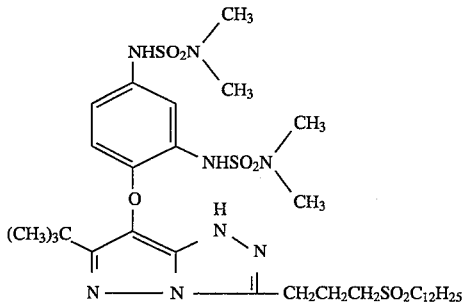
DSR-34
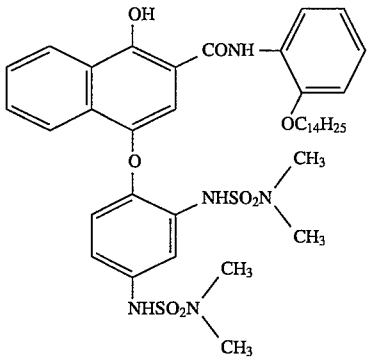
DSR-35
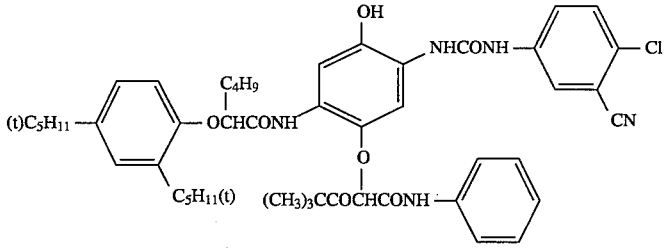
DSR-36
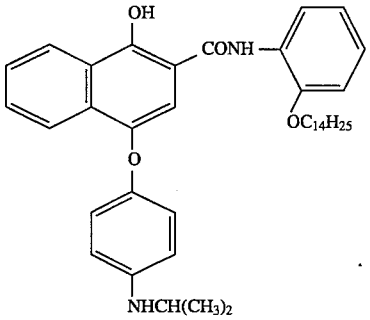
DSR-37
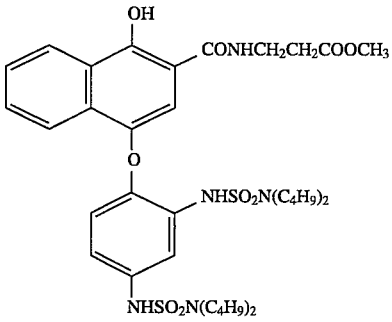

-continued

Illustrative compounds

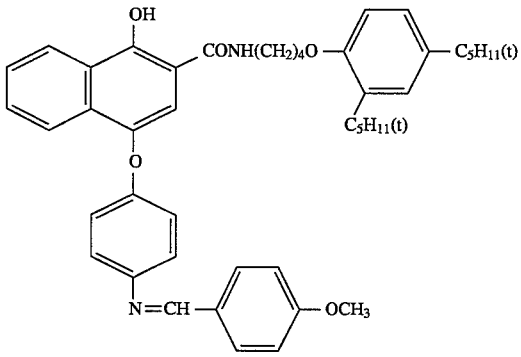

DSR-38

The DSR compound to be used in the present invention may be incorporated in a light-sensitive silver halide emulsion layer and/or a non-light-sensitive photographic constituent layer. Preferably, the DSR compound is incorporated in a light-sensitive silver halide emulsion layer.

Two or more DSR compounds may be incorporated in the same layer. Alternatively, the same DSR compound may be incorporated in two or more different layers.

The DSR compound is preferably used in an amount of from $2\times10^{-4}$ to $5\times10^{-1}$ moles, more preferably from $1\times10^{-2}$ to $2\times10^{-1}$ moles, per mole of silver in an emulsion layer.

If the yellow, magenta or/cyan coupler that are described hereinabove is to be used in combination with the DSR coupler, the latter is preferably used in an amount of 0.01–100 moles, more preferably 0.03–10 moles, per mole of the yellow, magenta or cyan coupler.

The various types of couplers described above may be added by any method as long as they are eventually incorporated in a photographic material of interest in the form a solution in high-boiling organic solvents. A common method of addition is as follows: the coupler is dissolved in a water-immiscible high-boiling organic solvent having a boiling point of at least 150° C., optionally in combination with a low-boiling organic solvent and/or a water-soluble organic solvent; then, the resulting solution is mixed with an aqueous gelatin solution containing a surfactant; subsequently, the mixture is emulsified with a suitable device such as a high-speed rotary mixer or a colloid mill; finally, the resulting emulsion is added to a hydrophilic colloid such as a silver halide emulsion.

Illustrative high-boiling organic solvents include phenolic derivatives, alkyl phthalate esters, phosphate esters, citrate esters, benzoate esters, alkylamides, aliphatic acid esters and trimesic acid esters and other organic solvents that will not react with the oxidation product of a developing agent and which have boiling points not lower than 150° C. Particularly preferred are those which boil at 170° C. and above.

Details of these high-boiling organic solvents are found in many prior patents including H.S. Patent Nos. 2,322,027, 2,533,514, 2,835,579, 3,287,134, 2,353,262, 2,852,383, 3,554,755, 3,676,137, 3,676,142, 3,700,454, 3,748,141, 3,779,765, 3,837,863, British Patent Nos. 958,441, 1,222, 753, OLS 2,538,889, Unexamined Published Japanese Patent Application Nos. 1031/1972, 90523/1974, 23823/1975, 26037/1976, 27921/1976, 27922/1976, 26035/1976, 26036/1976, 62632/1975, 1520/1978, 1521/1978, 15127/1978, 119921/1979, 119922/1979, 25057/1980, 36869/1980, 19049/1981, 81836/1981 and Examined Japanese Patent Publication No. 29060/1973.

Examples of the low-boiling organic solvent and/or water-soluble organic solvents that may be used in combination with high-boiling organic solvents include those which are described in U.S. Pat. Nos. 2,801,171, 2,949,360, etc. Examples of low-boiling organic solvents that are substantially insoluble in water include ethyl acetate, propyl acetate, butyl acetate, butanol, chloroform, carbon tetrachloride, nitromethane, nitroethane, benzene, etc. Illustrative water-soluble organic solvents include acetone, methyl isobutyl ketone, β-ethoxyetyl acetate, methoxy glycol acetate, methanol, ethanol, acetonitrile, dioxane, dimethylformamide, dimethyl sulfoxide, hexamethylphosphoriamide, diethylene glycol monophenyl ethar, phenoxyethanol, etc.

Surfactants that are preferably used as dispersion aids for the couplers include: anionic surfactants such as alkylbenzenesulfonic acid salts, alkylnaphthalenesulfonic acid salts, alkylsulfonic acid salts, alkylsulfuric acid esters, alkylphosphoric acid esters, sulfosuccinic acid esters, and sulfoalkylpolyoxyethylene alkylphenyl ethers; nonionic surfactants such as steroid type saponin, alkylene oxide derivatives and glycidol derivatives; amphoteric surfactants such as amino acids, aminoalkylsulfonic acids and alkylbetaines; and cationic surfactants such as quaternary ammonium salts. Specific examples of these surfactants are described in "Kaimen Kasseizai Binran (Handbook of Surfactants)" Sangyo Tosho, 1966, and "Nyukazai, Nyukasochi Kenkyu, Gijutsu Detashu (Technical Data on the Study of Emulsifiers and Emulsifying Apparatus)", Kagaku Hanronsha, 1978.

An emulsion as a component of the photographic material of the present invention, in particular, an emulsion containing silver halide grains, preferably uses a compound that in capable of releasing a bleach accelerator or a precursor thereof upon reaction with the oxidation product of a color developing agent (such "bleach accelerator releasing compound" is hereinafter referred as a "BAR compound"). An example of such BAR compound is described in Unexamined Published Japanese Patent Application No. 201247/1986. The present inventors unexpectedly found that when a BAR compound was used in an emulsion containing the silver halide grains of the type specified herein, development inhibition, particularly due to dyes, could be effectively prevented to accomplish accelerated development.

A preferred BAR compound is represented by the following general formula (BAR-I):

$$A\text{-}\overset{\overset{\displaystyle O}{\|}}{C}\text{-}(TIME)_m\text{-}BA \qquad \text{(BAR-I)}$$

where A denotes a coupler residue capable of coupling reaction with the oxidation product of a color developing agent, or a redox primary nuclear residue capable of cross-oxidation with the oxidation product of a color developing agent; TIME denotes a timing group; BA denotes a bleach accelerator or a precursor thereof; m is 0 or 1; when A is a coupler residue, l is 0, and when A is a redox primary nuclear residue, l is 0 or 1.

Particularly preferred examples of the BAR compound represented by the general formula (BAR-I) are those which are represented by the following general formulas (BAR-II) and (BAR-III):

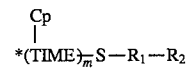

(BAR-II)

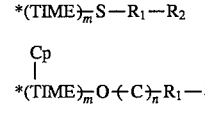

(BAR-III)

where Cp denotes a coupler residue capable of coupling reaction with the oxidation product of a color developing agent; * denotes a coupling site for the coupler; TIME denotes a timing group; $R_1$ denotes an aliphatic group, an aromatic group, a saturated heterocyclic group, or a 5- or 6-membered nitrogenous aromatic heterocyclic group; $R_2$ denotes a water-soluble substituent or a precusor thereof; $R_3$ denotes a hydrogen atom, a cyano group, —$COR_4$

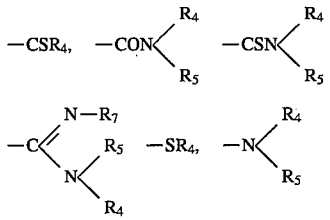

or a heterocyclic group (where $R_4$ is an aliphatic or aromatic group; $R_5$, $R_6$ and $R_7$ are each a hydrogen atom, an aliphatic group or an aromatic group); and m and n are each 0 or 1.

Examples of the coupler residue denoted by Cp include a residue that forms a yellow, a magenta or a cyan dye, and a dye that forms a substantially colorless product.

Typical examples of the yellow coupler residue denoted by Cp are described in such references as U.S. Pat. Nos. 2,298,443, 2,407,210, 2,875,057, 3,048,194, 3,265,506, 3,447,928, and Farbkuppler eine Literaturuversiecht Agfa Mitteilung (Band II), 112–126, 1961. Preferred are acylacetanilides such as benzoylacetanilides and pivaloylacetanilides.

Typical examples of the magenta coupler residue denoted by Cp are described in such references as U.S. Pat. Nos. 2,369,489, 2,343,703, 2,311,182, 2,600,788, 2,908,573, 3,062,653, 3,152,986, 3,519,429, 3,725,067, 4,540,654, Unexamined Published Japanese Patent Application No. 162548/1984, and Agfa Mitteilung, spura, 126–156 (1961). Preferred are pyrazolones and pyrazoloazoles (e.g. pyrazoloimidazole and pyrazolotriazole).

Typical examples of the cyan coupler residue denoted by Cp are described in such references as U.S. Pat. Nos. 2,367,531, 2,423,730, 2,474,293, 2,772,162, 2,395,826, 3,002,836, 3,034,892, 3,041,236, 4,666,999 and Agfa Mitteilung, supra, 156–175 (1961). Preferred are phenols and naphthols.

Typical examples of the coupler that forms a substantially colorless product are described in such prior patents as British Patent No. 861,138, U.S. Pat. Nos. 3,632,345, 3,928,041, 3,958,993 arid 3,961,959. Preferred are cyclic carbonyl compounds.

The timing group denoted by TIME is a group that enables a bleach accelerator or a precursor thereof (BA) to be released from Cp in a time-controlled manner. This group may contain groups that are capable of controlling the rate of reaction between Cp and the oxidation product of a color developing agent, the rate of diffusion of -TIME-BA released from Cp, and the rate of release of BA.

The following known timing groups may be mentioned as typical examples of TIME; in the following description, (*) denotes the site of binding to the active point of cp, and (*)(*) denote the site of binding to -S-$R_1$-$R_2$ or

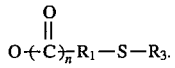

(1) a group that causes a cleavage reaction by making use of an electron transfer reaction along a conjugate system:

Examples of such group are described in Unexamined Published Japanese Patent Application Nos. 114946/1981, 154234/1982, 188035/1982, 98728/1983, 160954/1983, 162949/1983, 209736/1983, 209737/1983, 209738/1983, 209739/1983, 209740/1983, 86361/1987 and 87958/1987.

Among these groups, those which are represented by the following general formulas (TIME-I) and (TIME-II) are preferred:

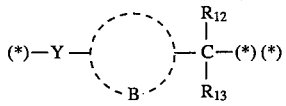

(TIME-I)

where B denotes the atomic group necessary to complete a benzene or naphthalene ring; Y is —O—, —S— or —N— or

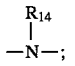

$R_{12}$, $R_{13}$ and $R_{14}$ are each a hydrogen atom, an alkyl group or an aryl group;

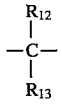

is substituted in the position ortho or para to Y;

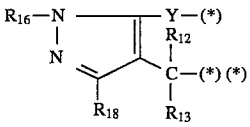

(TIME-II)

where Y, $R_{12}$ and $R_{13}$ have the same meanings as defined for the general formula (TIME-X); $R_{18}$ is a hydrogen atom, an alkyl group, an aryl group, an acyl group, a sulfone group, an alkoxycarbonyl group or a heterocyclic residue; $R_{16}$ is a hydrogen atom, an alkyl group, an aryl group, a heterocyclic residue, an alkoxy group, an amino group, an acylamino group, a sulfonamido group, a carboxy group, an alkoxycarbonyl group, a carbamoyl group or a cyano group.

(2) a group that causes a cleavage reaction by making use of an intramolecular nucleophilic substitution reaction:

Examples of such group are described in U.S. Pat. No. 4,248,962 and Unexamined Published Japanese Patent Application No. 56837/1982. Among these groups, those which are represented by the following general formulas (TIME-III), (TIME-IV) and (TIME-V) are preferred:

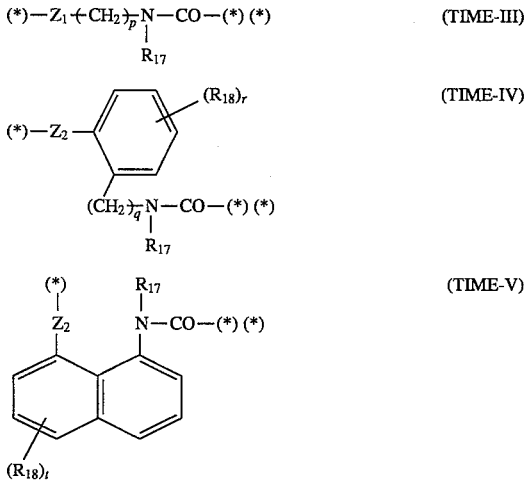

(TIME-III)

(TIME-IV)

(TIME-V)

where $Z_1$ denotes (*)—O—, (*)—O—CO, $(*)-O-\underset{\underset{R_{19}}{|}}{CON}-$, $(*)-S-$, $(*)-\underset{\underset{R_{19}}{|}}{N}-SO_2-$ $(*)-\underset{\underset{R_{19}}{|}}{N}-CO-$, $(*)-O-\underset{\underset{R_{19}}{|}}{N}SO_2-$, $(*)-\underset{\underset{SO_2R_{19}}{|}}{N}-$, $(*)-\underset{\underset{COR_{19}}{|}}{N}-$, $(*)-OCOO-$, $(*)-OCO-S-$, or $(*)-O-\underset{\underset{R_{19}}{|}}{N}-CO-$;

$Z_2$ denotes (*)—O—, (*)—O—$CH_2$—, (*)—O—CO—, $(*)-S-$, $(*)-\underset{\underset{SO_2R_{19}}{|}}{N}-$ or $(*)-\underset{\underset{COR_{19}}{|}}{N}-$ (where $R_{19}$ is a hydrogen atom, an alkyl group, an aryl group or a heterocyclic group); $R_{17}$ is a hydrogen atom, an alkyl group or an aryl group; $R_{18}$ is a hydrogen atom, an alkyl group, an aryl group, a heterocyclic group, $-O-R_{20}$, $-S-R_{20}$, $-OCO-R_{20}$, $-OSO_2R_{20}$, $-N\begin{matrix}R_{20}\\R_{20}\end{matrix}$, $-\underset{\underset{R_{20}}{|}}{N}-CO-R_{21}$, $-\underset{\underset{R_{20}}{|}}{N}-SO_2-R_{21}$, $-COOR_{20}$, $-CON\begin{matrix}R_{20}\\R_{21}\end{matrix}$, $-SO_2N\begin{matrix}R_{20}\\R_{21}\end{matrix}$, a cyano group, a halogen atom or a nitro group, provided that $R_{20}$ and $R_{21}$ which may be the same or different denote time same group as $R_{19}$; p is an integer of 1–4; q is 0, 1 or 2; r is an integer of 1–4; t is an integer of 1–3, provided that when r or t is 2 or more, groups denoted by $R_{18}$ may be the same or different, and when r or t is 2 or more, $R_{18}$ may combine together to form a ring.

(3) a group that makes use of a cleavage reaction on hemiacetal:

Examples of such group are described in U.S. Pat. No. 4,146,396, and Unexamined Published Japanese Patent Application Nos. 249148/1985 and 249149/1985.

Among these, those which are represented by the following general formula (TIME-VI) are preferred:

$$(*)-(Z_3-\underset{\underset{R_{18}}{|}}{\overset{\overset{R_{17}}{|}}{C}})_p-(*)\ (*) \qquad \text{(TIME-VI)}$$

where $Z_3$ denotes $(*)-O-$, $(*)-OCO-O-$, $(*)-\underset{\underset{SO_2R_{19}}{|}}{N}-$, $(*)-OCO-\underset{\underset{R_{19}}{|}}{N}-$, $(*)-S-$, $(*)-\underset{\underset{COR_{19}}{|}}{N}-$, $(*)-OCO-S-$, $(*)-OCH_2-O$, or $(*)-OCH_2-S-$;

$R_{17}$, $R_{18}$ and $R_{19}$ have the same meanings as defined for the general formulas (TIME-III), (TIME-IV) and (TIME-V).

(4) a group that is described in West German Patent Application (OLS) No. 2,626,315 and U.S. Pat. No. 4,546,073 and which is represented by the following general formula (TIME-VII):

$$(*)-Z_4-\overset{\overset{Z_5}{\|}}{C}-(*)\ (*) \qquad \text{(TIME-VII)}$$

where $Z_4$ denotes (*)—O—, (*)—S— or $(*)-\underset{\underset{R_{22}}{|}}{N}-$;

$Z_5$ denotes an oxygen atom, a sulfur atom or —N—$R_{22}$ (where $R_{22}$ is a hydrogen atom or a substituent).

The aliphatic group represented by $R_1$ is a saturated or unsaturated, straight-chained, branched or cyclic, substituted or unsubstituted aliphatic group that preferably has 1–8 carbon atoms.

The aromatic group represented by $R_1$ is an aromatic group having 6–10 carbon atoms, and is preferably a substituted or unsubstituted phenylene group.

The saturated heterocyclic group represented by $R_1$ is a 3- to 8-membered, preferably 4- to 6-membered, saturated heterocyclic group that has 1–7, preferably 1–5, carbon atoms and that has at least one of oxygen, nitrogen and sulfur atoms.

The 5- or 6-membered nitrogenous aromatic heterocyclic group represented by $R_1$ is preferably represented by the following general formula (H-I) or (H-II):

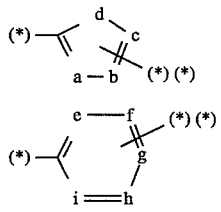

(H-I)

(H-II)

where a, b, c, e, f, g, h and i each denotes a nitrogen atom or a methine group; d in an oxygen atom, a sulfur atom or an imino group; (*) denotes the binding site to $$Cp-(TIME)_m-S- \text{ or } Cp-(TIME)_m-O-\overset{O}{\overset{\|}{C}}-_n$$

and (*) (*) denotes the binding site to $R_3$—S— or $R_2$—, provided that at least one of e, f, g, h and i is a nitrogen atom.

A more preferred example of $R_1$ is an aliphatic group or

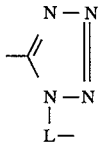

(where L is a divalent aliphatic group having 1–8 carbon atoms or a phenylene group).

Preferred examples of $R_1$ are specifically shown below:

$-CH_2-$, $-CH_2CH_2-$, $-CH_2CH_2CH_2-$, $-\underset{\underset{CH_3}{|}}{CH}-CH_2-$, $-CH_2\underset{\underset{CH_3}{|}}{CH}CH_2-$, $-CH_2CH_2CH_2CH_2-$, $-CH_2CH_2\underset{\underset{CH_3}{|}}{CH}CH_2-$, $-CH_2\underset{\underset{C_2H_5}{|}}{CH}CH_2CH_2-$, $-CH_2CH_2OCH_2CH_2-$,

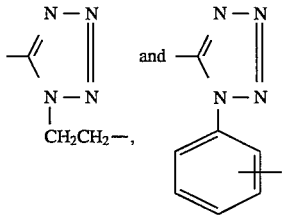

Preferred examples of the water-soluble substituent represented by $R_2$ or its precursor are shown below:

$-COOH$, $-COONa$, $-COOCH_3$, $-COOC_2H_5$, $-NHSO_2CH_3$, $-NHCOOCH_3$, $-NHCOOC_2H_5$,

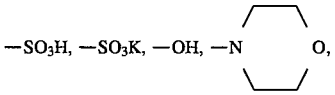

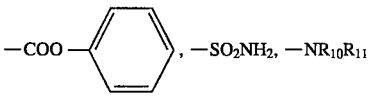

(where $R_{10}$ and $R_{11}$ are each a hydrogen atom or an alkyl group having 1–4 carbon atoms).

Particularly preferred examples of the bleach accelerator or precursor thereof that are represented by $-CONH_2$, $-COCH_3$, $-NHCOCH_3$, $-CH_2CH_2COOH$, $-CH_2CH_2NH_2$, $-SCH_2COOH$,

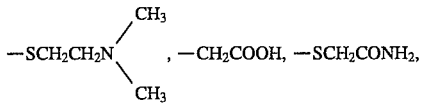

$-SCH_2COCH_3$, $-SCH_2CH_2COOH$, $-S-R_1-R_2$ are shown below.

$-SCH_2CH_2COOH$, $-SCH_2CH_2CH_2COOH$,

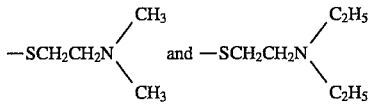

Preferred examples of $R_3$ are shown below:

H, $-CN$, $-COH$, $-COCH_3$, $-COCH_2OCH_3$, $-COCF_3$, $-CSCH_3$, $-CON(CH_3)_2$, $-CON(C_2H_5)_2$,

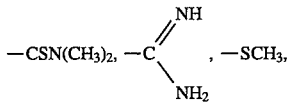

$-SCH_2CH_2N(CH_3)_2$, $-SCH_2CH_2OH$, $-SCH_2CH_2COOH$, $-NHCH_3$, $-NHCH_2CH_2COOH$ and

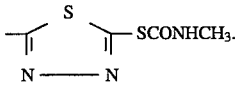

Particularly preferred examples of the bleach accelerator or precursor thereof that are represented by $$-O-\overset{O}{\overset{\|}{C}}-_n R_1-S-R_3$$

are shown below:

$-OCOCH_2CH_2SH$, $-OCH_2CH_2SH$,

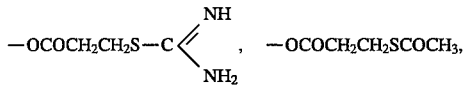

$-OCOCH_2CH_2SCSCH_3$, $-OCOCH_2CH_2SSCH_2CH_2COOH$, $-OCH_2CH_2SSCH_2CH_2OH$ and $-OCOCH_2CH_2SCN$.

The following are non-limiting examples of the BAR coupler that can be used in the actual practice of the present invention.

Illustrative compounds
BAR-1
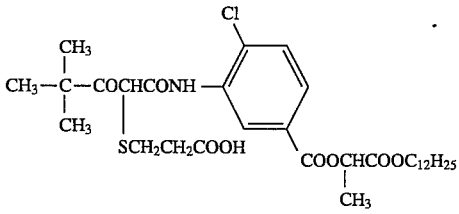
BAR-2
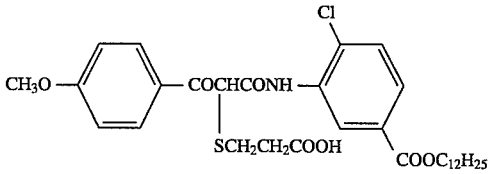
BAR-3
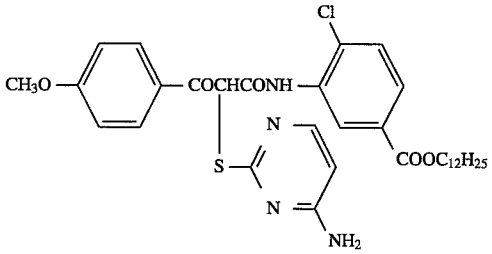
BAR-4
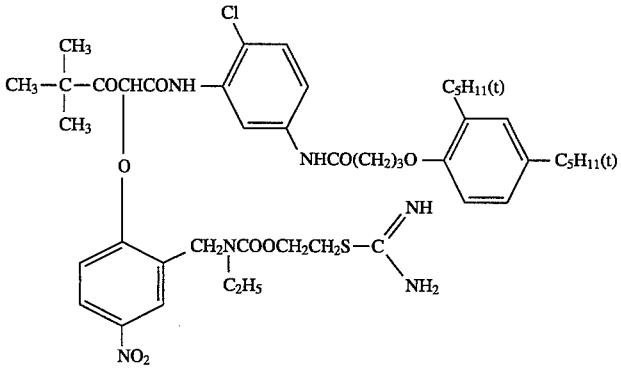
BAR-5
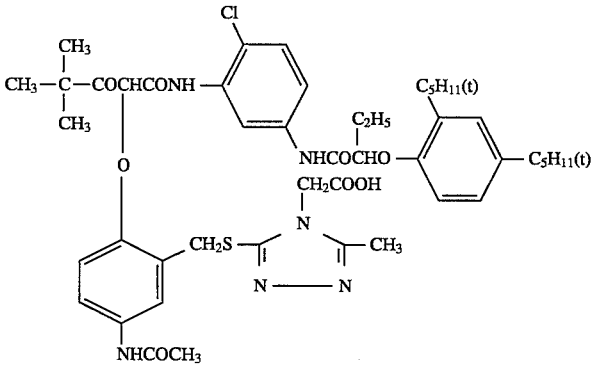

-continued
Illustrative compounds
BAR-6
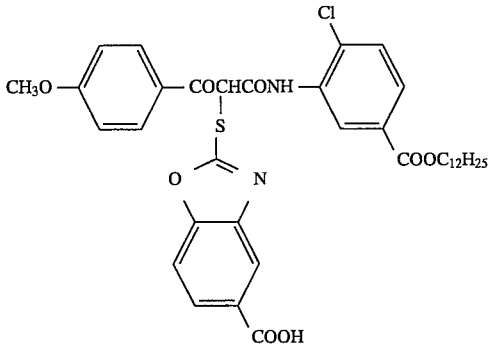
BAR-7
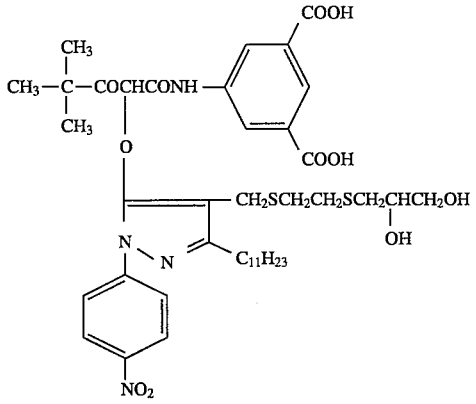
BAR-8
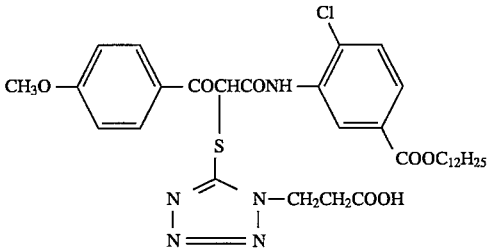
BAR-9
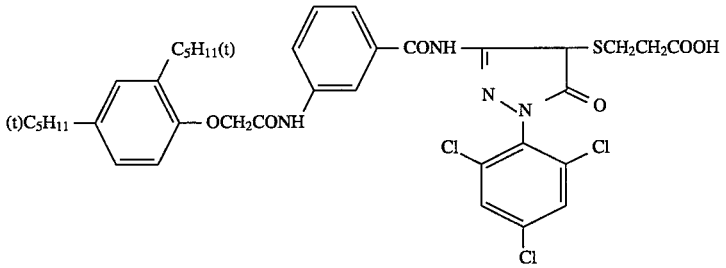
BAR-10
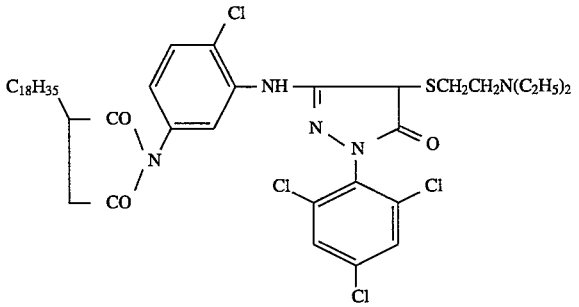

-continued
Illustrative compounds
BAR-11
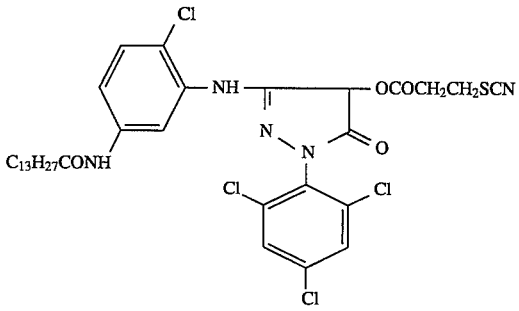
BAR-12
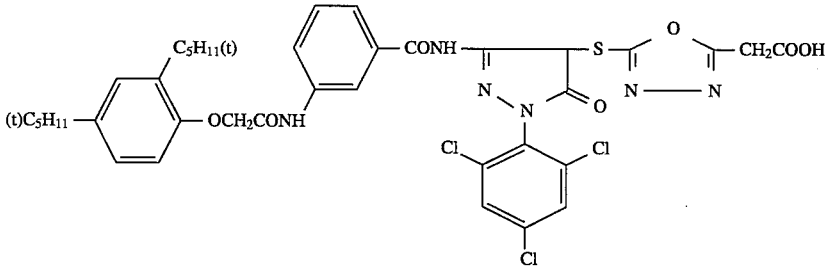
BAR-13
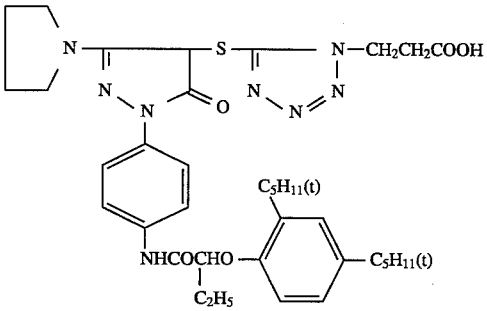
BAR-14
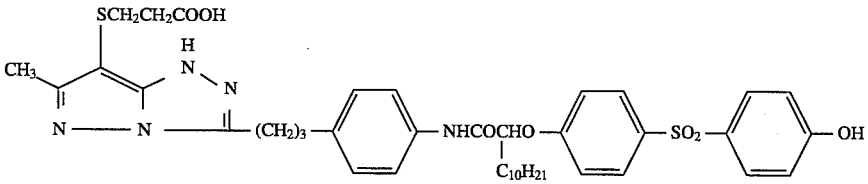
BAR-15
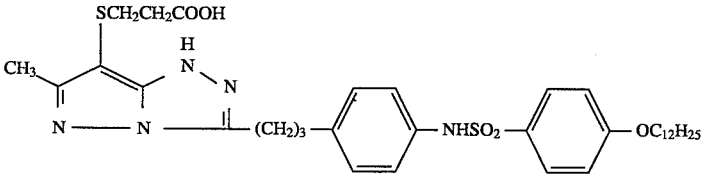
BAR-16
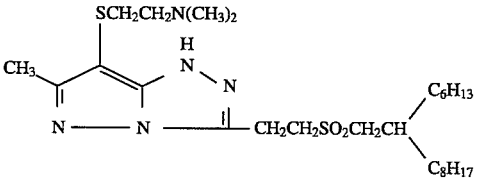
BAR-17
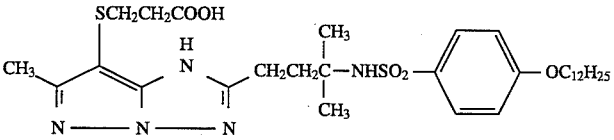

-continued
Illustrative compounds
BAR-18
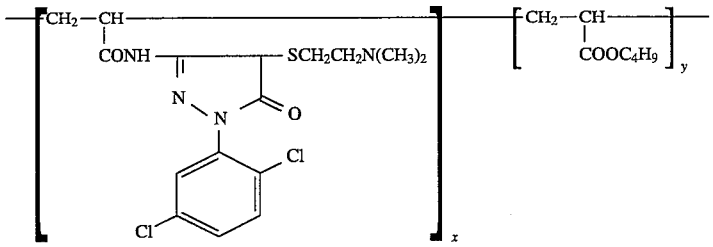
x:y = 50:50 (by weight)
BAR-19
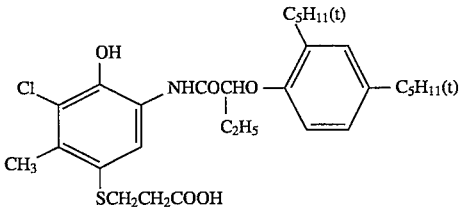
BAR-20
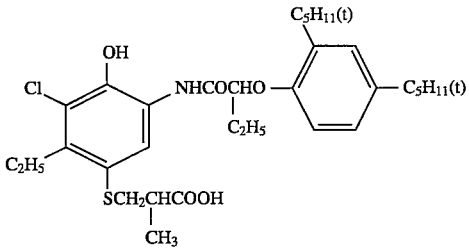
BAR-21
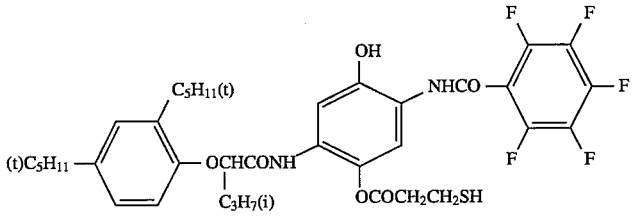
BAR-22
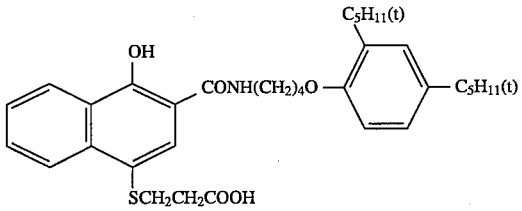
BAR-23
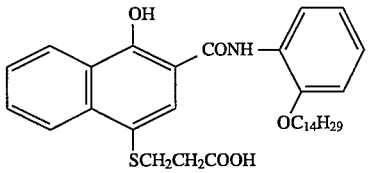
BAR-24
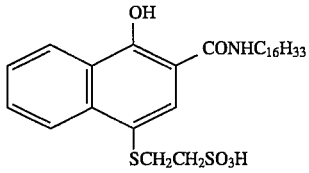

-continued
Illustrative compounds
BAR-25
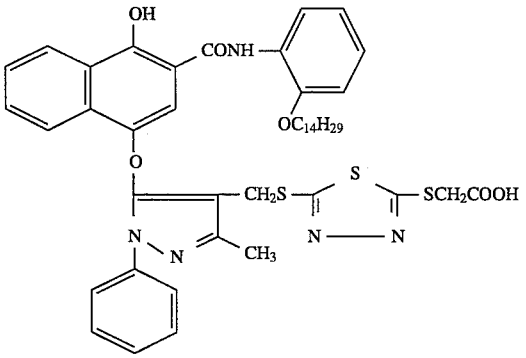
BAR-26
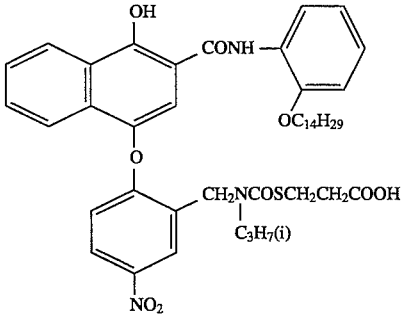
BAR-27
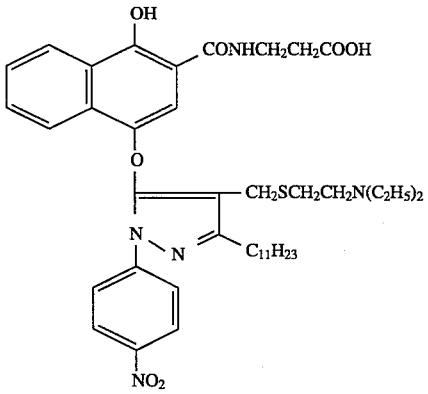
BAR-28
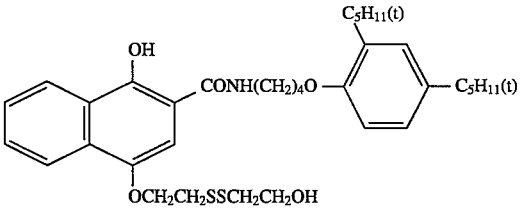
BAR-29
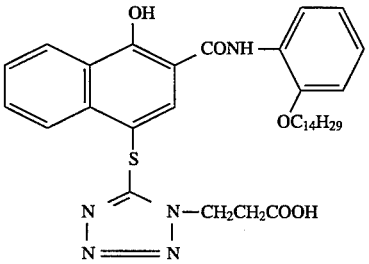

-continued
Illustrative compounds
BAR-30
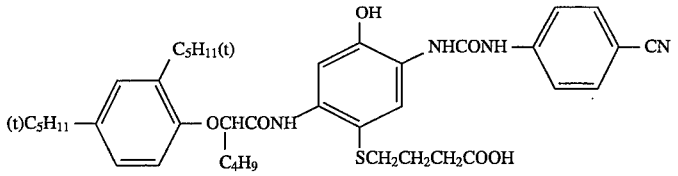
BAR-31
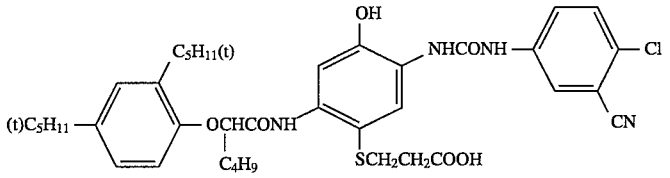
BAR-32
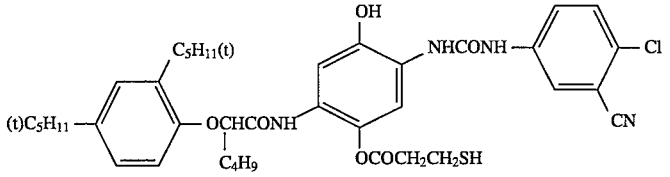
BAR-33
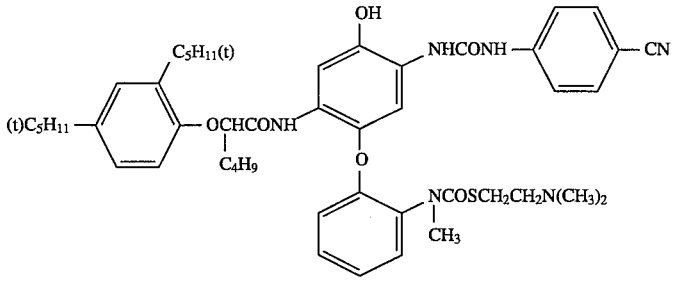
BAR-34
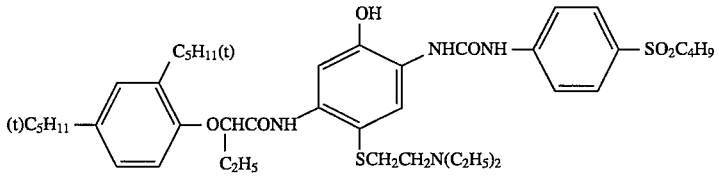
BAR-35
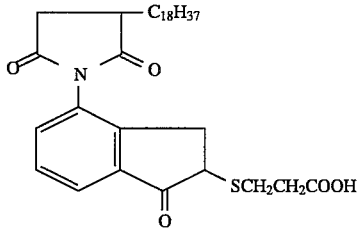
BAR-36
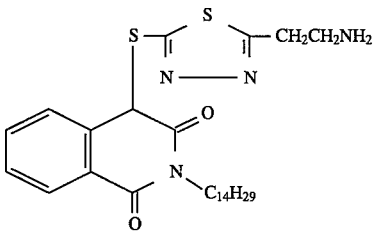
BAR-37
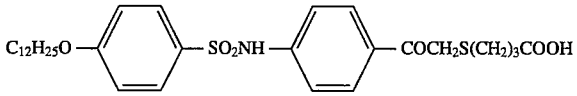

-continued

Illustrative compounds

BAR-38

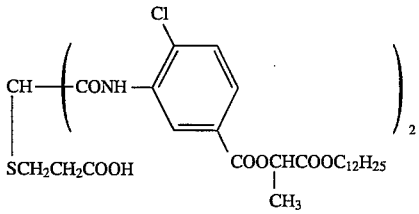

BAR-39

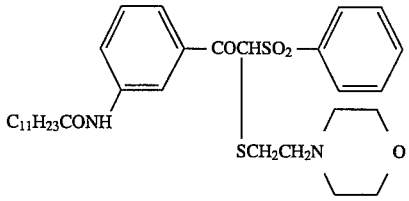

BAR-40

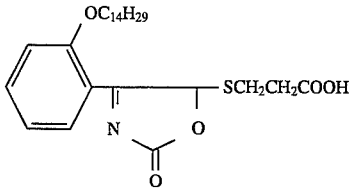

BAR-41

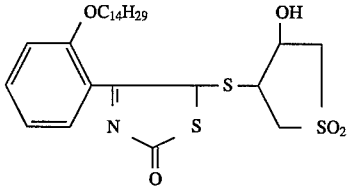

BAR-42

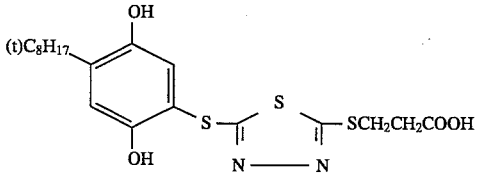

BAR-43

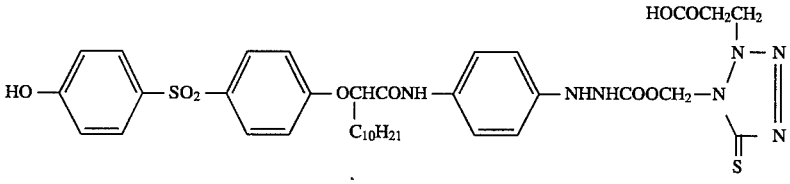

In the practice of the present invention, the BAR compound is preferably incorporated in an emulsion containing the specified silver halide grains so that it is present in a silver halide emulsion layer in a photographic material of interest. If desired, however, the BAR compound may be incorporated in any of other photographic constituent layers (e.g. a silver halide emulsion layer composed of an emulsion that is formed as required in addition to the emulsion containing the specified silver halide grains, as well as an anti-halation layer, an intermediate layer, a YC filter layer, a protective layer, etc.).

The BAR compound may be incorporated in a hydrophilic colloidal layer in a color photographic layer of interest by the following procedure: BAR compounds, either individually or as an admixture, are dissolved in a mixture of a known high-boiling solvent such as dibutyl phthalate, tricresyl phosphate or dinonylphenol and a low-boiling solvent such as butyl acetate or propionic acid; then, the solution is mixed with an aqueous gelatin solution containing a surfactant, and the mixture is emulsified with a high-speed rotary mixer, a colloid mill or an ultrasonic disperser; and the resulting dispersion is added to a coating solution for the hydrophilic colloidal layer either directly or after it is allowed to set, shredded and washed with water.

The BAR compound, if it is to be incorporated in a silver halide emulsion, is used in an amount of 0.0005– 5.0 moles, preferably 0.005–1.0 mole, per mole of silver halide.

The BAR compounds may be used either on their own or as admixtures.

In the practice of the present invention, emulsions as components of the photographic material of the present invention may be chemically sensitized in the usual manner. They may also be sensitized spectrally to have sensitivity in a desired wavelength range using the dyes illustrated hereinabove and other sensitizing dyes.

Antifoggants, stabilizers and other additives can be incorporated in silver halide emulsions.

The photographic material of the present invention is particularly useful as a camera color negative film.

The lower limit for the total dry thickness of all the hydrophilic colloidal layers in the silver halide color photographic material (said total dry thickness is hereunder sometimes referred to as the "film thickness of emulsion surfaces") is determined by such factors as the type of silver halide emulsions, couplers, oils and additives incorporated in said colloidal layers, and the preferred film thickness of emulsion surfaces is in the range of from 5 to 18 μm, more preferably from 10 to 16 μm. The distance from the outermost emulsion surface to the bottom of the emulsion layer that is the closest to a support is preferably not greater than 14 μm. The distance from the outermost emulsion surface to the emulsion layer that is sensitive to light of a different color than said bottommost emulsion layer and which is the second closest to the support is preferably not greater than 10 μm.

A method for reducing the thickness of a photographic material is to reduce the amount of a hydrophilic colloid used as a binder. A hydrophilic colloid is added to attain various purposes such as retaining silver halide grains and the tiny oil droplets of couplers dissolved in high-boiling solvents, preventing the increase in fog due to mechanical stresses, and preventing the color contamination due to diffusion of the oxidation product of a developing agent from one layer to another. The amount of this hydrophilic colloid can be reduced to an extent that is not deleterious to these purposes.

Other methods that can be employed to reduce the thickness of a photographic material include the reduction of the amount of high-boiling solvents and reducing the thickness of an intermediate layer between two layers having sensitivity to light of different colors by adding to it a scavenger of the oxidation product of a developing agent.

The total amount of silver halides to be incorporated in light-sensitive silver halide emulsions in all of the emulsion layers in the silver halide color photographic material of the present invention is preferably not more than 15 g/m$^2$, more preferably from 2.5 to 12.0 g/m$^2$, yet more preferably from 3.0 to 10.0 g/m$^2$, with the range of 3.5–8.0 g/m$^2$ being particularly preferred.

The amount of silver halides can be determined by X-ray fluorescence analysis and the above-specified ranges of silver halide content are expressed in terms of silver.

The silver halide color photographic material of the present invention is preferably stored at relative humidities not higher than 55%. A preferred method for storing the photographic material at relative humidities not higher than 55% is to wrap it airtightly. This can be accomplished by wrapping the photographic material in a moisture-proof package, which is a technique well known in the art of packaging. Moisture-proof packaging materials include: metal sheets such as aluminum and tinplated steel sheets; metal foils such as aluminum foil; glass; polymers such as polyethylene, polyvinyl chloride, polystyrene, polyvinylidene chloride, polypropylene, polycarbonate and polyamide; and various polymers combined with Cellophane, paper, aluminum foil and other suitable materials to form composites (called "laminated" in the packaging industry).

Sealing for airtight wrapping can be achieved by various methods including a bonding method using a variety of adhesives, a heat fusing method such as heat sealing, and the use of film magazines which is a common technique in the photographic industry. For details of these sealing methods, see "Shokuhin Hoso Gijutsu Binran (Handbook of Food Packaging Technology)" compiled by the Packaging Technology Society of Japan, pp. 573–609.

The "silver halide photographic material stored at a relative humidity of 55% or below" may be defined as a silver halide photographic material that satisfies the condition:

$$\Delta W^{55}=W_2^{55}-W_1^{55}\geqq 0$$

where $W_1^{55}$ is the weight of the photographic material as measured within 30 seconds of exposure to 25° C. ×55% r.h., and $W_2^{55}$ is the weight as measured after exposure to the same condition for 3 days.

The preferred condition for the present invention is that the weight change $\Delta W^{30}$ upon exposure to 25° C. ×30% r.h. be negative, and a more preferred condition is that the weight change $\Delta W^{35}$ upon exposure to 25° C. ×35% r.h. be negative.

If the silver halide photographic material of the present invention is a rolled projection material, it is preferably kept in a film magazine made of a high-molecular weight material such as polypropylene, and if it is a camera photographic material in sheet form, it is preferably heat-sealed with polyethylene, etc.

Two or more of the packaging methods described above may be combined to insure maximum results. In order to reduce the relative humidity to a desired level before packaging, the silver halide photographic material may be handled for packing in a cool room, or it may be pre-dried by a greater degree than in the usual case, or its moisture may be reduced by putting a desiccant such as silica gel into a closed container.

It is preferred for the purposes of the present invention that when swollen by development, the total thickness of all the hydrophilic protective colloidal layers formed on a support on the same side as emulsion layers in a silver halide color photographic material is from 180% to 350%, more preferably from 200% to 300%, of the dry thickness in a dry state.

Techniques for controlling the thickness of hydrophilic protective colloidal layers in a swollen state are well known to one skilled in the art and one typical method is to properly select the amount and type of hardeners used.

Hardeners that can be used for the silver halide photographic material of the present invention include: aldehyde and aziridine compounds (as described in PB Report 19,921, U.S. Pat. Nos. 2,950,197, 2,964,404, 2,983,611, 3,271,175, Examined Japanese Patent Publication No. 40898/1971 and Unexamined Published Japanese Patent Application No. 91315/1975); isoxazole compounds (as described in U.S. Pat. No. 331,609); epoxy compounds (as described in U.S. Pat. No. 3,047,394, German Patent No. 1,085,663, British Patent No. 1,033,518, and Examined Japanese Patent Publication No. 35495/1973); vinylsulfone compounds (as described in PB Report 19,920, German Patent Nos. 1,100, 942, 2,337,412, 2,545,722, 2,635,518, 2,742,308, 2,749,260, British Patent No. 1,251,091, Japanese Patent Application Nos. 54236/1970, 110996/1973, U.S. Pat. Nos. 3,539,644 and 3,490,911); acryloyl compounds (as described in Japanese Patent Application No. 27949/1973 and U.S. Pat. No. 3,640,720); carbodiimide compounds (as described in U.S. Pat. Nos. 2,938,892, 4,043,818, 4,061,499, Examined Japanese Patent Publication No. 38715/1971 and Japanese Patent Application No. 15095/1974); triazine compounds (as described in German Patent Nos. 2,410,973, 2,553,915, U.S.

Pat. No. 3,325,287, and Unexamined Published Japanese Patent Application No. 12722/1977); high-molecular weight compounds (as described in British Patent No. 822,061, U.S. Pat. Nos. 3,623,878, 3,396,029, 3,226,234, Examined Japanese Patent Publication Nos. 18578/1972, 18579/1972, and 48896/1972); as well as maleimide compounds, acetylene compounds, methanesulfonate ester compounds, and N-methylol compounds. These hardeners may be used either on their own or as admixtures. Useful combinations of hardeners are described in such prior patents as German Patent Nos. 2,447,587, 2,505,746, 2,514,245, U.S. Pat. Nos. 4,047, 957, 3,832,181, 3,840,370, Unexamined Published Japanese Patent Application Nos. 43319/1973, 63062/1975, 127329/1977, and Examined Japanese Patent Publication No. 32364/1973.

The term "thickness in a swollen state upon development" as used herein may be defined as the thickness measured after 3-min immersion in a solution held at 38° C. that has the composition shown below.

| Solution for measuring thickness in a swollen state | |
|---|---|
| 4-Amino-3-methyl-N-ethyl-N-(β-hydroxyethyl)-aniline sulfate | 4.75 g |
| Anhydrous sodium sulfite | 4.25 g |
| Hydroxylamine hemisulfate | 2.0 g |
| Anhydrous potassium carbonate | 37.5 g |
| Sodium bromide | 1.3 g |
| Nitrilotriacetic acid trisodium salt (monohydrate) | 2.5 g |
| Potassium hydroxide | 1.0 g |
| Water | to make 1,000 ml |

The thickness in a swollen state may be measured by the method described in A. Green and G. I. P. Levenson, J. Photogr. Sci., 20, 205 (1972).

The term "dry thickness" as used hereinabove means the thickness as measured at 23° C. ×55% r.h. For thickness measurement, a picture is taken of a cross section of a dry sample with a scanning electron microscope and the thickness of each layer in the sample is measured.

The "hydrophilic protective colloidal layers" include not only the above-described blue-, green- and red-sensitive silver halide emulsion layers (at least one layer is provided for sensitivity to each color), but also any optionally provided layers such as protective layers, anti-halation layers, yellow filter layers and intermediate layers.

Layer arrangements for silver halide color photographic materials that are particularly effective for attaining the intended advantages of the present invention are as follows: a support coated successively with a colloidal silver anti-halation layer, (an intermediate layer), a red-sensitive layer, (an intermediate layer), a green-sensitive layer, (an intermediate layer), a colloidal silver yellow filter layer, a blue-sensitive layer, (an intermediate layer), and a protective layer; and a support coated successively with a colloidal silver anti-halation layer, (an intermediate layer), a red-sensitive layer, (an intermediate layer), a green-sensitive layer, (an intermediate layer), a blue-sensitive layer, (an intermediate layer), a red-sensitive layer, (an intermediate layer), a green-sensitive layer, (a colloidal silver yellow filter layer), a blue-sensitive layer, (an intermediate layer), and a protective layer. The layers in parentheses are optional and may be omitted depending on the case.

Each of the red-, green- and blue-sensitive layers in the photographic material of the present invention may be divided into two parts, one having the lower sensitivity and the other having the higher sensitivity. Other layer arrangements that can be adopted include: at least one of the red-, green- and blue-sensitive layers is divided into three parts as described in Examined Japanese Patent Publication No. 15495/1974; the three kinds of light-sensitive emulsion layers are divided into two nuits, one having the higher sensitivity and the other having the lower sensitivity, as described in Unexamined Published Japanese Patent Application No. 49027/1976; and layer arrangements as described in West German Application (OLS) Nos. 2,622,922, 2,622,923, 2,622,924, 2,704,826, and 2,704,797.

The layer arrangements described in Unexamined Published Japanese Patent Application Nos. 177551/1982, 177552/1984 and 180555/1984 are also useful in the present invention.

Gelatin is used advantageously as a binder (or protective colloid) in silver halide emulsions. Also useful are hydrophilic colloids such as gelatin derivatives, graft polymers of gelatin and other high-molecular weight compounds, other proteins, saccharide derivatives, cellulosic derivatives, and synthetic hydrophilic high-molecular weight materials (e.g. homo- and copolymers).

Photographic emulsion layers and other hydrophilic colloidal layers in a photographic material layer using silver halide emulsions can be hardened with one or more hardeners that increase the film strength by crosslinking the molecules of a binder (or protective colloid). Hardeners can be added to the photographic material in a sufficient amount to harden it to such an extent that there is no need to incorporate hardeners in processing solutions. If desired, hardeners can also be added to processing solutions.

Silver halide emulsion layers and/or other hydrophilic colloidal layers in the photographic material may incorporate plasticizers for the purpose of providing enhanced flexibility. Compounds preferred for use as plasticizers are described in RD 17643, XII, A.

Photographic emulsion layers and other hydrophilic colloidal layers in the photographic material may also incorporate dispersions (latices) of synthetic polymers either insoluble or slightly soluble in water for attaining such purposes as improvement in dimensional stability. Useful polymers are those which dimensional stability.

Contain the following monomer components: alkyl (meth)acrylates, alkoxyalkyl (meth)acrylates, glycidyl (meth)acrylates, (meth)acrylamides, vinyl esters (e.g. vinyl acetate), acrylonitrile, olefins, styrene, etc., which may be used either alone or in combination with themselves or with other monomers such as acrylic acid, methacrylic acid, α,β-unsaturated dicarboxylic acids, hydroxyalkyl (meth)-acrylates, sulfoalkyl (meth)acrylates, styrenesulfonic acids, etc.

If the oxidation product of a developing agent or an electron transfer agent migrates between emulsion layers in a photographic material (i.e., between layers having sensitivity to the same color and/or between layers having sensitivity to different colors), color contamination, deteriorated sharpness or visible graininess will occur. To avoid this problem, a color fog preventing agent may be used. If a color fog preventing agent is to be used, it may be incorporated in an emulsion layer per se or in an intermediate layer provided between adjacent emulsion layers.

The photographic material of the present invention may incorporate an image stabilizer for preventing the deterioration of dye images. Compounds that are preferably used as image stabilizers are described in RD 17643, VII, J.

Antistatic agents may be incorporated in protective layers, intermediate layers and other hydrophilic colloidal layers in the photographic material in order to prevent fogging that will occur upon discharging of static buildup caused by triboelectricity or otherwise electrification of the photographic material. Ultraviolet absorbers may also be used to prevent image deterioration due to uv radiation.

Formaldehyde scavengers may be used in the photographic material in order to prevent formaldehyde-induced deterioration of magenta dye forming couplers, etc. during storage.

When dyes, uv absorbers and other additives are to be contained in hydrophilic colloidal layers in the photographic material, they may be mordanted with cationic polymers and other mordants.

Compounds that alter developability (e.g. development accelerators and development retarders) and bleach accelerators may be incorporated in silver halide emulsion layers and/or other hydrophilic colloidal layers in the photographic material. Compounds that are preferably used as development accelerators are described in RD 17643, XXI, B-D, and compounds suitable for use as development retarders are described in RD 17643, XXI, E. Black-and-white developing agents and/or precursors thereof may be used for development acceleration and other purposes.

For the purpose of increasing the sensitivity or contrast or accelerating the rate of development, emulsion layers in the photographic material may contain polyalkylene oxides or ether, ester amine, or other derivatives thereof, thioether compounds, thiomorpholines, quaternary ammonium compounds, urethane derivatives, urea derivatives, imidazole derivatives, etc.

Brighteners may be used in the photographic material for the purpose of highlighting the whiteness of the background while making the staining of the background less noticeable. Compounds that are preferably used as brighteners are described in RD 17643, V.

The photographic material may employ auxiliary layers such as a filter layer, an anti-halation layer and an anti-irradiation layer. These auxiliary layers and/or emulsion layers may contain dyes that will flow out of the photographic material during development or dyes that are bleachable. Such dyes include oxonol, hemioxonol, styryl, merocyanine, cyanine and azo dyes.

Matting agents may be incorporated in silver halide emulsion layers and/or other hydrophilic colloidal layers in the photographic material in order to attain such purposes as reducing the gloss of the photographic material, providing increased adaptability for writing-in, and preventing two sheets of the photographic material from sticking to each other. While any matting agents can be used, typical examples include silicon dioxide, titanium dioxide, magnesium dioxide, aluminum dioxide, barium sulfate, calcium carbonate, polymers of acrylic acid or methacrylic acid or esters thereof, polyvinyl resins, polycarbonates, as well as styrene homo- and copolymers. The matting agents preferably have a particle size in the range of 0.05–10 μm. They are preferably incorporated in amounts of 1–300 mg/m$^2$.

Lubricants may be incorporated in the photographic material in order to reduce its sliding friction.

Antistatic agents may also be incorporated in the photographic material for the purpose of preventing static buildup. Antistatic agents may be used in an antistatic coating provided on the side of a support where no emulsion layers are provided. Alternatively, they may be used in emulsion layers and/or protective colloidal layers other than the emulsion layers that are provided on the same side of the support as where the emulsion layers are provided. Compounds that are preferably used as antistatic agents are described in RD 17643, XIII.

Photographic emulsion layers and/or other hydrophilic colloidal layers in the photographic material may employ various surfactants in order to attain such purposes as improvement in coating quality, prevention of static buildup, improvement in slip property, emulsification and dispersion, anti-blocking, and improvement in photographic characteristics (e.g. accelerated development, hardening and sensitization).

Various supports may be used for the photographic material of the present invention and they include: flexible reflecting supports such as paper laminated with α-olefin polymers (e.g. polyethylene, polypropylene and ethylene/butene copolymer) and synthetic paper; flexible supports such as films made of semi-synthetic or synthetic polymers (e.g. cellulose acetate, cellulose nitrate, polystyrene, polyvinyl chloride, polyethylene terephthalate, polycarbonate and polyamide), which films may optionally be provided with a reflecting layer; as well as glass, metals and ceramics.

The support of the photographic material may be subjected to a suitable surface treatment (e.g. corona discharge, uv irradiation and flame treatment) as required. Thereafter, the necessary photographic layers may be coated either directly or via one or more subbing layers that are provided for the purpose of improving the adhesion of the surface of the support, its antistatic quality, dimensional stability, wear resistance, hardness, anti-halation quality, frictional characteristics and/or other characteristics.

Coating operations may be performed using a thickener for the purpose of increasing the coating efficiency. Some additives such as a hardener are so fast reactive that they will experience premature gelation if they are preliminarily incorporated into a coating solution. In this case, such additives are preferably mixed with the other components of the coating solution by means of a static mixer or some other suitable device just prior to the start of coating operation.

Particularly advantageous coating methods are extrusion coating and curtain coating, both of which are capable of applying two or more layers simultaneously. Packet coating is also useful depending on the object. The coating speed may be selected at any desired value.

While there is no particular limitation on the type of surfactants to be used, illustrative examples include: natural surfactants such as saponin; nonionic surfactants such as alkylene oxide compounds, glycerin compounds and glycidol compounds; cationic surfactants such as higher alkylamines, quaternary ammonium salts, heterocyclic compounds (e.g. pyridine), phosphonium compounds, and sulfonium compounds; anionic surfactants containing acidic groups such as carboxylic acid, sulfonic acid, phosphoric acid, sulfate esters and phosphate esters; and amphoteric surfactants such as amino acids, aminosulfonic acids, and sulfate or phosphate esters of aminoalcohols. Fluorine-containing surfactants may also be used to attain similar objects.

In order to obtain a dye image with the photographic material of the present invention, it is first exposed and then subjected to color photographic processing. Color processing comprises the steps of color development, bleaching, fixing, washing and stabilizing (optional). The steps of bleaching and fixing which use a bleaching solution and a fixing solution, respectively, may be replaced by the step of bleach-fixing which uses a mono-bath fleach-fixing solution. Further, the steps of color development, bleaching and fixing may be performed by a single mono-bath treatment using a combined development-bleaching-fixing solution.

The processing steps described above may be combined with other steps such as prehardening, neutralization, stop-fixing, and post-hardening. If desired, the step of color development may be replaced by a step of activator treatment, in which a photographic material containing a color developing agent or a precursor thereof is developed with an activator solution. Alternatively, an activator may be used in a mono-bath treatment. Typical processing schemes are described below (in each of which, the final step is either washing or one of washing and stabilizing):

i) colr development - bleaching - fixing;

ii) color development - bleach-fixing;

iii) prehardening - color development - stop-fixing - washing - bleaching - fixing - washing - post-hardening;

iv) color development - washing - auxiliary color development - stopping - bleaching - fixing;

v) activator treatment - bleach-fixing;

vi) activator treatment - bleaching - fixing; and vii) mono-bath treatment.

In the present invention, the silver halide photographic material described above is subjected to imagewise exposure and processed by a scheme including at least the steps of (1) color development and (2) bleaching and/or fixing. In this case, color development may be performed rapidly within a time of 20–120 sec. The temperature for color development is preferably in the range of 20°–80° C., more preferably at least 35° C.

The developing agent to be used in the developer for processing the photographic material of the present invention is described below.

The developer for processing the photographic material of the present invention preferably employs aromatic primary amino color developing agents which include any known compounds that are used extensively in various color photographic processes. These color developing agents include aminophenolic and p-phenylenediamino derivatives. These compounds may be used in a free state but more commonly, they are used in the form of salts such as hydrochlorides or sulfates in view of their stability.

Illustrative aminophenolic developing agents include o-aminophenol, p-aminophenol, 5-amino-2-oxy-toluene, 2-amino-3-oxy-toluene, 2-oxy-3-amino-1,4-dimethylbenzene, etc.

Particularly useful aromatic primary amino color developing agents are p-phenylenediamino compounds having at least one water-soluble group. Particularly preferred are the compounds represented by the following general formula (X):

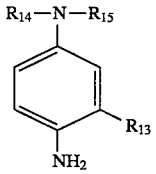

(X)

where $R_{13}$ is a hydrogen atom, a halogen atom or an alkyl group, which alkyl group is an optionally substituted straight-chained or brached alkyl group having 1–5 carbon atoms; $R_{14}$ and $R_{15}$ are each hydrogen atom or an optionally substituted alkyl or aryl group, with the alkyl group being preferably substituted by an aryl group; at least one of $R_{14}$ and $R_{15}$ is an alkyl group or $-(CH_2)_q O)_p R_{16}$ which are substituted by a water-soluble group such as a hydroxyl group, a carboxylic acid group, a sulfonic acid group, an amino group or a sulfonamido group, which alkyl group may have another substituent (where $R_{16}$ is a hydrogen atom or an alkyl group which is straight-chained or branched alkyl group having 1–5 carbon atoms; p and q are each an integer of 1–5).

The following are non-limiting examples of the compound represented by the general formula (X).

Illustrative compounds

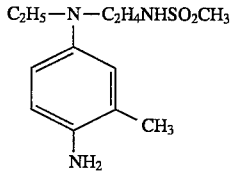

(E-1)

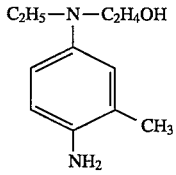

(E-2)

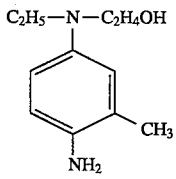

(E-3)

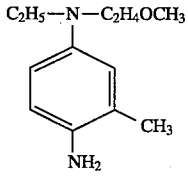

(E-4)

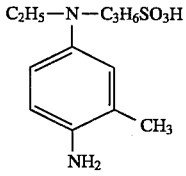

(E-5)

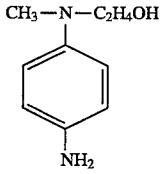

(E-6)

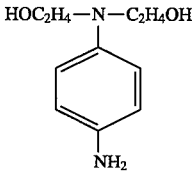

(E-7)

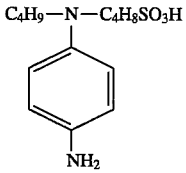

(E-8)

-continued

Illustrative compounds

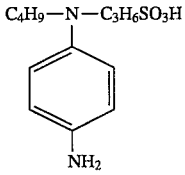

(E-9)

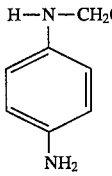

(E-10)

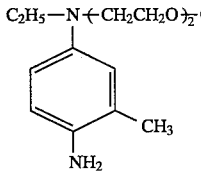

(E-11)

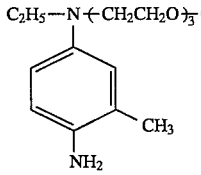

(E-12)

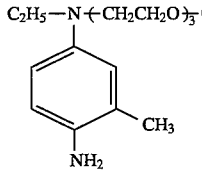

(E-13)

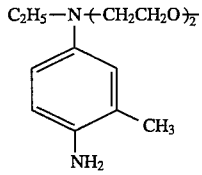

(E-14)

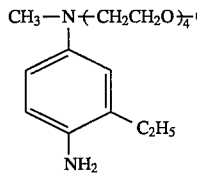

(E-15)

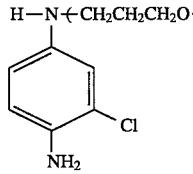

(E-16)

These p-phenylenediamino derivatives represented by the general formula (X) can be used in the form of salts of organic or inorganic acids, such as hydrochlorides, sulfates, phosphates, p-toluenesulfonates, sulfites, oxalates, benzenedisulfonates, etc.

The aromatic primary amino color developing agents described above are preferably contained in a developer in amounts of at least $2\times10^{-2}$ moles, more preferably from $2.5\times10^{-2}$ to $2\times10^{-1}$ moles, most preferably from $3\times10^{-2}$ to $1\times10^{-1}$ mole, per liter of the developer.

Compounds preferably used in color developers include sulfites, hydroxylamines and development inhibitors. Illustrative sulfites include sodium solfite, sodium hydrogensulfite, potassium sulfite and potassium hydrogensulfite. These sulfites are preferably used in amounts of 0.1–40 g/L, with the range of 0.5–10 g/L being more preferred. Hydroxylamines are used in the form of salts such as hydrochlorides and sulfates. They are preferably used in amounts of 0.1–40 g/L, with the range of 0.5–10 g/L being more preferred. Illustrative development inhibitors include halides (e.g. sodium bromide, potassium bromide, sodium iodide and potassium iodide) and organic inhibitors. The organic inhibitors described in Japanese Patent Application No. 162885/1986 are preferably used. These inhibitors are preferably used in amounts of 0.005–20 g/L, with the range of 0.01–5 g/L being more preferred.

The color developer to be used in the present invention preferably contains a compound represented by the following general formula (IS):

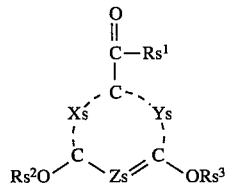

(IS)

where $Rs^1$ is —OH, —$ORs^4$ or

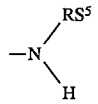

[where $Rs^4$ and $Rs^5$ are each an alkyl group which may have a substituent (e.g. a hydroxyl group or an aryl group such as phenyl) and which is exemplified by methyl, ethyl, propyl, butyl, benzyl, β-hydroxyethyl or dodecyl]; $Rs^2$ and $Rs^3$ are each —H or

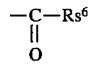

[where $Rs^6$ is an aryl group or an alkyl group such as a long-chained alkyl group (e.g. undecyl)]; Xs and Ys each denotes a carbon atom or a hydrogen atom that cooperate with the group of other atoms to form a 6-membered ring; and Zs denotes —N= or —CH=, provided that when Zs is —N=, the compound represented by the general formula (IS) is typically a citrazinic acid derivative, and when Zs is —CH=, the compound represented by the general formula (IS) is typically a benzoic acid derivative; time compound taken as a whole may optionally contain a substituent such as a halogen atom in the 6-membered ring; and Zs is preferably —N=.

Specific examples of time compound represented by the general formula (IS) are listed below but it should be understood that the scope of the present invention is by no means limited by the following examples.

Illustrative compounds
(1)
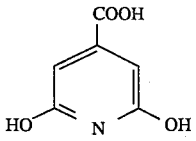
(2)
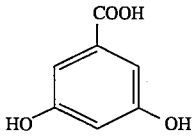
(3)
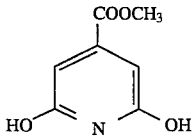
(4)
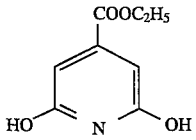
(5)
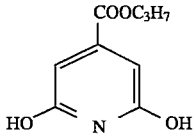
(6)
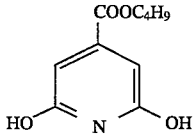
(7)
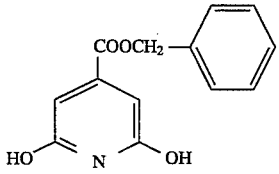
(8)
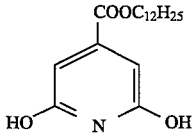
(9)
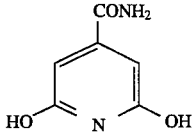
(10)
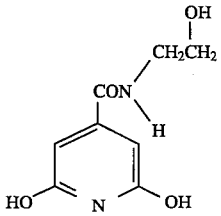
-continued
Illustrative compounds
(11)
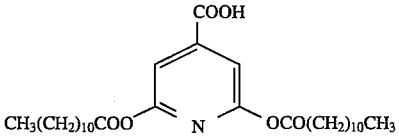
(12)
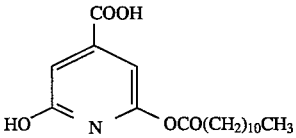
(13)
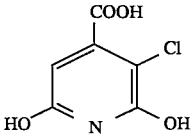
(14)
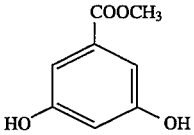
(15)
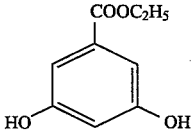
(16)
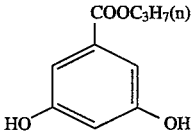
(17)
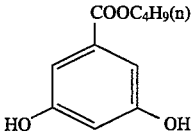
(18)
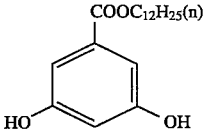
(19)
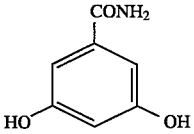
(20)
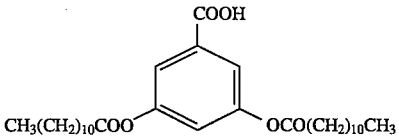
(21)
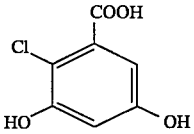

The compounds represented by the general formula (IS) are preferably used in amounts of 0.1–50 g, more preferably 0.2–20 g, per liter of the color developer.

The color developer may further contain various components that are customarily added to color developers, and they include alkali agents such as sodium hydroxide and sodium carbonate, alkali metal salts of thiocyanic acid, alkali metal halides, benzyl alcohol, water softeners, thickeners, development accelerators, and any other suitable additives.

Other additives that can be incorporated in the color developer include antistaining agents, antisludging agents, preservatives, interimage effect accelerating agents, chelatants, etc.

In the present invention, the developer is preferably used at a pH of at least 9, more preferably between 9 and 13.

Besides the conditions described above, there are no particular limitations that are imposed on the method of processing the photographic material of the present invention and every conventional processing method may be employed. Typical processing schemes are described below: 1) color development and bleach-fixing, which is optionally followed by washing or stabilization as a step alternative to washing; 2) color development and separate steps of bleaching and fixing, which are optionally followed by washing or stabilization as a step alternative to washing; 3) prehardening, neutralization, color development, stop-fixing, washing (or stabilization as a step alternative to washing), bleaching, fixing, washing (or stabilization as a step alternative to washing), post-hardening, and washing (or stabilization as a step alternative to washing); 4) color development, washing (or stabilization as a step alternative to washing), auxiliary color development, stopping, bleaching, fixing, washing (or stabilization as a step alternative to washing), and stabilization; and 5) color development, bleaching by halogenation of the developed silver, and another step of color development to increase the amount of dye production.

The bleaching agent to be used in the bleaching solution (in the bleaching step) or in the bleach-fixing solution (in the bleach-fixing step) is usually composed of an aminopolycarboxylic acid or an organic acid such as oxalic acid or citric acid, which are coordinated with metal ions such as iron, cobalt or copper ion. Typical examples of the aminopolycarboxylic acid are listed below:

ethylenediaminetetraacetic acid;
diethylenetriaminepenetaacetic acid;
propylenediaminetetraacetic acid;
nitrilotriacetic acid;
iminodiacetic acid;
glycol ether diaminetetraacetic acid;
ethylenediamine tetrapropionic acid;
ethylenediaminetetraacetic acid disodium salt;
diethylenetriaminepentaacetic acid pentasodium salt; and
nitrilotriacetic acid sodium salt.

The bleaching solution or bleach-fixing solution can be used at a pH of 0.2–9.5 preferably at a pH of at least 4.0, more preferably at least 5.0. The processing temperature is usually in the range of 20°–80° C., desirably at 40° C. and above.

The bleaching solution may contain various additives together with the bleaching agent described above (preferably a ferric complex salt of an organic acid). Particularly preferred additives are alkali halides and ammonium halides such as potassium bromide, sodium bromide, sodium chloride, ammonium bromide, potassium iodide, sodium iodide and ammonium iodide. Other additives that can be added as appropriate include: pH buffers such as borates, oxalates, acetates, carbonates and phosphates; solubilizing agents such as triethanolamine; and known compounds that are customarily added to bleaching solutions, such as acetylacetone, phosphonocarboxylic acid, polyphosphoric acid, organic phosphonic acids, oxycarboxylic acids, polycarboxylic acids, alkylamines, and polyethylene oxides.

The bleach-fixing solution may be of such a composition that a halogen compound such as potassium bromide is added in a small amount, or that a halogen compound such as potassium bromide or ammonium bromide is added in a large amount.

Besides potassium bromide, useful halogen compounds include hydrochloric acid, hydrobromic acid, lithium bromide, sodium bromide, ammonium bromide, potassium iodide, sodium iodide, ammonium iodide, etc.

Examples of the silver halide fixing agent to be contained in the bleach-fixing solution are those compounds which are customarily used in fixing treatments and which react with silver halides to form water-soluble complex salts, and typical examples include thiosulfates such as potassium thiosulfate, sodium thiosulfate and ammonium thiosulfate, thiocyanates such as potassium thiocyanate, sodium thiocyanate and ammonium thiocyanate, as well as thiourea, thioether, highly concentrated bromides and iodides. These fixing agents can be used in amounts of at least 5 g/L, preferably at least 50 g/L, more preferably at least 70 g/L, with the upper limit being the solubility limit of these agents.

As in the case of the bleaching solution, the bleach-fixing solution my contain pH buffers, either singly or in combination, that are composed of boric acid or various salts such as sodium borate, sodium hydroxide, potassium hydroxide, sodium carbonate, potassium carbonate, sodium bicarbonate, potassium bicarbonate, acetic acid, sodium acetate and ammonium hydroxide. The bleach-fixing solution may further contain various brighteners, defoamers, surfactants and mold inhibitors. Also containable as appropriate are the following additives: preservatives such as hydroxylamines, hydrazines, sulfites, isomeric bisulfites, and bisulfite adducts of aldehyde and ketone compounds; organic chelatants such as acetylacetone, phosphonocarboxylic acids, polyphosphoric acid, organic phosphonic acids, oxycarboxylic acids, polycarboxylic acids, dicarboxylic acids and aminopolycarboxylic acids; stabilizers such as nitroalcohols and nitrates; solubilizing agents such as alkanolamines; anti-staining agents such as organic amines; and organic solvents such as methanol, dimethylformamide and dimethyl sulfoxide.

The most preferred method of processing the photographic material of the present invention consists of color development which is immediately followed by bleaching or bleach-fixing. If desired, color development may be followed by washing or rinsing and a subsequent treatment such as stopping before bleaching or bleach-fixing is performed. Alternatively, a pre-bath containing a bleach-accelerator may be used as a processing solution prior to bleaching or bleach-fixing.

In the processing of the silver halide photographic material of the present invention, the temperature for treatments other than development, such as bleach-fixing (or bleaching and fixing) and optionally performed washing or stabilization as a step alternative to washing, is preferably within the range of 20°–80° C.

In the practice of the present invention, stabilization as a step alternative to washing (for this treatment, see Unexamined Published Japanese Patent Application Nos. 14834/1983, 105145/1983, 134634/1983 and 18631/1983, as well as Japanese Patent Application Nos. 2709/1985 and 89288/1984) is preferably performed.

The following examples are provided for the purpose of further illustrating the present invention but are in no way to be taken as limiting.

In preparing emulsions to be used in the following examples, seed emulsions were used and they were prepared by the following procedure.

Preparation of seed emulsion N-1 (Formation 1)

To 500 ml of a 2.0% aqueous gelatin solution held at 40° C., 250 ml of an aqueous solution of 4M $AgNO_3$ and 250 ml of an aqueous solution of 4M KBr/KI (KBr: KI=98:2 in molar ratio) were added over a period of 35 min by a controlled double-jet method with the. pAg and pH being controlled at 9.0 and 2.0, respectively (M signifies molar concentration) in accordance with the teaching of Unexamined Published Japanese Patent Application No. 45437/1975. The aqueous gelatin solution containing the thus obtained silver halide grains for the total silver content was adjusted to a pH of 5.5 with an aqueous solution of potassium carbonate. Thereafter, 364 ml of a 5% aqueous solution of Demor N (Kao-Atlas Co., Ltd.) as a precipitant and 244 ml of a 20% aqueous solution of magnesium sulfate as a polyvalent ion supplier were added to cause flocculation. The silver halide grains were precipitated by standing and the supernatant was decanted. Thereafter, 1,400 ml of distilled water was added to have the silver grains re-dispersed. By addition of a 20% aqueous solution of magnesium sulfate (36.4 ml), the silver halide grains were again allowed to flocculate. After precipitation, the supernatant was decanted and an aqueous solution containing 28 g of ossein gelatin was added to make a total volume of 425 ml. By subsequent dispersion at 40° C. for 40 min, a seed emulsion was prepared. This seed emulsion, designated as N-1, was found to be a monodisperse emulsion with an average grain size of 0.093 μm by examination with an electron microscope.

Preparation of seed emulsion N-2 and N-3 (Formulation 2)

By repeating the procedure described above, AgBrI seed emulsions N-2 and N-3 were prepared; they respectively had average grain sizes of 0.27 μm and 0.8 μm, and their AgI content was 2 mol %.

Example 1

Emulsions within the scope of the present invention and comparative emulsions were prepared as described below.

Emulsion preparation 1

Using eight solutions having the compositions shown below, a silver iodobromide emulsion of a core/shell type with the AgI content decreasing as 15 mol %, 5 mol % and 3 mol % from the center outward was prepared. It had an average grain size of 0.65 μm and an average AgI content of 7.16 mol %. This emulsion contained the silver halide grains of the present invention and hence was within the scope of the present invention.

| | |
|---|---|
| Solution A-1 | |
| Ossein gelatin | 10.8 g |
| Pronon (10% sol. in ethanol) | 20.0 ml |
| 4-Hydroxy-6-methyl-1,3,3a,7-tetrazaindene (hereinafter referred to as "TAI") | 200 mg |
| 56% Aqueous acetic acid solution | 32.5 ml |
| 28% Aqueous ammonia solution | 58.7 ml |
| Seed emulsion N-2 | equivalent to 0.4673 mol AgX |
| Distilled water | to make 4,000 ml |
| Solution B-1 | |
| Ossein gelatin | 40 g |
| KBr | 404.6 g |
| KI | 99.6 g |
| TAI | 1,224 mg |
| Distilled water | to make 1,300 ml |
| Solution C-1 | |
| Ossein gelatin | 20 g |
| KBr | 791.4 g |
| KI | 58.1 g |
| TAI | 2,142 mg |
| Distilled water | to make 1,700 ml |
| Solution D-1 | |
| Ossein gelatin | 15 g |
| KBr | 606.0 g |
| KI | 26.15 g |
| TAI | 1,605 mg |
| Distilled water | to make 800 ml |
| Solution E-1 | |
| $AgNO_3$ | 310.4 g |
| 28% Aqueous ammonia | 253 ml |
| Distilled water | to make 1,827 ml |
| Solution F-1 | |
| $AgNO_3$ | 803.3 g |
| 28% Aqueous ammonia | 655 ml |
| Distilled water | to make 1,351 ml |
| Solution G-1 | |
| 28% Aqueous KBr solution | q.s. to adjust pAg |
| Solution H-1 | |
| 56% Aqueous acetic acid solution | q.s. to adjust pH |

Solution E-1 and solution B-1 were added to solution A-1 by double-jet precipitation at 40° C. using a mixer-stirrer of the same type as described in Unexamined Published Japanese Patent Application Nos. 92523/1982 and 92524/1982. Simultaneously with the completion of the addition of B-1, solutions C-1 and E-1 were added, and simultaneously with the completion of the addition of C-1, solution D-1 was added. During the double-jet precipitation, the pAg and pH were controlled as shown in Table 1, and the rates of addition of solutions E-1, B-1, C-1, D-1 and F-1 were also controlled as shown in Table 1.

Control over pAg and pH was effected with a variable-flow roller tube pump by adjusting the flow rates of solutions G-1 and H-1.

Subsequently, desalting and washing were performed in the usual manner, and the grains were dispersed in an aqueous solution containing 197.4 g of ossein gelatin. Thereafter, distilled water was added to make a total volume of 3,000 ml, whereby emulsion EM-1 was obtained.

A scanning electron micrograph (SEM) of silver halide grains in emulsion EM-1 is shown in FIG. 1, from which one can see that the grains were normal crystals with concave faces. Thus, these grains were silver halide crystals of the type specified by the present invention.

TABLE 1

| Time | Conditions for Grain Growth (EM-1) | | | | | | |
|---|---|---|---|---|---|---|---|
| | | | Rate of addition (ml/min) | | | | |
| (min) | pH | pAg | B-1 | C-1 | D-1 | E-1 | F-1 |
| 0 | 9.00 | 8.40 | | | | | |
| 6.58 | 9.00 | 8.40 | 81.5 | | | 82.8 | |
| 10.13 | 9.00 | 8.40 | 100.1 | | | 101.7 | |
| 15.30 | 9.00 | 8.40 | 123.1 | | | 125.7 | |
| 21.62 | 9.00 | 8.40 | 140.5 | | | 145.2 | |
| 22.07 | 9.00 | 8.40 | | 44.7 | | | 42.8 |
| 24.06 | 8.87 | 8.85 | | 59.2 | | | 52.0 |
| 26.94 | 8.64 | 9.63 | | 197.4 | | | 98.2 |
| 27.11 | 8.62 | 9.71 | | 119.9 | | | 119.3 |
| 29.97 | 8.22 | 9.71 | | 110.4 | | | 109.9 |
| 32.03 | 7.97 | 9.71 | | | 90.1 | | 89.7 |
| 34.92 | 7.70 | 9.71 | | | 68.1 | | 67.8 |
| 37.30 | 7.50 | 9.71 | | | 68.1 | | 67.8 |

Emulsion preparation 2 (Comparative emulsion)

Figure 2:
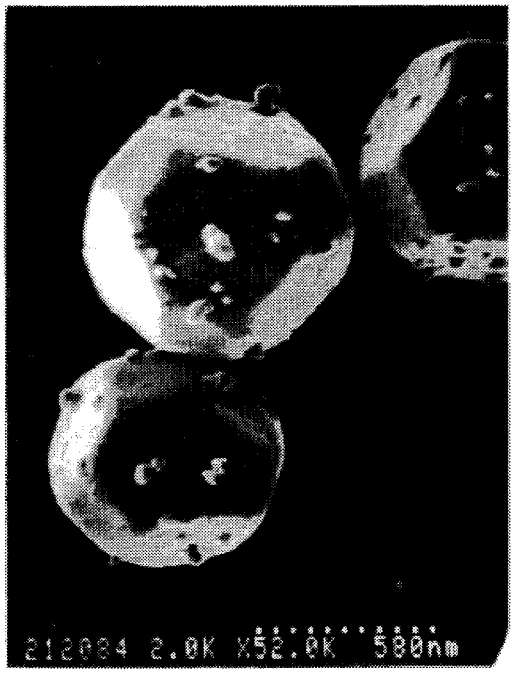
FIG. 2 is a SEM showing the structure of the emulsion EM-2 prepared in Example 1.

Using eight solutions having the same compositions as in Preparation 1 but by changing the conditions of grain growth as shown in Table 2, a silver iodobromide emulsion (comparison) of a core/shell type with the AgI content decreasing as 15 mol %, 5 mol % and 3 mol % from the center outward was prepared. It had an average grain size of 0.65 μm and an average AgI content of 7.16 mol %. This emulsion was designated as EM-1, a SEM of which is shown in FIG. 2.

TABLE 2

| Time | Conditions for Grain Growth (EM-1) | | | | | | |
|---|---|---|---|---|---|---|---|
| | | | Rate of addition (ml/min) | | | | |
| (min) | pH | pAg | B-1 | C-1 | D-1 | E-1 | F-1 |
| 0 | 9.00 | 8.58 | | | | | |
| 6.58 | 9.00 | 8.58 | 81.5 | | | 82.8 | |
| 10.13 | 9.00 | 8.58 | 100.1 | | | 101.7 | |
| 15.30 | 9.00 | 8.58 | 123.1 | | | 125.7 | |
| 21.62 | 9.00 | 8.58 | 140.5 | | | 145.2 | |
| 22.07 | 9.00 | 8.58 | | 44.7 | | | 42.8 |
| 24.06 | 8.87 | 9.05 | | 59.2 | | | 52.0 |
| 26.94 | 8.64 | 9.82 | | 197.4 | | | 98.2 |
| 27.11 | 8.62 | 9.89 | | 119.9 | | | 119.3 |
| 29.97 | 8.22 | 9.89 | | 110.4 | | | 109.9 |
| 32.03 | 7.97 | 9.89 | | | 90.1 | | 89.7 |
| 34.92 | 7.70 | 9.89 | | | 68.1 | | 67.8 |
| 37.30 | 7.50 | 9.89 | | | 68.1 | | 67.8 |

Using EM-1 and EM-2, two samples of photographic material were prepared and their performance was evaluated.

To each of EM-1 and EM-2, sensitizing dyes S-31 and S-32 were added in respective amounts of $1.6\times10^{-4}$ moles and $1.2\times10^{-4}$ moles, and the mixtures were subjected to optimum chemical sensitization with chloroauric acid and sodium thiosulfate. Then, the emulsions were stabilized by addition of TAI and 1-phenyl-5-mercaptotetrazole.

Further, a magenta coupler ($M_4$-4) was dissolved in ethyl acetate and dinonyl phthalate (DNP) and thereafter emulsified in a gelatin-containing aqueous solution. The thus prepared dispersion and customary photographic additives such as a spreading agent and a hardener were added to the emulsions to prepare coating solutions, which were applied to subbed cellulose acetate supports in the usual manner and subsequently dried to prepare two samples of photographic material, Nos. 101 and 102.

Each sample was exposed through an optical wedge in the usual manner and subsequently processed by the following scheme.

| Processing scheme (38° C.) | |
|---|---|
| Color development | 3 min and 15 sec |
| Bleaching | 6 min and 30 sec |
| Washing | 3 min and 15 sec |
| Fixing | 6 min and 30 sec |
| Washing | 3 min and 15 sec |
| Stabilizing | 1 min and 30 sec |
| Drying | |

The processing solutions had the following compositions.

| | |
|---|---|
| Color developer | |
| 4-Amino-3-methyl-N-ethyl-N-(β-hydroxyethyl)-aniline sulfate | 4.75 g |
| Anhydrous sodium sulfite | 4.25 g |
| Hydroxylamine hemisulfate | 2.0 g |
| Anhydrous potassium carbonate | 37.5 g |
| Potassium bromide | 1.3 g |
| Nitrilotriacetic acid trisodium salt (monohydrate) | 2.5 g |
| Potassium hydroxide | 1.0 g |
| Water | to make 1,000 ml |
| Bleaching solution | |
| Ethylenediaminetetraacetic acid iron ammonium salt | 100.0 g |
| Ethylenediaminetetraacetic acid diammonium salt | 10.0 g |
| Potassium bromide | 150.0 g |
| Glacial acetic acid | 10.0 g |
| Water | to make 1,000 ml |
| pH adjusted to 6.0 with aqueous ammonia | |
| Fixing solution | |
| Ammonium thiosulfate | 175.0 g |
| Anhydrous ammonium sulfite | 8.6 g |
| Sodium metasulfite | 2.3 g |
| Water | to make 1,000 ml |
| pH adjusted to 6.0 with acetic acid | |
| Stabilizing solution | |
| Formaldehyde (37% aq. sol.) | 1.5 ml |
| Konidax (Konica Corp.) | 7.5 ml |
| Water | to make 1,000 ml |

The sensitivity and keeping quality of these samples were evaluated and the results were as shown in Table 3.

The sensitivity was the reciprocal of the amount of exposure necessary to provide a density of (fog+0.1) on the constructed characteristic curve, and it was expressed in terms of relative values, with the sensitivity of sample No. 102 being taken as 100.

TABLE 3

| Sample No. | Emulsion | Crystal face | Relative sensitivity | Keeping quality* |
|---|---|---|---|---|
| 101 | EM-1 | Concave faces observed | 139 | 48 |
| 102 (comparison) | EM-2 | Concave faces not observed | 100 | 100 |

*Keeping quality: Shown in relative value against the variation that occurred in sensitivity of sample No. 102 from the initial value upon standing at 40° C. × 80% r.h. for 7 days. The smaller the value of variation, the better the keeping quality.

As is clear from Table 3, sample No. 101 using emulsion EM-1 which contained the silver halide grains of the present invention had higher sensitivity and better keeping quality than comparative sample No. 102.

When the combination of sensitizing dyes S-31 and S-32 used in EM-1 and EM-2 was changed to that of S-27/S-48, S-37/S-33 or S-29/S-34, sample No. 101 of the present invention also exhibited high sensitivity and good keeping quality.

The advantages of the present invention were also attained even when coupler $M_4$-4 was changed to M-14, M-15 or M-18 while maintaining the combination of S-31 and S-32.

The amount of the hardener in sample No. 101 was changed in such a way that the degree of film swelling upon development would be 220% or 250%. The performance of the so prepared samples was evaluated as in the case of sample No. 1C1 and the advantages of the present invention were demonstrated.

Two additional samples were prepared in the same way as sample No. 101 except that they were wrapped at relative humidities of 50% and 40%, respectively, and stored for 3 months. The performance of these samples was evaluated as in the case of sample No. 101 and the advantages of the present invention were demonstrated.

Example 2

Comparative emulsion EM-3, emulsion of the present invention EM-4 and another comparative emulsion EM-5 were prepared as described below.

Emulsion preparation 3 (Comparative emulsion)

Using seven solutions having the compositions shown below, a silver iodobromide emulsion of a core/shell type with the AgI content decreasing as 15 mol %, 5 mol % and 3 mol % from the center outward was prepared. It had an average grain size of 0.38 μm and an average AgI content of 8.46 mol %.

| | |
|---|---|
| Solution A-2 | |
| Ossein gelatin | 28.6 g |
| Pronon (10% sol. in ethanol) | 16.5 ml |
| TAI | 247.5 mg |
| 56% Aqueous acetic acid solution | 72.6 ml |
| 28% Aqueous ammonia solution | 97.2 ml |
| Seed emulsion N-1 | equivalent to 0.1552 mol AgX |
| Distilled water | to make 6,600 ml |
| Solution B-2 | |
| Ossein gelatin | 13 g |
| KBr | 460.2 g |
| KI | 113.3 g |
| TAI | 665 mg |
| Distilled water | to make 1,300 ml |
| Solution C-2 | |
| Ossein gelatin | 17 g |
| KBr | 672.6 g |
| KI | 49.39 g |
| TAI | 870 mg |
| Distilled water | to make 1,700 ml |
| Solution D-2 | |
| Ossein gelatin | 8 g |
| KBr | 323.2 g |
| KI | 13.94 g |
| TAI | 409 mg |
| Distilled water | to make 800 ml |

-continued

| | |
|---|---|
| Solution E-2 | |
| $AgNO_3$ | 1,773.6 g |
| 28% Aqueous ammonia | 1,470 ml |
| Distilled water | to make 2,983 ml |
| Solution F-2 | |
| 28% Aqueous KBr ammonia | q.s. to adjust pAg |
| Solution G-2 | |
| 56% Aqueous acetic acid solution | q.s. to adjust pAg |

Solution E-2 and solution B-2 were added to solution A-2 by double-jet precipitation at 40° C. using a mixer-stirrer of the same type as used in Preparation 1. Simultaneously with the completion of the addition of solution B-2, solution C-2 was added, and simultaneously with the completion of the addition of C-2, solution D-2 was added. During the double-jet precipitation, the pAg and pH were controlled as shown in Table 4, and the rates of addition of solutions E-2, B-2, C-2 and D-2 were also controlled as shown in Table 4.

Control over pAg and pH was effected with a variable-flow roller tube pump by adjusting the flow rates of solutions E-2 and G-2.

Following the completion of the addition of solution E-2, pH and pAg adjustments, desalting, washing and re-dispersion were performed as in Preparation 1. The so prepared emulsion was designated EM-3.

TABLE 4

| Conditions for Grain Growth (EM-3) | | | | | | |
|---|---|---|---|---|---|---|
| Time | | | Rate of addition (ml/min) | | | |
| (min) | pH | pAg | E-2 | B-2 | C-2 | D-2 |
| 0 | 8.97 | 8.55 | 9.8 | 9.3 | | |
| 7.85 | 8.78 | 8.55 | 30.7 | 29.2 | | |
| 11.80 | 8.60 | 8.55 | 44.9 | 42.7 | | |
| 17.33 | 8.22 | 8.55 | 61.4 | 58.4 | | |
| 19.23 | 8.07 | 8.55 | 63.5 | 60.4 | | |
| 22.19 | 7.85 | 8.55 | 56.8 | 53.8 | | |
| 28.33 | 7.47 | 8.55 | 41.2 | 39.8 | 39.8 | |
| 36.61 | 7.47 | 9.38 | 31.9 | | 34.1 | |
| 40.44 | 7.47 | 9.71 | 30.6 | | 37.1 | |
| 45.14 | 7.47 | 10.12 | 34.6 | | 57.8 | |
| 45.97 | 7.47 | 10.20 | 37.3 | | 36.3 | |
| 57.61 | 7.47 | 10.20 | 57.3 | | 55.8 | 55.8 |
| 63.08 | 7.47 | 10.20 | 75.1 | | | 73.1 |
| 66.63 | 7.47 | 10.20 | 94.0 | | | 91.4 |

Examination by electron microscopy showed that EM-3 had an average grain size of 0.38 μm and that the grains had no concave faces.

Emulsion preparation 4

Using seven solutions having the compositions shown below, an emulsion containing the silver halide grains of the present invention was prepared. This emulsion, designated as EM-4, comprised silver iodobromide grains of a core/shell type having on average grain size of 0.38 μm and an average AgI content of 8.46 mol %.

| | |
|---|---|
| Solution A-3 | |
| Ossein gelatin | 10.2 g |
| 10% Ethanol solution of Pronon (Nippon Oils & Fats Co., Ltd.) having an average molecular weight of 1,700 | 11.0 ml |
| $HO(CH_2CH_2O)_m(CH(CH_3)CH_2O)_p(CH_2CH_2O)_nH$ | |
| Distilled water | 3,646 cc |
| Solution B-3 | |
| Seed emulsion N-1 | equivalent of 0.1552 mol AgX |
| TAI | 165 mg |
| 56% Aqueous acetic acid solution | 48.4 ml |
| 28% Aqueous ammonia | 64.8 ml |
| Distilled water | to make 750 ml |
| Solution C-3 | |
| $AgNO_3$ | 124.2 g |
| 28% Aqueous ammonia | 1,013 ml |
| Distilled water | to make 1,820 ml |
| Solution D-3 | |
| Ossein gelatin | 40 g |
| KBr | 1,666 g |
| TAI | 3.38 g |
| Distilled water | to make 5,000 ml |
| Solution E-3 | |
| 20% Aqueous KBr solution | q.s. to adjust pAg |
| Solution F-3 | |
| 56% Aqueous acetic acid solution | q.s. to adjust pH |
| Solution G-3 | |
| Fine AgI grains with an average size of 0.05 μm | equivalent to 0.5885 mol AgX |
| Distilled water | to make 820 ml |

Using a mixer-stirrer of the same type as used in Preparation 1, solution B-3 was added to solution A-3 at 40° C., and subsequently, solutions C-3, D-3 and G-3 were added by double-jet precipitation, with pAg, pH and the flow rates of solutions C-3, D-3 and G-3 being controlled as shown in Table 5.

Control over pAg and pH during the double-jet precipitation was effected with a variable-flow roller tube pump by adjusting the flow rates of solutions E-3 and F-3.

Two minutes after the completion of the addition of solution C-3, solution E-3 was added to adjust the pAg to 10.4. Two more minutes later, solution F-3 was added to adjust the pH to 6.0. Thereafter, pH and pAg adjustments, desalting, washing and re-dispersion were performed as in Preparation 1. The so prepared emulsion was designated EM-4. Examination by electron microscopy showed that EM-4 had an average grain size of 0.38 μm and that it was comprised of grains laving concave faces. Hence, this emulsion was within the scope of the present invention.

TABLE 5

| Conditions for Grain Growth (EM-4) | | | | | |
|---|---|---|---|---|---|
| Time | | | Rate of addition (ml/min) | | |
| (min) | pH | pAg | C-3 | D-3 | G-3 |
| 0 | 9.0 | 8.77 | 2.6 | 2.5 | |
| 5.52 | 9.0 | 8.77 | 2.4 | 2.3 | 115.0 |
| 6.86 | 9.0 | 8.77 | 1.5 | 1.4 | 70.1 |
| 8.57 | 9.0 | 8.77 | 1.6 | 1.5 | 74.5 |

TABLE 5-continued

| Conditions for Grain Growth (EM-4) | | | | | |
|---|---|---|---|---|---|
| Time | | | Rate of addition (ml/min) | | |
| (min) | pH | pAg | C-3 | D-3 | G-3 |
| 11.71 | 9.0 | 8.77 | 1.7 | 1.7 | 83.5 |
| 14.53 | 9.0 | 8.77 | 1.9 | 1.8 | 92.5 |
| 15.83 | 9.0 | 8.77 | 2.0 | 1.9 | 97.0 |
| 20.51 | 9.0 | 8.77 | 2.4 | 2.3 | |
| 33.05 | 9.0 | 8.77 | 3.9 | 3.7 | |
| 58.88 | 9.0 | 8.77 | 11.5 | 10.6 | |
| 64.95 | 9.0 | 8.77 | 14.9 | 14.4 | |
| 73.89 | 9.0 | 9.06 | 12.9 | 12.6 | |
| 83.14 | 9.0 | 9.39 | 17.9 | 18.2 | |
| 89.76 | 8.92 | 9.72 | 24.5 | 26.9 | |
| 93.29 | 8.83 | 9.96 | 33.8 | 41.1 | |
| 69.39 | 8.75 | 10.20 | 30.5 | 29.7 | |
| 117.77 | 8.03 | 10.20 | 46.6 | 45.3 | |
| 118.62 | 8.00 | 10.20 | 46.9 | 45.6 | |

Emulsion preparation (Comparative emulsion)

Using seven solutions having the same compositions as in Preparation 4 but by changing the conditions of grain growth as shows in Table 6, a silver iodobromide emulsion (comparison) of a core/shell type having an average grain size of 0.38 μm and all average AgI content of 8.46 mol % was prepared. This emulsion was designated as EM-5.

TABLE 6

| Time | Conditions for Grain Growth (EM-5) | | | | |
|---|---|---|---|---|---|
| | | | Rate of addition (ml/min) | | |
| (min) | pH | pAg | C-3 | D-3 | G-3 |
| 0 | 9.00 | 8.50 | 6.5 | 6.2 | |
| 2.06 | 8.97 | 8.50 | 9.2 | 8.5 | 2.2 |
| 4.28 | 8.92 | 8.50 | 12.7 | 12.8 | 30.9 |
| 8.08 | 8.79 | 8.50 | 21.1 | 20.2 | 50.9 |
| 12.10 | 8.59 | 8.50 | 30.4 | 27.3 | 74.5 |
| 14.00 | 8.48 | 8.50 | 34.8 | 30.6 | 85.3 |
| 15.25 | 8.40 | 8.50 | 37.3 | 32.8 | 70.3 |
| 17.60 | 8.22 | 8.50 | 41.1 | 36.8 | 10.0 |
| 19.55 | 8.07 | 8.50 | 41.9 | 39.9 | |
| 28.37 | 7.50 | 8.50 | 27.3 | 30.6 | |
| 33.75 | 7.50 | 9.00 | 22.7 | 25.4 | |
| 38.93 | 7.50 | 9.48 | 20.5 | 23.1 | |
| 42.62 | 7.50 | 9.79 | 20.6 | 32.5 | |
| 45.69 | 7.50 | 10.06 | 23.4 | 40.3 | |
| 46.02 | 7.50 | 10.09 | 23.8 | 24.2 | |
| 54.91 | 7.50 | 10.09 | 33.9 | 35.0 | |
| 60.31 | 7.50 | 10.09 | 40.1 | 42.2 | |
| 65.70 | 7.50 | 10.09 | 58.6 | 57.0 | |
| 66.72 | 7.50 | 10.09 | 58.6 | 57.0 | |

Examination by electronmicroscopy showed that EM-5 had an average grain size of 0.38 μm and that the grains had no concave faces.

Using EM-3, EM-4 and EM-5, three samples of photographic material were prepared and their performance was evaluated.

To each of EM-3, EM-4 and EM-5, sensitizing dyes S-27 and S-48 were added in respective amounts of $7.6\times10^{-4}$ moles and $8.7\times10^{-5}$ moles, and the mixtures were subjected to optimum chemical sensitization with chloroauric acid and sodium thiosulfate. Then, the emulsions were stabilized by addition of TAI and 1-phenyl-5mercaptotetrazole.

Further, a magenta coupler ($M_4$-4) was dissolved in ethyl acetate and dinonyl phthalate (DNP) and thereafter emulsified in a gelatin-containing aqueous solution. The thus prepared dispersion and customary photographic additives such as a spreading agent and a hardener were added to the emulsions to prepare coating solutions, which were applied to subbed cellulose acetate supports in the usual manner and subsequently dried to prepare three samples of photographic material, Nos. 201–203.

Each sample was exposed through an optical wedge in the usual manner and subsequently processed as in Example 1. The results of evaluation of the sensitivity and keeping quality of the samples are shown in Table 7. As in Table 3, the data for sensitivity and keeping quality is expressed in terms of relative values, with those for sample No. 201 being taken as 100.

TABLE 7

| Sample No. | Emulsion | Crystal face | Relative sensitivity | Keeping quality |
|---|---|---|---|---|
| 201 (comparison) | EM-3 | Concave faces not observed | 100 | 100 |
| 202 (invension) | EM-4 | Concave faces observed | 161 | 43 |
| 203 (comparison) | EM-5 | Concave faces not observed | 109 | 91 |

As is clear from Table 7, sample No. 202 using emulsion EM-4 containing the silver halide grains of the present invention had higher sensitivity and better keeping quality than comparative sample Nos. 201 and 203.

Example 3

An emulsion EM-6 that was within the scope of the present invention and a comparative emulsion EM-7 were prepared as described below.

Emulsion preparation 6

Using seven solutions having the compositions described below, EM-6 within the scope of the present invention was prepared.

| | |
|---|---|
| Solution A-4 | |
| Ossein gelatin | 22.5 g |
| Distilled water | 6,884 ml |
| Polyisopropylene-polypropyleneoxy-discuccinic acid ester sodium salt (10% sol. in ethanol) | 20 ml |
| TAI | 646 mg |
| 28% Aqueous ammonia | 469 ml |
| 56% Aqueous acetic acid solution | 258 ml |
| Seed emulsion (N-3) | equivalent to 0.8828 mol AgX |
| Solution B-4 | |
| Ossein gelatin | 24 g |
| KBr | 848 g |
| KI | 209 g |
| TAI | 2,560 mg |
| Distilled water | 1,978 ml |
| Solution C-4 | |
| Ossein gelatin | 24 g |
| KBr | 948 g |
| KI | 69.7 g |
| TAI | 2,560 mg |
| Distilled water | 1,978 ml |
| Solution D-4 | |
| Ossein gelatin | 40 g |
| KBr | 1,660 g |
| KI | 6.97 g |
| TAI | 4,268 mg |
| Distilled water | 3,296 ml |
| Solution E-4 | |
| $AgNO_3$ | 1,109 g |
| 28% Aqueous ammonia | 904 ml |
| Distilled water | to make 1,866 ml |
| Solution F-4 | |
| 50% Aqueous KBr solution | q.s. to adjust pAg |
| Solution G-4 | |
| 56% Aqueous acetic acid solution | q.s. to adjust pH |

Solution E-4 and solution B-4 were added to solution A-4 by double-jet precipitation at 50° C. over a period of 46.6 min using a stirrer-mixer of the same type as used in Example 1. Simultaneously with the completion of the addition of solution B-4, solution C-4 was added and, 35.9 min later, the addition of C-4 was completed, whereupon the addition of solution D-4 was started and completed after 25.5 min. During the double-jet precipitation, the pAg and pH were controlled as shown in Table 8, and the rates of addition of solutions E-4, B-4, C-4 and D-4 were also controlled as shown in Table 8.

Control over pAg and pH was effected with a variable-flow roller tube pump by adjusting the flow rates of solutions F-4 and G-4. Two minutes after the completion of the addition of solution E-4, solution F-4 was added to adjust the pAg to 10.4, and after 2 more minutes, solution G-4 was added to adjust the pH to 6.0.

Subsequently, desalting and washing were performed in the usual manner, and the grains were dispersed in an aqueous solution containing 127 g of ossein gelatin. Thereafter, distilled water was added to make a total volume of 3,000 ml, whereby emulsion EM-6 was obtained.

Examination by electron microscopy showed that this emulsion had an average grain size of 1.60 μm and that it contained the silver halide grains of the present invention which had concave faces.

The thus prepared emulsion EM-6 was a silver iodobromide emulsion of a core/shell type in which the AgI content decreased as 15 mol %, 5 mol % and 0.3 mol % from the center outward.

TABLE 8

| Conditions for Grain Growth (EM-6) | | | | | | |
|---|---|---|---|---|---|---|
| Time | | | Rate of addition (mllmin) | | | |
| (min) | pH | pAg | E-4 | B-4 | C-4 | D-4 |
| 0.00 | 9.00 | 8.70 | 7.07 | 7.00 | | |
| 18.00 | 9.00 | 8.70 | 8.89 | 8.80 | | |
| 27.00 | 9.00 | 8.70 | 9.75 | 9.65 | | |
| 36.00 | 9.00 | 8.70 | 10.55 | 10.45 | | |
| 45.00 | 9.00 | 8.70 | 11.29 | 11.18 | | |
| 46.60 | 9.00 | 8.70 | 11.51 | 11.40 | 11.40 | |
| 54.80 | 8.85 | 8.93 | 16.44 | | 18.12 | |
| 63.05 | 8.66 | 9.30 | 21.33 | | 24.73 | |
| 72.05 | 8.31 | 9.96 | 32.84 | | 60.87 | |
| 75.50 | 8.21 | 10.19 | 25.31 | | 54.69 | |
| 82.50 | 8.04 | 10.20 | 24.12 | | 23.88 | 23.88 |
| 90.06 | 7.85 | 10.20 | 21.89 | | | 21.67 |
| 99.08 | 7.66 | 10.20 | 20.13 | | | 19.93 |
| 108.00 | 7.50 | 10.20 | 19.25 | | | 19.06 |

Emulsion preparation 7 (Comparative emulsion)

Using seven solutions having the compositions shown below, a silver iodobromide emulsion EM-7 (comparison) was prepared.

| | |
|---|---|
| Solution A-5 | |
| Same as solution A-4. | |
| Solution B-5 | |
| Ossein gelatin | 24 g |
| KBr | 978 g |
| KI | 27.8 g |
| TAI | 2,560 mg |
| Distilled water | 1,978 ml |
| Solution C-5 | |
| Ossein gelatin | 24 g |
| KBr | 978 g |
| KI | 27.8 g |
| TAI | 2,560 mg |
| Distilled water | 1,978 ml |
| Solution D-5 | |
| Ossein gelatin | 40 g |
| KBr | 1,632 g |
| KI | 46.5 g |
| TAI | 4,268 mg |

-continued

| | |
|---|---|
| Distilled water | 3,296 ml |
| Solution E-5 | |
| Same as solution E-4. | |
| Solution F-5 | |
| 50% Aqueous KBr solution | q.s. to adjust pAg |
| Solution G-5 | |
| 56% Aqueous acetic acid solution | q.s. to adjust pH |

Using these solutions, an emulsion was prepared at 50° C. as in Preparation 6, with the stirrer-mixer being of the same type as used in Preparation 1.

Examination by electronmicroscopy showed that this emulsion, designated EM-7, contained silver halide grains with an average size of 1.60 μm that and only flat crystal faces. This emulsion had a uniform composition of AgBrI with a AgI content of 2 mol % in the bulk.

Each of the emulsions EM-6 and EM-7 was subjected to optimum chemical sensitization with chloroauric acid and sodium thiosulfate, and then spectrally sensitized for the red region by adding sensitizing dyes S-57 and S-58 in respective amounts of $5\times10^{-5}$ moles and $1.7\times10^{-5}$ moles per mole of silver halide. Subsequently, the emulsions were stabilized by addition of TAI and 1-phenyl-5mercaptotetrazole.

Further, a cyan coupler (C-8) and a BAR compound (BAR-22) were dissolved in ethyl acetate and DNP and thereafter emulsified in a gelatin-containing aqueous solution. The thus prepared dispersion and customary photographic additives such as a spreading agent and a hardener were added to the emulsions to prepare coating solutions, which were applied to subbed cellulose acetate supports in the usual manner and subsequently dried to prepare three samples of photographic material, Nos. 301– 303. The amounts of cyan coupler and BAR compound added per mole of silver halide are shown in Table 9.

Each of these samples was exposed through an optical wedge in the usual manner and subsequently processed as in Example 1. The results of evaluation of the sensitivity and keeping quality of the samples are shown in Table 9. As in Table 3, the data for sensitivity and keeping quality is expressed in terms of relative values, with those for sample No. 301 being taken as 100.

TABLE 9

| Sample No. | Emulsion | Crystal face | Amount of C-1 (mol/mol Ag) | Amount of BAR-22 (mol/mol Ag) | Relative sensitivity | Keeping quality |
|---|---|---|---|---|---|---|
| 301 (comparison) | EM-7 | Concave faces not observed | 0.02 | 0.01 | 100 | 100 |
| 302 | EM-6 | Concave faces observed | 0.02 | 0.01 | 131 | 72 |
| 303 | EM-6 | Concave faces observed | 0.02 | 0 | 126 | 71 |

As is clear from Table 9, sample Nos. 302 and 303 using EM-6 containing the silver halide grains of the present invention had higher sensitivity and better keeping quality than comparative sample No. 301.

When the combination of sensitizing dyes S-57 and S-58 used in EM-6 and EM-7 was changed to that of S-67/S-57/S-58, sample No. 302 of the present invention also exhibited high sensitivity and good keeping quality.

The advantages of the present invention were also attained even when coupler C-8 was changed to C-1, C-4 or C-19 while maintaining the combination of S-57 and S-58.

When SS-2 was added to each of sample Nos. 301–303 in an amount of $5\times10^{-6}$ moles/mol AgX, sample Nos. 302 and 303 of the present invention achieved higher sensitivity than sample No. 301 without deterioration in the keeping quality.

When DSR-17 was added to each of sample Nos. 301–303 in an amount of $6\times10^{-3}$ moles/mol AgX, the advantages of the present invention were attained, with marked improvements in sensitivity and keeping quality.

Similar results were attained even when DSR-17 was replaced by DSR-26, DSR-27 or DSR-34.

Example 4

Preparation of sample No. 401 (comparison)

Using a subbed cellulose acetate film as a support, sample No. 401 of multi-layer color photographic material having the layer arrangement shown below was prepared.

The coating weights of silver halides and colloidal silver are expressed in grams per square meter in terms of silver; the coating weights of additives and gelatin are expressed in grams per square meter; and the coating weights of sensitizing dyes, coupler and DIR compounds are expressed in numbers of mole per mole of silver halide in the same layer.

The emulsion contained ill each of the red-, green- and blue-sensitive layers was subjected to optimum sensitization with sodium thiosulfate and chloroauric acid.

| Layer | Main ingredients | Amount |
|---|---|---|
| First layer (HC) | Black colloidal silver | 0.20 |
| Antihalation layer | Gelatin | 1.5 |
| | UV absorber (UV-1) | 0.1 |
| | UV absorber (UV-2) | 0.2 |
| | Dioctyl phthalate (DOP) | 0.03 |
| Second layer (IL-1) | Gelatin | 2.0 |
| Intermediate layer | Antistain agent (AS-1) | 0.1 |
| | DOP | 0.1 |
| Third layer (R-1) | EM-5 | 1.2 |

-continued

| Layer | Main ingredients | Amount |
|---|---|---|
| First red-sensitive emulsion layer | Gelatin | 1.1 |
| | Sensitizing dye (S-57) | $3\times10^{-4}$ |
| | Sensitizing dye (S-67) | $3\times10^{-4}$ |
| | Sensitizing dye (S-58) | $1\times10^{-4}$ |
| | Coupler (C4-20) | 0.06 |
| | Coupler (CC-1) | 0.003 |
| | DIR compound (D-23) | 0.0015 |
| | DIR compound (D-25) | 0.002 |
| | DOP | 0.6 |
| Fourth layer (R-2) | EM-2 | 1.0 |
| Second red-sensitive emulsion layer | Gelatin | 1.1 |
| | Sensitizing dye (S-57) | $3\times10^{-4}$ |
| | Sensitizing dye (S-67) | $1\times10^{-4}$ |
| | Coupler ($C_4$-20) | 0.03 |
| | DOP | 0.2 |
| | DIR compound (D-25) | 0.001 |
| Fifth layer (IL-2) | Gelatin | 0.8 |
| Intermediate layer | AS-1 | 0.03 |
| | DOP | 0.1 |
| Sixth layer (G-1) | EM-6 | 1.1 |
| First green-sensitive emulsion layer | Gelatin | 1.2 |
| | Sensitizing dye (S-27) | $7.6\times10^{-4}$ |
| | Sensitizing dye (S-48) | $8.7\times10^{-5}$ |
| | Coupler (M-15) | 0.045 |
| | Coupler (CM-1) | 0.009 |
| | DIR compound (D-23) | 0.001 |
| | DIR compound (D-26) | 0.003 |
| | Tricresyl phosphate (TCP) | 0.5 |
| Seventh layer (G-2) | EM-2 | 1.3 |
| Second green-sensitive emulsion layer | Gelatin | 0.8 |
| | Sensitizing dye (S-31) | $1.6\times10^{-4}$ |
| | Sensitizing dye (S-32) | $1.2\times10^{-4}$ |
| | Coupler (M4-4) | 0.03 |
| | DIR compound (D-26) | 0.01 |
| | TCP | 0.3 |
| Eighth layer (YC) | Gelatin | 0.6 |
| Yellow filter layer | Yellow colloidal silver | 0.08 |
| | AS-1 | 0.1 |
| | DOP | 0.3 |
| Ninth layer (B-1) | EM-5 | 0.5 |
| First blue-sensitive emulsion layer | Gelatin | 1.1 |
| | Sensitizing dye (S-6) | $1.3\times10^{-4}$ |
| | Coupler (Y-5) | 0.29 |
| | TCP | 0.2 |
| Tenth layer (B-2) | EM-2 | 0.7 |
| Second blue-sensitive emulsion layer | Gelatin | 1.2 |
| | Sensitizing dye (S-15) | $1\times10^{-4}$ |
| | Coupler (Y-5) | 0.08 |
| | DIR compound (D-25) | 0.0015 |
| | TCP | 0.1 |
| Eleventh layer (Pro-1) | Gelatin | 0.55 |
| First protective layer | UV absorber (UV-1) | 0.1 |
| | UV absorber (UV-2) | 0.2 |
| | DOP | 0.03 |
| | Silver iodobromide (1 mol % AgI; average | 0.5 |

-continued

| Layer | Main ingredients | Amount |
|---|---|---|
| | grain size, 0.07 μm) | |
| Twelfth layer (Pro-2) | Gelatin | 0.5 |
| Second protective layer | Polymethyl methacrylate particles (1.5 μm$^{\varnothing}$) | 0.2 |
| | Formaldehyde scavenger (HS-1) | 3.0 |
| | Hardener (H-1) | 0.4 |

Besides the ingredients described above, a surfactant was added as a coating aid to each layer.

CC-1

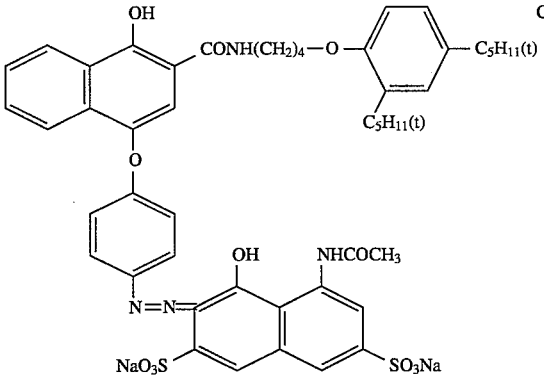

CM-1

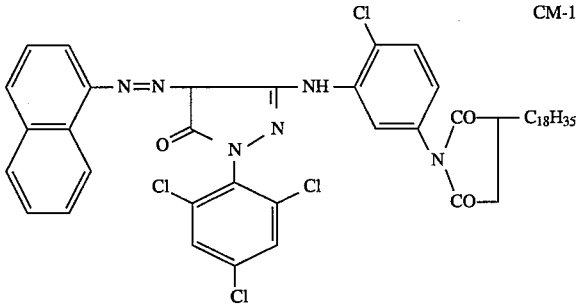

UV-1

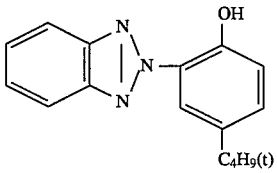

UV-2

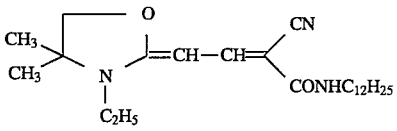

HS-1

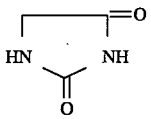

H-1

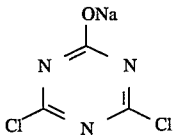

-continued

AS-1

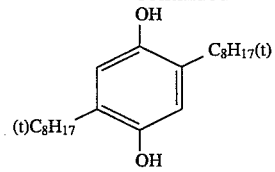

Preparation of sample No. 402 (of the present invention)

Sample No. 402 was prepared as in the case of sample No. 401 except that comparative emulsion EM-5 in the third, sixth and ninth layers was replaced by emulsion EM-4 of the present invention and that comparative emulsion EM-2 in the fourth, seventh and tenth layers was replaced by emulsion EM-1 of the present invention.

Each of sample Nos. 4-1 and 402 was exposed through an optical wedge in the usual manner and subsequently processed. The sensitivity and keeping quality of the blue-sensitive and green-sensitive layers were evaluated as in Example 1. The results are shown in Table 10. As in Table 3, the data on sensitivity and keeping quality is expressed in terms of relative values, with the those for the blue- and green-sensitive layers in sample No. 401 being taken as 100.

TABLE 10

| | Blue-sensitive layer | | Green-sensitive layer | |
|---|---|---|---|---|
| Sample No. | Relative sensitivity | Keeping quality | Relative sensitivity | Keeping quality |
| 401 (comparison) | 100 | 100 | 100 | 100 |
| 402 | 165 | 45 | 170 | 50 |

As is clear from Table 10, sample No. 402 of multilayer color photographic material using emulsions EM-1 and EM-4 of the present invention had satisfactory sensitivity and keeping quality.

Even when coupler Y-5 was changed to Y-1, Y-2, Y-6 or Y-11, the blue-sensitive layers in sample No. 402 of the present invention had higher sensitivity than comparative sample No. 401 and they also has good keeping quality.

Two additional samples were prepared as in the case of sample No. 402 except that the gelatin content of each layer was so adjusted as to reduce the dry thickness of the film to 15 μm or 13 μm. Evaluation of the sensitivity and keeping quality of these samples showed that the intended improvements were also achieved.

Two more samples, Nos. 403 and 404, were prepared by repeating the procedures for preparation of sample Nos. 401 and 402, except that the amounts of silver halide emulsions in the respective layers were so adjusted that the content of light-sensitive silver halide grains in all emulsion layers (as expressed in terms of silver) would decrease to 3.5 g/m$^2$.

Evaluation of the sensitivity and keeping quality of these samples showed that sample No. 404 of the present invention obviously achieved greater sensitization than comparative sample No. 403.

Sample Nos. 401 and 402 were exposed to white light through an optical wedge and subsequently processed by the following "rapid" scheme for evaluation of their relative sensitivity.

| Steps | | Time |
|---|---|---|
| Color development | (40° C.) | 1 min |
| Bleach-fixing | (38° C.) | 4 min |
| Washing | (20–33° C.) | 1 min |
| Stabilizing | (20–33° C.) | 30 sec |
| Drying | | |

The processing solutions had the following compositions.

| Color developer | |
|---|---|
| Sulfate salt of compound E-2 (see below) | 5.0 g |
| Anhydrous sodium sulfite | 4.25 g |
| Hydroxylamine hemisulfate | 2.0 g |
| Compound (1) represented by the general formula (IS) | 10.0 g |
| Anhydrous potassium carbonate | 30.0 g |
| Sodium bromide | 1.3 g |
| Nitrilotriacetic acid trisodium salt (monohydrate) | 2.5 g |
| Potassium hydroxide | 1.0 g |
| Water | to make 1,000 ml |

(E-2)

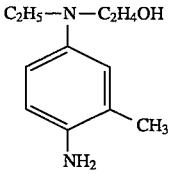

| Bleach-fixing solution | |
|---|---|
| Ethylenediaminetetraacetic acid iron ammonium salt | 200.0 g |
| Ethylenediaminetetraacetic acid diammonium salt | 2.0 g |
| Aqucous ammonia (28% aq. sol.) | 20.0 g |
| Ammonium thiosulfate | 175.0 g |
| Anhydrous sodium sulfite | 8.5 g |
| Sodium metasulfite | 2.3 g |
| 2-Amino-5-mercapto-1,3,4-thiadiazole | 1.5 g |
| Water | to make 1,000 ml |
| pH adjusted to 6.6 with acetic acid and aqueous ammonia | |
| Washing liquid | |
| Tap water | |
| Stabilizing solution | |
| Formaldehyde (37% aq. sol.) | 1.5 ml |
| Konidax (Konica Corp.) | 7.5 ml |
| Water | to make 1,000 ml |

The time of color development was set to be 60 seconds. The sensitivity of the green-sensitive layers is shown in Table 11 in terms of relative value, with the value for comparative sample No. 401 being taken as 100.

TABLE 11

| Sample | Relative sensitivity |
|---|---|
| 401 (comparison) | 100 |
| 402 | 175 |

As is clear from Table 11, sample No. 402 using emulsions EM-1 and EM-4 of the present invention had high sensitivity even when it was subjected to rapid photographic processing.

Example 5

To each of emulsions EM-1 and EM-2, sensitizing dye S-15 was added in an amount of $1.6\times10^{-4}$ moles per mole of silver halide, and the mixture was subjected to optimum chemical sensitization with chloroauric acid and sodium thiosulfate. Then, the emulsions were stabilized by addition of TAI and 1-phenyl-5-mercaptotetrazole.

Further, a dispersion in a gelatin-containing aqueous solution and customary photographic additives such as a spreading agent and a hardener were added to the emulsions to prepare coating solutions, which were applied to subbed cellulose acetate supports in the usual manner and subsequently dried to prepare two samples of photographic material, Nos. 501 and 502.

Each sample was exposed through a yellow filter and an optical wedge. The exposed samples were processed for 90 sec with all automatic processor Model KX-500 of Konica Corp according to the scheme shown below, and their sensitivity was determined.

| Steps (35° C.) | |
|---|---|
| Development | 25 sec |
| Fixing | 25 sec |
| Washing | 25 sec |
| Drying | 15 sec |

The processing solutions had the following compositions.

| Developer | |
|---|---|
| Potassium sulfite | 55.0 g |
| Hydroquinone | 25.0 g |
| 1-Phenyl-3-pyrazolidone | 1.2 g |
| Boric acid | 10.0 g |
| Sodium hydroxide | 21.0 g |
| Triethylene glycol | 17.5 g |
| 5-Methylbenzotriazole | 0.07 g |
| 5-Nitroindazole | 0.14 g |
| 1-Phenyl-5-mercaptotetrazole | 0.015 g |
| Glutaraldehyde bisulfite | 15.0 g |
| Glacial acetic acid | 16.0 g |
| Potassium bromide | 4.0 g |
| Triethylenetetraaminehexaacetic acid | 2.5 g |
| Water | to make 1,000 ml |
| pH adjusted to 10.20 | |
| Fixing solution | |
| Ethylenediaminetetraacetic acid disodium salt | 5.0 g |
| Tartaric acid | 3.0 g |
| Ammonium thiosulfate | 130.9 g |
| Anhydrous sodium sulfite | 7.3 g |
| Boric acid | 7.0 g |
| Acetic acid (90 wt %) | 5.5 g |
| Sodium acetate trihydrate | 25.8 g |
| Aluminum sulfate (18 $H_2O$) | 14.6 g |
| Sulfuric acid (50 wt %) | 6.77 g |
| Water | to make 1,000 ml |
| pH adjusted to 4.20 | |

The results are shown in Table 12.

TABLE 12

| Sample No. | Emulsion | Crystal face | Sensitivity | Keeping quality |
|---|---|---|---|---|
| 501 | EM-1 | Concave faces observed | 128 | 58 |
| 502 (comparison) | EM-2 | Concave faces not observed | 100 | 100 |

As is clear from Table 12, sample No. 501 using emulsion EM-1 containing the silver halide grains of the present invention exhibited better sensitivity and keeping quality than comparative sample No. 502 although the improvement was not as great as in the case where it was subjected to color development.

Example 6

Sample Nos. 601 and 602 were prepared by coating the following layers successively on a support.

| | |
|---|---|
| First layer: | Anti-halation layer |
| Second layer: | Intermediate layer |
| Third layer: | Less red-sensitive emulsion layer |
| Fourth layer: | Intermediate layer |
| Fifth layer: | Less green-sensitive emulsion layer |
| Sixth layer: | Intermediate layer |
| Seventh layer: | Less blue-sensitive emulsion layer |
| Eighth layer: | Intermediate layer |
| Ninth layer: | Highly red-sensitive emulsion layer |
| Tenth layer: | Intermediate layer |
| Eleventh layer: | Highly green-sensitive emulsion layer |
| Twelfth layer: | Intermediate layer |
| Thirteenth layer: | Highly blue-sensitive emulsion layer |
| Fourteenth layer: | First protective layer |
| Fifteenth layer: | Second protective layer |

The third, fifth, seventh, ninth, eleventh and thirteenth layers in sample No. 601 (or 602) had the same compositions as the third, sixth, ninth, fourth, seventh and tenth layers, respectively, in sample No. 401 (or 402) of Example 4. In addition, the anti-halation layer, the first protective layer and the second protective layer in sample No. 601 (or 602) had the same compositions as in sample No. 401 (or 402).

Sample Nos. 601 and 602 were exposed and subsequently processed as in Example 4 and their performance was evaluated as in Example 4. Sample No. 602 of the present invention was obviously improved over comparative sample No. 601 with respect to sensitivity and keeping quality.

As described above, the silver halide photographic material of the present invention contains silver halide grains of normal crystal form and yet is has good aging stability and exhibits high sensitivity, particularly upon spectral sensitization.

What is claimed is:

1. A silver halide photographic material comprising one or more silver halide emulsion layers on a support, wherein at least one of said emulsion layers contains normal crystal silver halide grains having at least one concave crystal face, said silver halide grains having a core/shell structure comprising a core surrounded by a shell having a different composition than said core, said silver halide grains having been grown from silver halide grains referred to as AgX (1) grains which are grown in the presence of fine silver halide grains referred to as AgX (2) grains, wherein said AgX (2) grains have a solubility product equal to or less than the solubility product of said AgX (1) grains.

2. A silver halide photographic material according to claim 1 wherein said silver halide grains in said silver halide emulsion layer are composed of silver iodobromide or silver chloroiodobromide.

3. A silver halide photographic material according to claim 2 wherein said silver halide grains in said silver halide emulsion layer are composed of silver iodobromide.

4. A silver halide photographic material according to claim 1 wherein said shell has a silver iodide content of 2–40 mol %.

5. A silver halide photographic material according to claim 1 wherein at least one silver halide emulsion layer contains a compound capable of releasing a bleach accelerator or a precursor thereof upon reaction with the oxidation product of a color developing agent.

6. A process for producing the silver halide photographic material of claim 1, comprising preparing an emulsion containing silver halide grains which are grown from silver halide grains referred to as AgX (1) grains which are grown in the presence of fine silver halide grains referred to as AgX (2) grains, wherein said AgX (2) grains have a solubility product equal to or less than the solubility product of said AgX (1) grains.

7. A silver halide photographic material according to claim 1 wherein at least one emulsion layer which contains silver halide grains of normal crystal form having at least one concave crystal face contains a compound capable of releasing a bleach accelerator or a precursor thereof upon reaction with the oxidation product of a color developing agent.

8. A silver halide photographic material according to claim 5 wherein said compound capable of releasing a bleach accelerator or a precursor thereof upon reaction with the oxidation product of a color developing agent is represented by the following general formula [BAR-I]:

$$A\text{-}\overset{\overset{\displaystyle O}{\|}}{C}\text{)}_{l}\text{-(TIME)}_{m}\text{-BA} \qquad \text{[BAR-I]}$$

wherein A represents a coupler residue capable of coupling reaction with the oxidation product of a color developing agent, or a redox primary nuclear residue capable of cross-oxidation with the oxidation product of a color developing agent; TIME represents a timing group; BA represents a bleach accelerator or a precursor thereof; m is 0 or 1; when A is a coupler residue, l is 0, and when A is a redox primary nuclear residue, l is 0 or 1.

9. A silver halide photographic material according to claim 8 wherein said compound represented by the formula [BAR-I] is a compound represented by either of the following formulas [BAR-II] and [BAR-III]:

$$*\overset{\overset{\displaystyle Cp}{|}}{}\text{(TIME)}_{m}\text{-S-R}_1\text{-R}_2 \qquad \text{[BAR-II]}$$

-continued $$\begin{array}{l} Cp \\ | \\ (TIME)_m-O-(CO)_n-R_1-S-R_3 \end{array} \qquad \text{[BAR-III]}$$

wherein Cp represents a coupler residue capable of coupling reaction with the oxidation product of a color developing agent;* represents a coupling site for the coupler; TIME represents a timing group; $R_1$ represents an aliphatic group, an aromatic group, a saturated heterocyclic group, or a 5- or 6-membered nitrogen-containing aromatic heterocyclic group; $R_2$ represents a water-soluble substituent or a precursor thereof; $R_3$ represents a hydrogen atom, a cyano group,

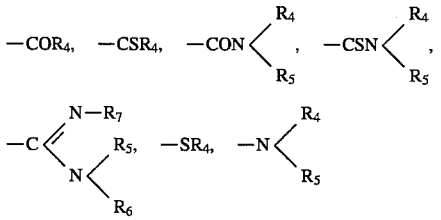

or a heterocyclic group (wherein $R_4$ is an aliphatic or aromatic group; $R_5$, $R_6$ and $R_7$ are each a hydrogen atom, an aliphatic group or an aromatic group); and m and n are each 0 or 1.

10. A silver halide photographic material according to claim 1, wherein said at least one emulsion layer containing silver halide grains further contains at least one dye selected from members of the general formulas (S-I), (S-II), (S-III) and (S-IV):

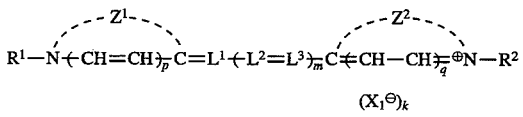

(S-I)

where $Z^1$ and $Z^2$ are the same or different and each is a group of non-metallic atoms necessary to form a 5- or 6-membered hetero ring; $R^1$ and $R^2$ are the same or different and each is an unsubstituted or substituted alkyl group; , $L^1$, $L^2$ and $L^3$ are each an unsubstituted or substituted methine group; p and q are each 0 or 1; m is 0, 1, 2 or 3, provided that when m is 2 or 3, each $-(L^2=L^3)-$ may be the same or different; $X_1^-$ is an anion; and k is 0 or 1;

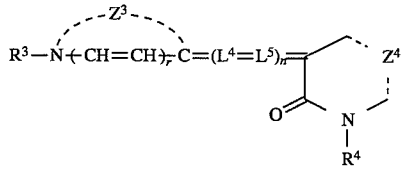

(S-II)

where $Z^3$ is a group of non-metallic atoms necessary to form a 5- or 6-membered hetero ring; $R^3$ is an unsubstituted or substituted alkyl group; $L^4$ and $L^5$ are each an unsubstituted or substituted methine group; $Z^4$ is a group of non-metallic atoms necessary to form a 5- or 6-membered hetero ring; $R^4$ is a hydrogen atom, an unsubstituted or substituted alkyl group, an unsubstituted or substituted aryl group, or a heterocyclic group; r is 0 or 1; and n is 0, 1, 2 or 3;

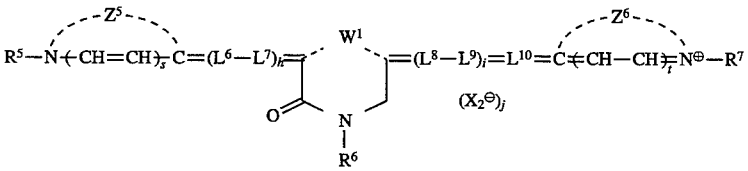

(S-III)

where $Z^5$ and $Z^6$ are the same or different and each is a group of non-metallic atoms necessary to form a 5- or 6-membered hetero ring; and $R^5$ and $R^7$ are the same or different and each is an unsubstituted or substituted alkyl group; $R^6$ is a hydrogen atom, an unsubstituted or substituted alkyl group, an unsubstituted or substituted aryl group, or a heterocyclic group; $L^6$, $L^7$, $L^8$, $L^9$ and $L^{10}$ are each an unsubstituted or substituted methine group; $W^1$ is a group of non-metallic atoms necessary to form a 5- or 6-membered hetero ring; s and t are each 0 or 1; h and i each is 0, 1, 2 or 3; $X_2^-$ is an anion; and j is 0 or 1;

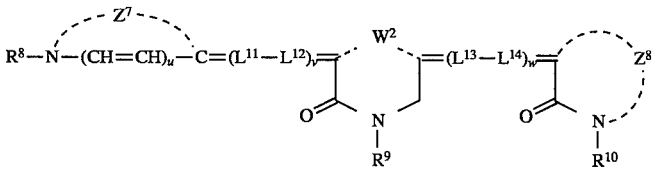

(S-IV)

where $Z^7$ and $Z^8$ are the same or different and each is a group of non-metallic atoms necessary to form a 5- or 6-membered hetero ring; $W^2$ is a group of non-metallic atoms necessary to form a 5 or 6-membered hetero ring; $R^8$ is an unsubstituted or substituted alkyl group;

$R^9$ and $R^{10}$ are each a hydrogen atom, an unsubstituted or substituted alkyl group, an unsubstituted or substituted aryl group, or a heterocyclic group; $L^{11}$, $L^{12}$, $L^{13}$ and $L^{14}$ are each an unsubstituted or substituted methine group; u is 0 or 1; and v and w each is 0, 1, 2 or 3.

11. A silver halide photographic material according to claim 1 wherein said silver halide grains in said silver halide emulsion layer have at least one silver halide component of silver chloride, silver bromide, silver chlorobromide, silver iodobromide or silver chloroiodobromide.

12. A silver halide photographic material according to claim 5 wherein said shell has a multilayer structure in which a shell having a homogeneous or nonhomogeneous silver halide composition is coated with one or more shells having a different silver halide composition than said first shell.

13. A silver halide photographic material according to claim 5 wherein said core has a higher average silver iodide content than said shell.

14. A silver halide photographic material according to claim 1 wherein said silver halide grains in said silver halide emulsion layer have (III) faces.

15. A process for producing the silver halide photographic material of claim 2, comprising growing silver halide grains comprising silver iodobromide or silver chloroiodobromide from silver halide grains referred to as AgX(1) grains which are grown in the presence of iodide ions from silver halide grains referred to as AgX (2) grains, wherein said AgX (2) grains have a solubility product which is less than the solubility product of said AgX (1) grains.

* * * * *

UNITED STATES PATENT AND TRADEMARK OFFICE

CERTIFICATE OF CORRECTION

PATENT NO. : 5,541,052
DATED : July 30, 1996
INVENTOR(S) : OKUSA et al.

It is certified that error appears in the above-indentified patent and that said Letters Patent is hereby corrected as shown below:

Claim 8, col. 204, line 58, change "1" to –/–; and line 59, change "1" to –/–.

Signed and Sealed this

Twenty-fifth Day of February, 1997

*Attest:*

*Attesting Officer*

BRUCE LEHMAN

*Commissioner of Patents and Trademarks*